US009693660B1

(12) United States Patent
Stelmarski et al.

(10) Patent No.: US 9,693,660 B1
(45) Date of Patent: Jul. 4, 2017

(54) REPOSITIONABLE AND ADJUSTABLE BASKETS SHELVES AND ACCESSORIES

(71) Applicant: InterDesign, Inc., Solon, OH (US)

(72) Inventors: Brian Stelmarski, Hudson, OH (US); Radu Alexandru Ghiorghie, Copley, OH (US)

(73) Assignee: InterDesign, Inc., Solon, OH (US)

( * ) Notice: Subject to any disclaimer, the term of this patent is extended or adjusted under 35 U.S.C. 154(b) by 271 days.

(21) Appl. No.: 14/174,195

(22) Filed: Feb. 6, 2014

Related U.S. Application Data

(60) Provisional application No. 61/761,362, filed on Feb. 6, 2013, provisional application No. 61/789,415, filed on Mar. 15, 2013.

(51) Int. Cl.
*A47F 5/01* (2006.01)
*A47K 3/28* (2006.01)
*F16M 13/02* (2006.01)

(52) U.S. Cl.
CPC ..... *A47K 3/281* (2013.01); *A47F 5/01* (2013.01); *F16M 13/02* (2013.01)

(58) Field of Classification Search
CPC .. A47F 5/01; A47F 5/08; A47F 5/0838; A47F 5/0846; A47F 5/0853; A47G 29/08; A47G 29/087; A47K 3/28; A47K 3/281; F16M 13/02
USPC ..... 211/113, 119, 119.009, 153; D6/525
See application file for complete search history.

(56) References Cited

U.S. PATENT DOCUMENTS

| | | | | | |
|---|---|---|---|---|---|
| 3,789,996 | A * | 2/1974 | Stroh | A47K 3/281 | 211/106 |
| D286,599 | S * | 11/1986 | Sussman | D6/525 | |
| 5,031,783 | A * | 7/1991 | Goudreau | A47F 5/13 | 211/106 |
| D446,670 | S * | 8/2001 | Emery | D6/525 | |
| 6,520,351 | B1 * | 2/2003 | Zadro | A47K 3/281 | 211/106 |
| D512,861 | S * | 12/2005 | Rosen | D6/525 | |
| D552,391 | S * | 10/2007 | Rosen | D6/525 | |
| D568,657 | S * | 5/2008 | Snider | D6/525 | |
| D568,658 | S * | 5/2008 | Yang | D6/525 | |
| D615,333 | S * | 5/2010 | Snell | D6/525 | |
| D632,514 | S * | 2/2011 | Didehvar | D6/525 | |
| D676,696 | S * | 2/2013 | Primeau | D6/525 | |
| 2004/0188369 | A1 * | 9/2004 | Yu | A47K 5/04 | 211/106 |
| 2005/0252872 | A1 * | 11/2005 | Eisele | A47B 57/42 | 211/187 |
| 2008/0000859 | A1 * | 1/2008 | Yang | A47B 57/26 | 211/90.02 |
| 2008/0047913 | A1 * | 2/2008 | Naden | A47K 3/281 | 211/119.009 |
| 2008/0224011 | A1 * | 9/2008 | Chang | A47K 3/281 | 248/317 |
| 2010/0102014 | A1 * | 4/2010 | Yang | A47K 3/281 | 211/113 |

(Continued)

FOREIGN PATENT DOCUMENTS

DE 29804520 U1 * 5/1998 ..... A47B 55/02

*Primary Examiner* — Joshua Rodden
(74) *Attorney, Agent, or Firm* — Calfee Halter & Griswold, LLP

(57) ABSTRACT

The present application discloses shelving systems (e.g., shower stations) with adjustable shelves (e.g., baskets) that can be moved by hand.

20 Claims, 94 Drawing Sheets

(56) References Cited

U.S. PATENT DOCUMENTS

| | | | | |
|---|---|---|---|---|
| 2011/0163054 | A1* | 7/2011 | Yu | A47B 55/02<br>211/94.02 |
| 2012/0091088 | A1* | 4/2012 | Didehvar | A47B 45/00<br>211/113 |
| 2012/0159748 | A1* | 6/2012 | Carney | A47K 3/281<br>24/457 |

* cited by examiner

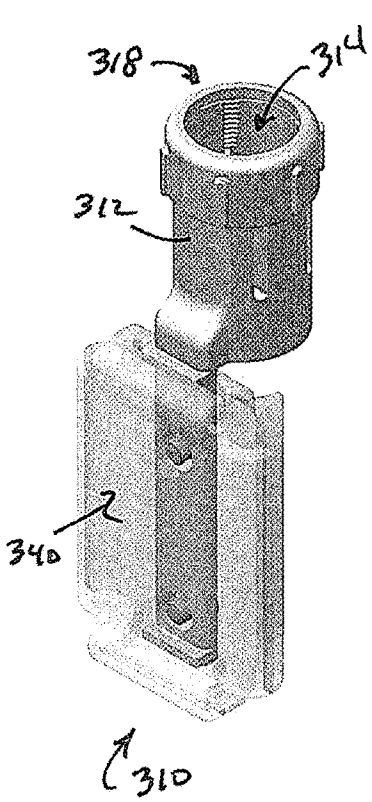
Fig. 27A
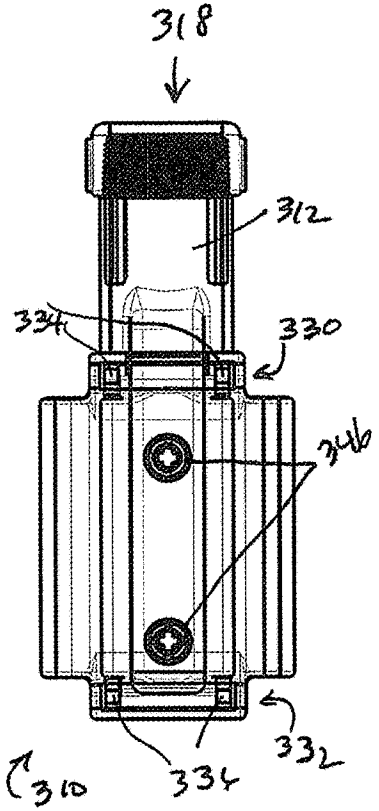
Fig. 27B
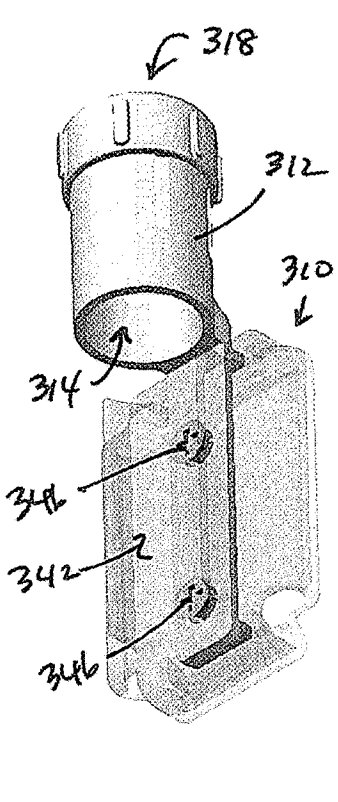
Fig. 27C
Fig. 27D 450
470
150
16
156
154
152

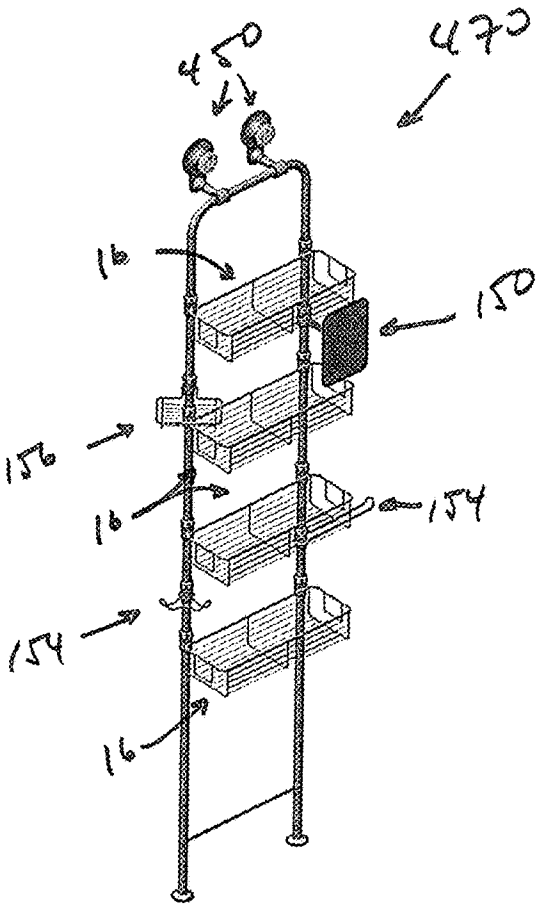
1
1
1

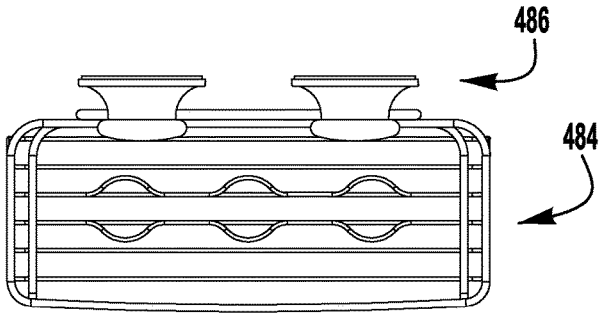
FIG. 35C
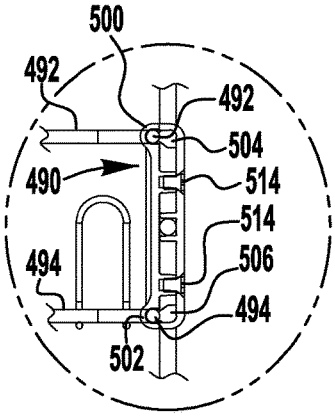
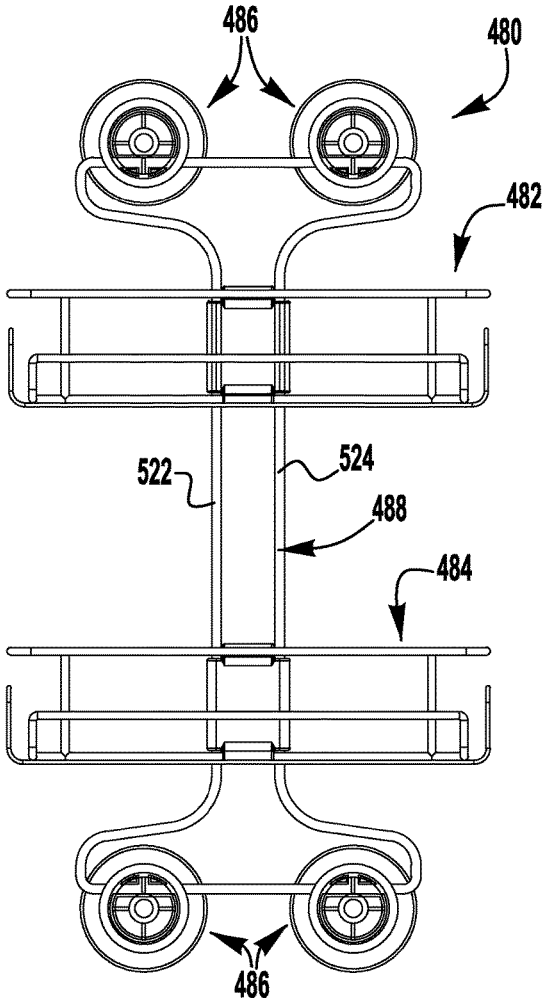
FIG. 35A
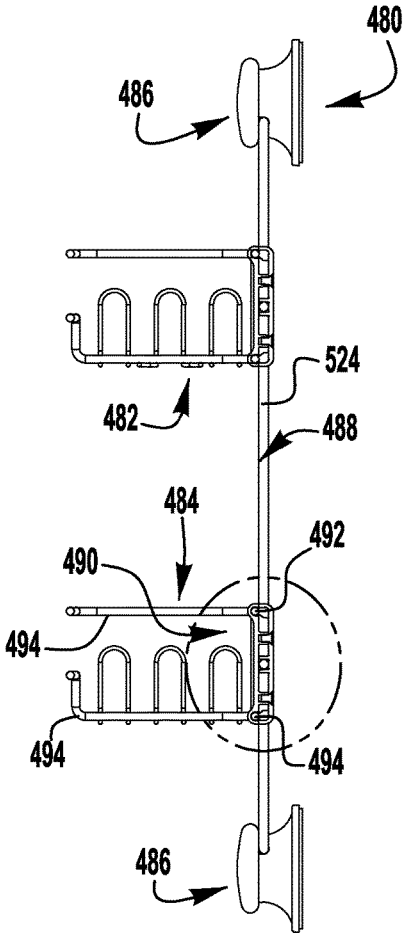
FIG. 35B

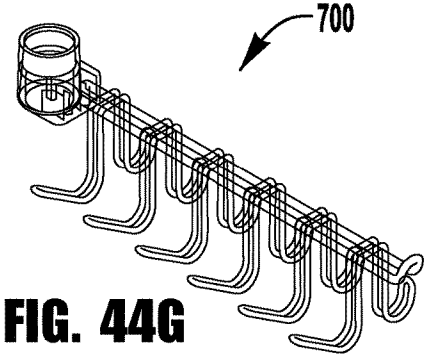
FIG. 44G
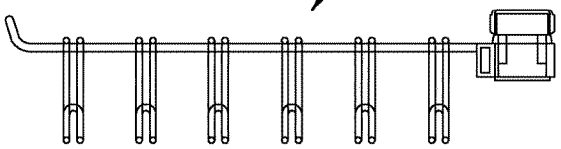
FIG. 44E
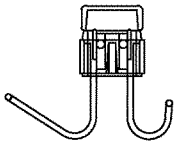
FIG. 44B
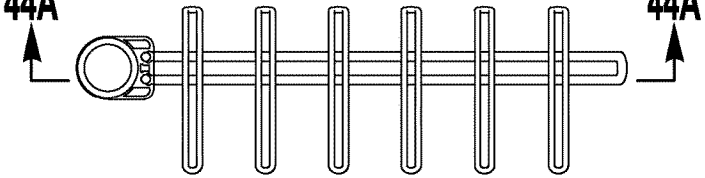
FIG. 44C
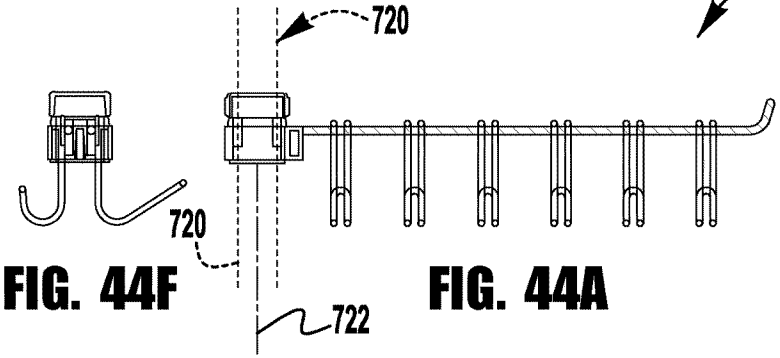
FIG. 44A
FIG. 44F
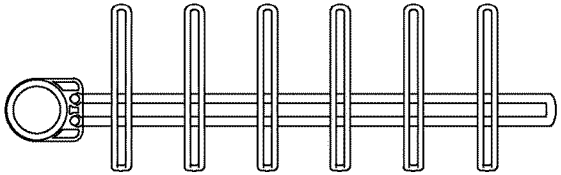
FIG. 44D

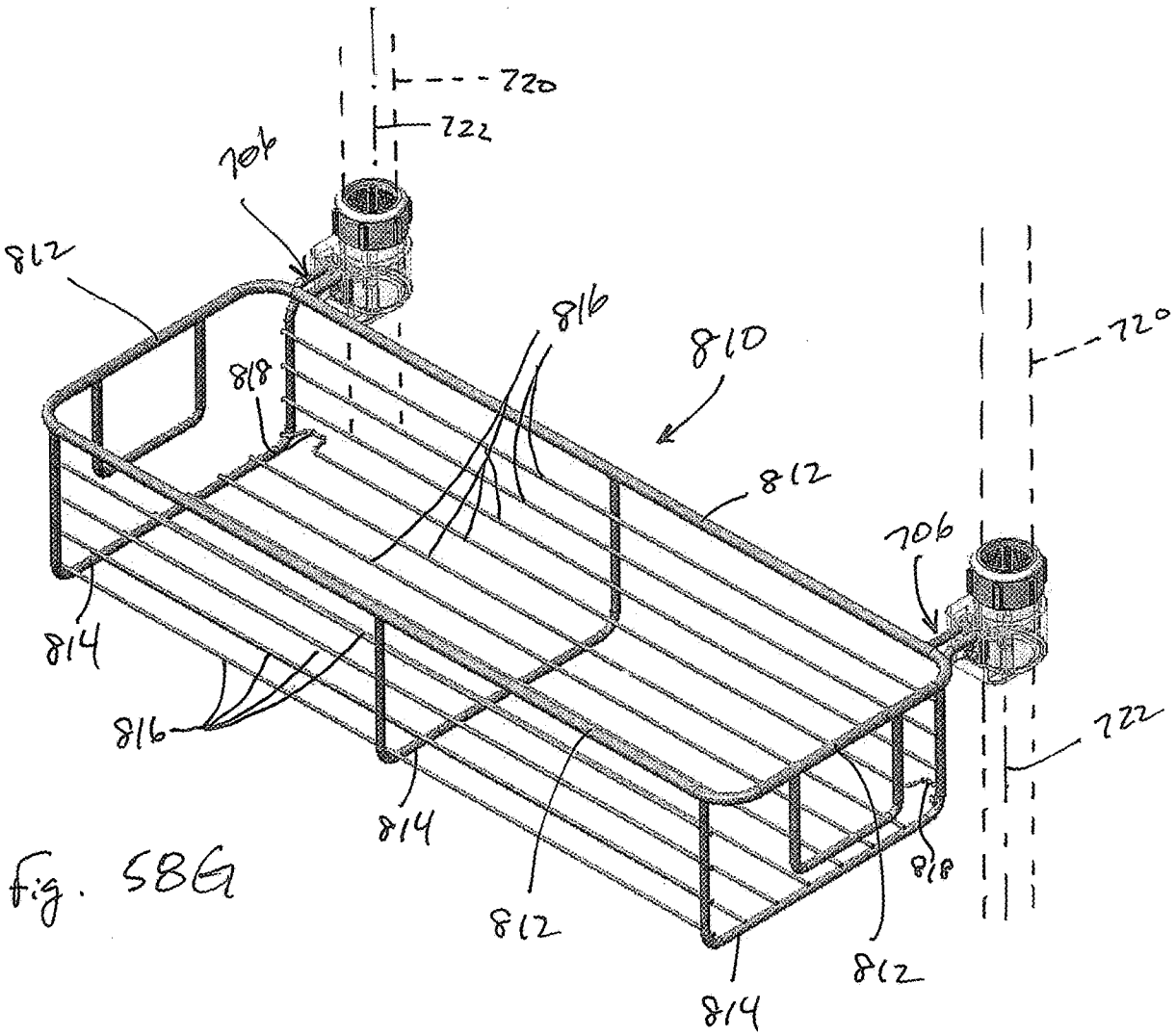
220
222
706
818
218
818
818
818

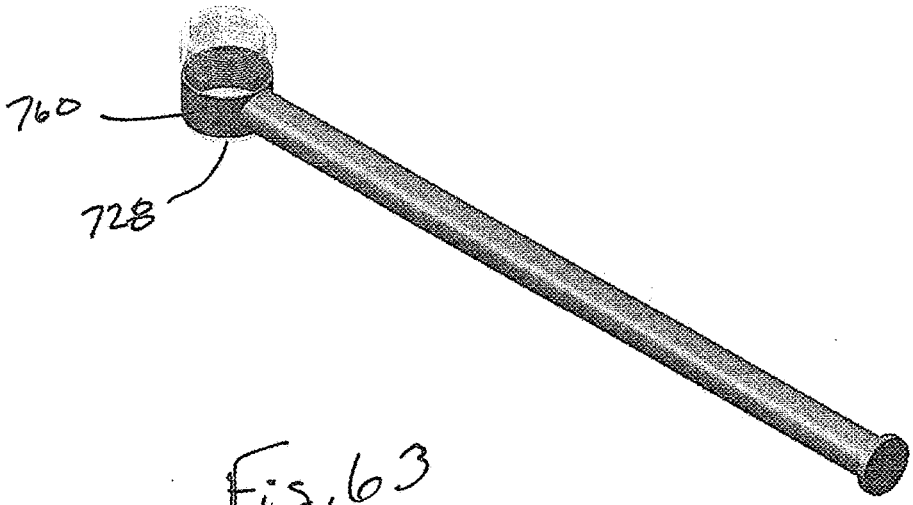
Fig. 63
Fig. 64
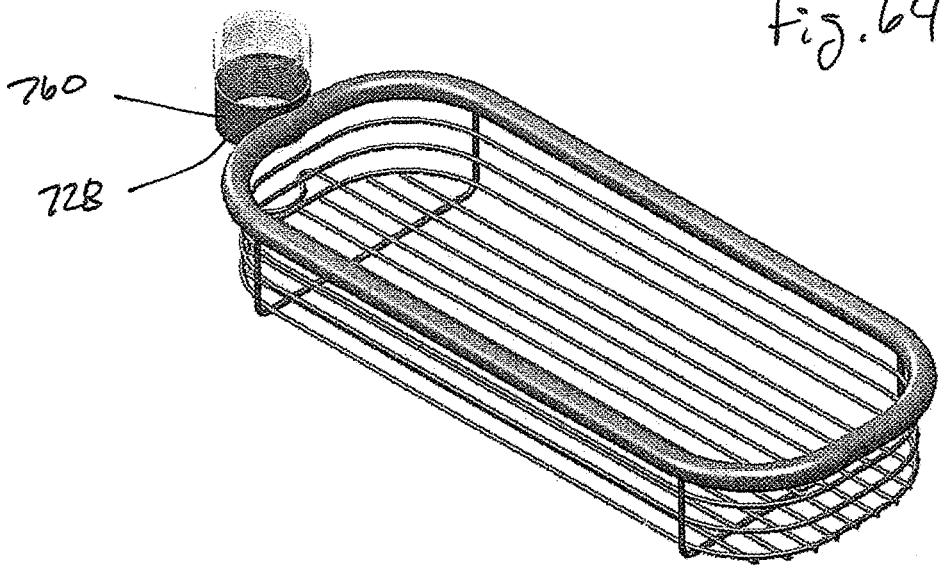

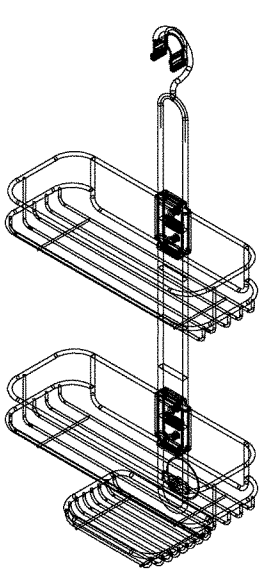
FIG. 75D
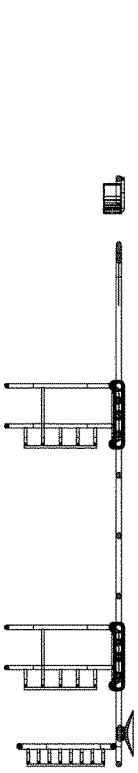
FIG. 75C
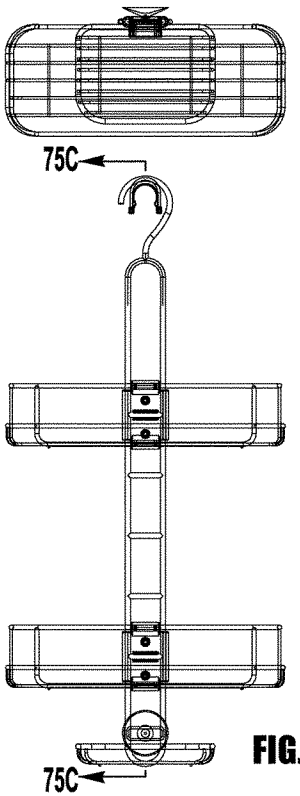
FIG. 75B
FIG. 75A

REPOSITIONABLE AND ADJUSTABLE BASKETS SHELVES AND ACCESSORIES

CROSS REFERENCE TO RELATED APPLICATIONS

This application claims priority to, and any other benefit of, U.S. Provisional Patent Application Ser. No. 61/761,362, filed on Feb. 6, 2013, and entitled Adjustable Shower Stations, and U.S. Provisional Patent Application Ser. No. 61/789,415, filed on Mar. 15, 2013, and entitled Repositionable and Adjustable Baskets Shelves and Accessories, which two applications are hereby incorporated by reference in their entireties, except where directly conflicting with the present application. This application is related to U.S. Design patent application Ser. No. 29/444,254, filed on Jan. 29, 2013, and entitled Items; and U.S. Design patent application Ser. No. 29/449,963, filed on Mar. 15, 2013, and entitled Items, which two applications are hereby incorporated by reference in their entireties, except where directly conflicting with the present application.

BACKGROUND

Shower caddies and shower stations are convenient means to store shampoo, conditioner, shaving cream, body wash, soap, and other items used in a shower. However, typical shower caddies and shower stations have a fixed configuration, which might not accommodate taller bottles used in a shower.

Additionally, tension poles extending between floor and ceiling can be used to support various storage devices. In known tension pole storage devices, it is not possible to easily re-sequence the various storage devices supported by the pole. For example, if one wants to re-sequence one storage device above or below another, one must disassemble the assembly sufficient to change the order of the storage devices on the tension pole.

SUMMARY

The present application discloses shelving systems (e.g., shower stations and tension poles) with adjustable and/or repositionable shelves (e.g., baskets) and accessories and/or improved means for connecting shelving to a shower pipe and/or improved means for connecting shelving to a shower wall.

In an exemplary embodiment, a caddy is provided comprising a frame having first and second spaced, elongate wire portions; a plurality of shelves carried by the frame in such a manner that when the first and second spaced, elongate wire portions of the frame are in a substantially vertical orientation, the shelf or basket is in a substantially horizontal orientation; and at least one bracket slidably retaining at least one respective shelf to the first and second spaced, elongate wire portions frame; the bracket configured to tightly secure itself to the first and second spaced, elongate wire portions of the frame; and the bracket further configured to secure itself to the respective shelf to permit the respective shelf to be moved horizontally relative to the frame by hand without tools and without loosening a fastener or latching mechanism. In exemplary embodiments, the bracket comprises first and second halves secured to each other with the first and second spaced, elongate wire portions of the frame positioned therebetween to tightly secure the bracket to the first and second spaced, elongate wire portions of the frame. In exemplary embodiments, an exemplary shelf is formed from at least first and second basket wire portions; and the first basket wire portion is slidably secured in a first basket wire channel of the first bracket half on one side and on the other side by a first projection of the second bracket half and wherein the second basket wire portion is slidably secured in a second basket wire channel of the first bracket half on one side and on the other side by a second projection of the second bracket half In an exemplary embodiment, an adjustable shelf or basket is provided, permitting the shelf or basket to be re-sequenced on a frame without disassembling the frame and without tools and including: a shelf or basket affixed to at least one support that supports the shelf or basket; and at least one adapter having a frame opening extending therethrough that accepts and is supported by a portion of a frame in a vertical orientation when in use, the adapter also having at least one support opening that removably accepts a portion of the at least one support, wherein the at least one support and the at least one adapter cooperate to support the shelf or basket and retain a surface of the shelf or basket in a horizontal orientation when the portion of the frame is in a vertical orientation; and wherein the at least one support can be removed from the at least one adapter by hand without tools permitting the shelf or basket to be removed from the at least one adapter by hand without tools. The adapter can be supported by a compression sleeve, which permits the shelf or basket to be adjusted up or down by loosening a compression collar, moving the adapter and compression sleeve to a desired location, and retightening the compression collar.

Another exemplary embodiment is an adjustable accessory permitting the accessory to be re-sequenced on a frame without disassembling the frame and without tools and including: an accessory (e.g., one of a mirror, towel bar, dish, and hook) affixed to at least one support that supports the accessory; and at least one adapter having a frame opening extending therethrough that accepts and is supported by a portion of a frame in a vertical orientation when in use, the adapter also having at least one support opening that removably accepts a portion of the at least one support; wherein the at least one support and the at least one adapter cooperate to support the accessory and retain the accessory in an in-use orientation when the portion of the frame is in a vertical orientation; and wherein the at least one support can be removed from the at least one adapter by hand without tools permitting the accessory to be removed from the at least one adapter by hand without tools. The adapter can be supported by a compression sleeve, which permits the accessory to be adjusted up or down by loosening a compression collar, moving the adapter and compression sleeve to a desired location, and retightening the compression collar.

BRIEF DESCRIPTION OF DRAWINGS

In FIG. 26B, the baskets are centered. In FIG. 26C, the baskets have been shifted horizontally without using tools.

FIGS. 27A-28B show a bracket carrying a compression sleeve to provide movable baskets and shelves.

FIGS. 34A-34G show still another exemplary shower station embodiment.

FIGS. 35A-37C show yet another exemplary shower station embodiment

FIGS. 40A-41H show still another exemplary shower station embodiment.

FIGS. 43, 44A-44K, 45A-45K, 46A-46K, 47-54, 55A-55G, 56A-56G, and 57 show various views of accessories using an adapter that permits the accessories to be removed from and attached to a frame without disassembling the frame and without tools, permitting the accessories to be re-sequenced on a frame, without disassembling the frame and without tools.

FIGS. 58A-58L, 59A-59L, 60A-60L show various views of baskets and shelves using a pair of adapters that permit the baskets and shelves to be removed from and attached to a frame without disassembling the frame and without tools, permitting the baskets and shelves to be re-sequenced on a frame, without disassembling the frame and without tools.

FIGS. 61-66B and 70-72 show various views of additional exemplary accessories.

FIGS. 73-77 show various views of another shower caddy using the bracket of FIGS. 36A-36B.

DETAILED DESCRIPTION

This Detailed Description merely describes exemplary embodiments of the invention and is not intended to limit the scope of the claims in any way. Indeed, the invention as claimed is broader than and unlimited by the preferred embodiments, and the terms used in the claims have their full ordinary meaning.

Figure 1:
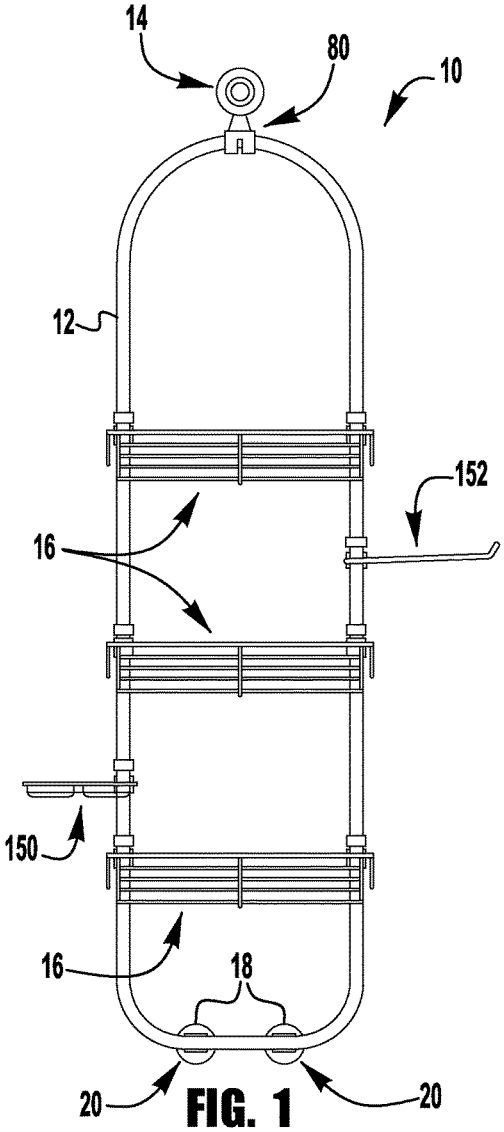
FIGS. 1 and 2 are front elevational and right side elevational views of an exemplary shower station according to the present application.
Figure 2:
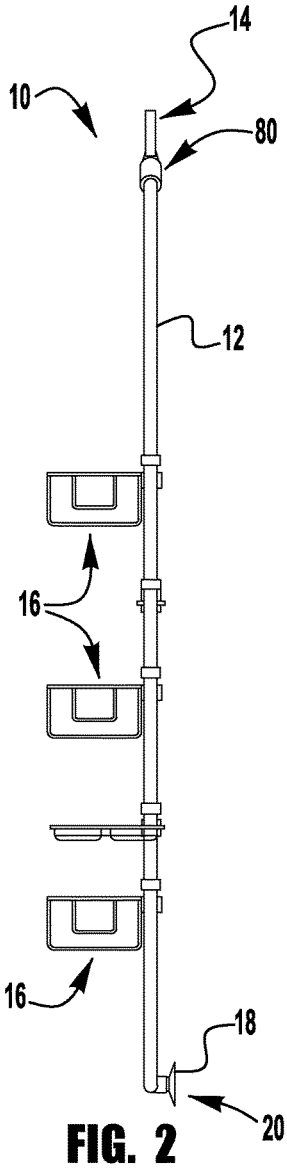

The present application discloses shelving systems (e.g., shower stations and shower caddies) with adjustable shelves (e.g., baskets) and/or improved means for connecting shelving to a shower pipe and/or improved means for connecting shelving to a shower wall. Referring now to FIGS. 1-2, an exemplary shower station 10 is shown. Shower station 10 comprises a frame 12, a pivot hook 14 affixed to the frame 10, a plurality of adjustable baskets 16 adjustably affixed to the frame 12, and one or more section cups 18 removably affixed to the frame 12 via respective suction cup clips 20.

Figure 4:
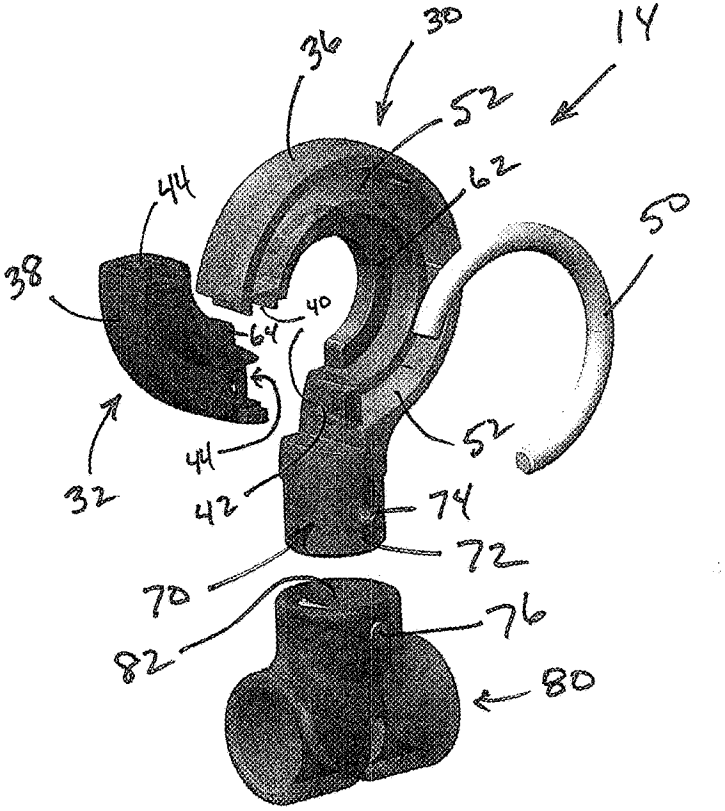
FIGS. 3 and 4 are rear elevational and perspective exploded views of an exemplary pivot hook according to the present application.
Figure 3:
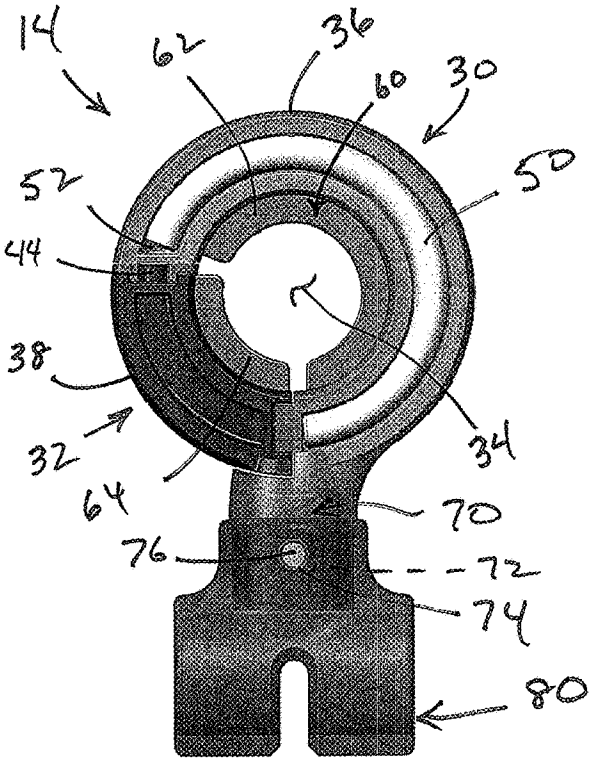
Figure 7:
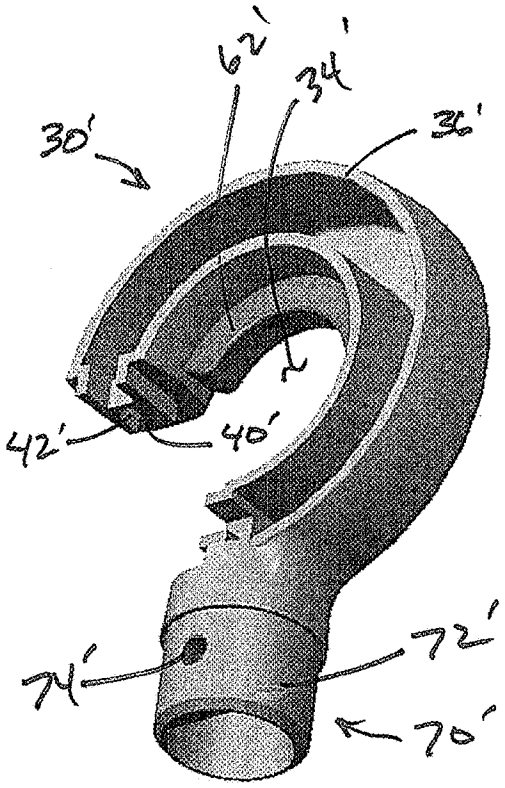
FIGS. 6 and 7 are perspective views of a first portion of another exemplary pivot hook.
Figure 6:
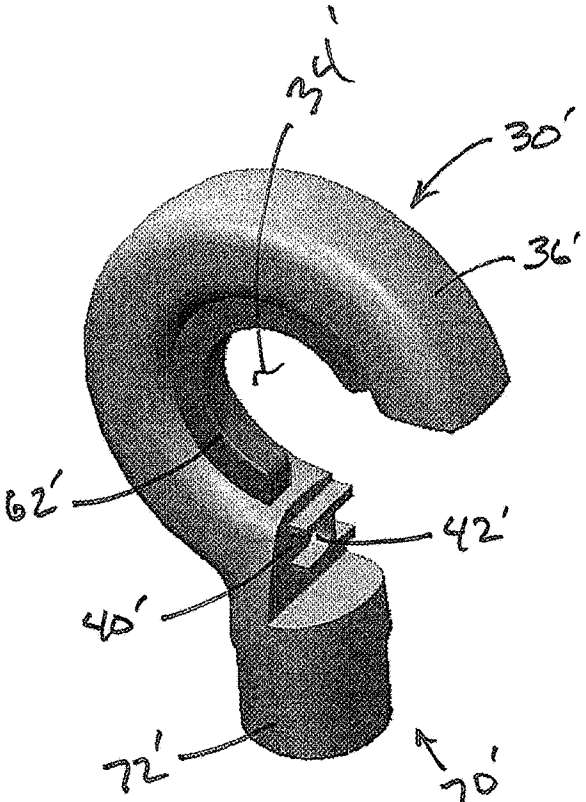
Figure 5:
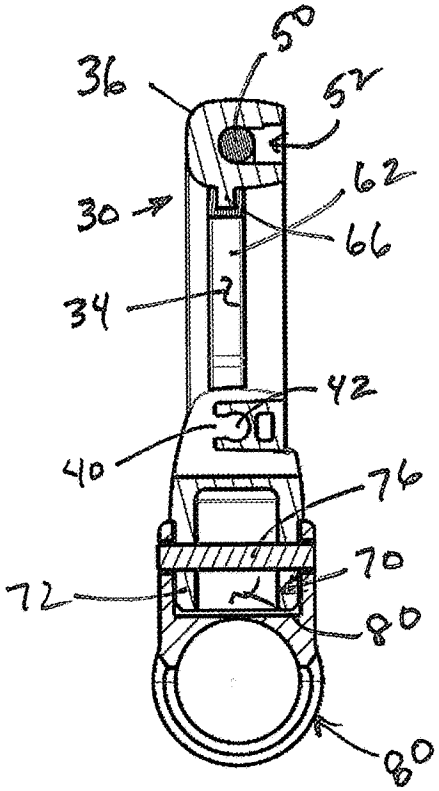
FIG. 5 is a vertical sectional view of a portion of the pivot hook of FIGS. 3-4.
Figure 9:
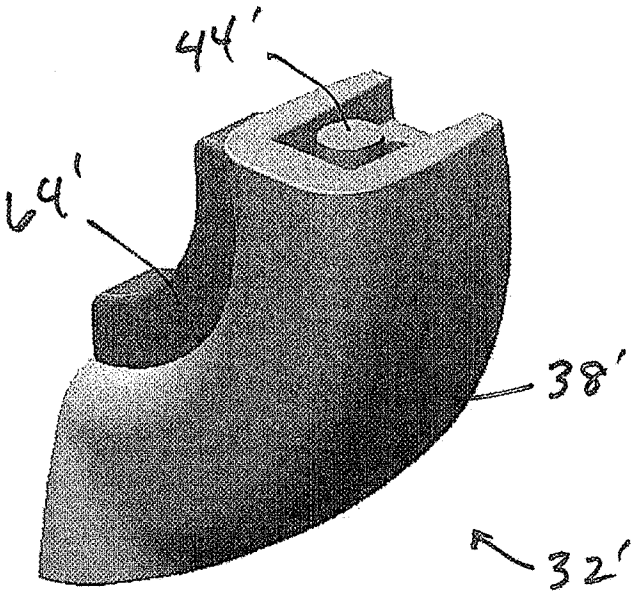
FIGS. 8 and 9 are perspective views of a second portion of the other pivot hook.
Figure 8:
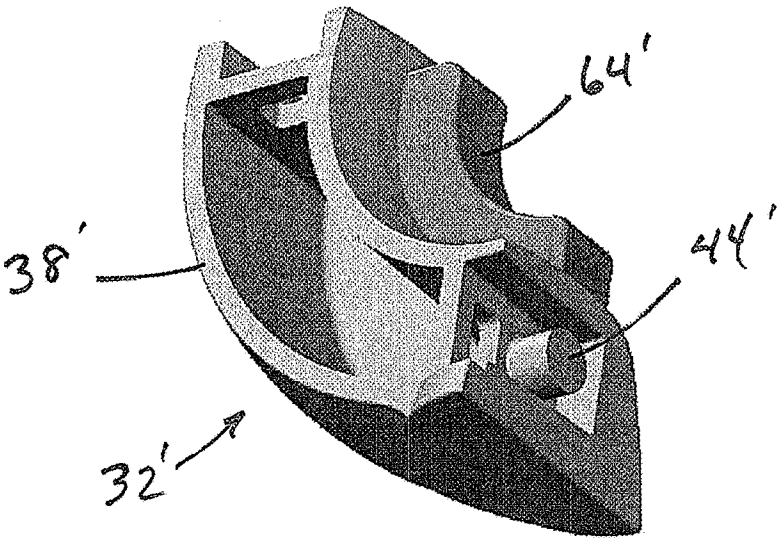
Figure 11:
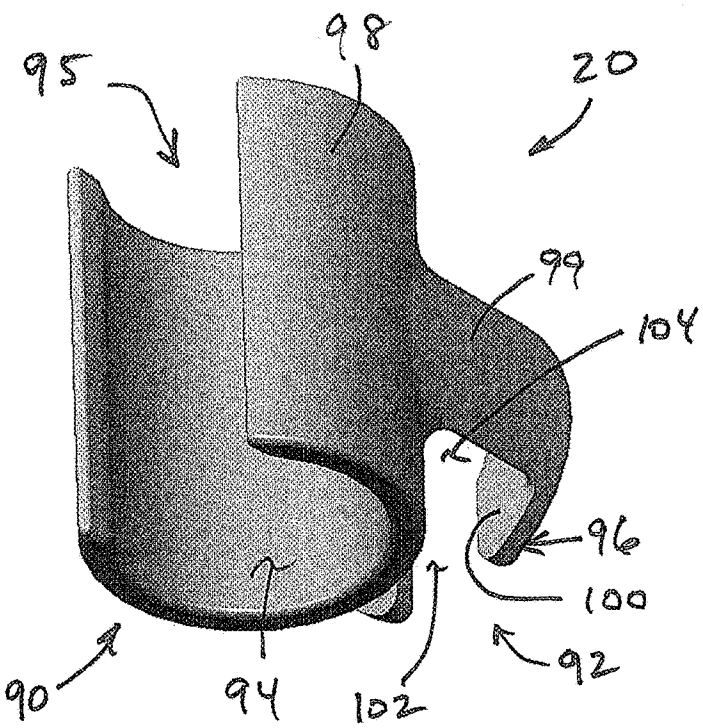
FIGS. 10-11 show perspective views of an exemplary suction cup clip.
Figure 10:
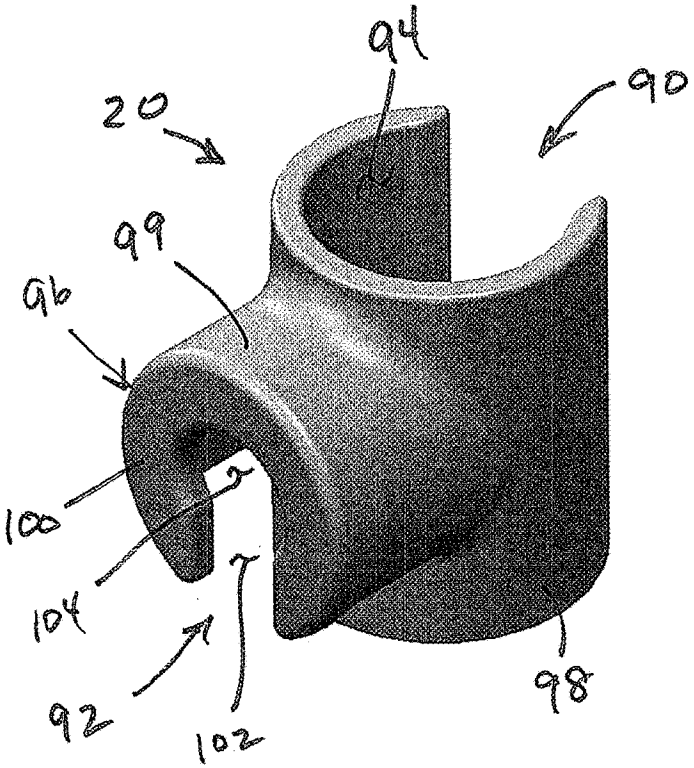
Figure 13:
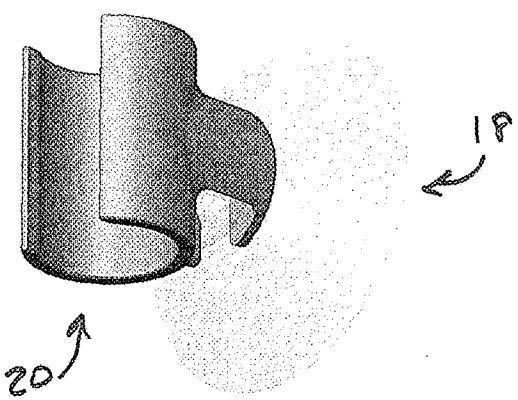
FIGS. 12-13 show perspective views of exemplary suction cup clip with a suction cup.
Figure 15B:
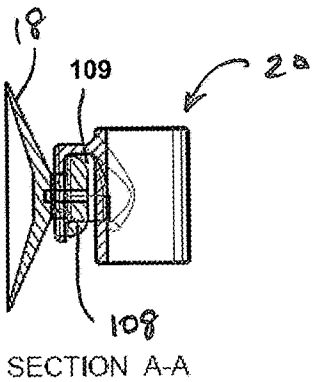
FIGS. 14A-15B show various views of the exemplary cup clip.
Figure 12:
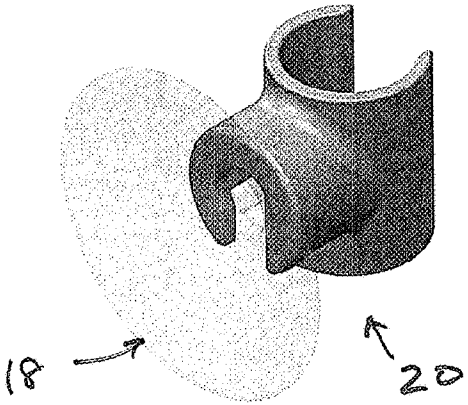
Figure 15A:
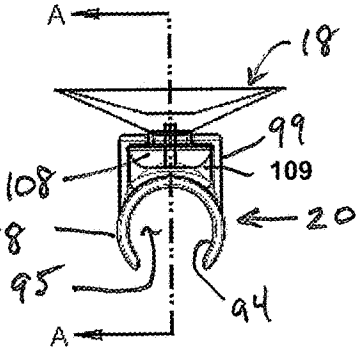
Figure 14E:
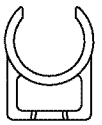
Figure 14A:
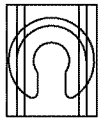
Figure 14D:
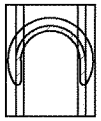
Figure 14B:
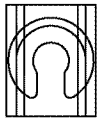
Figure 14B:
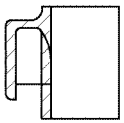
Figure 14C:
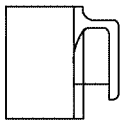
Figure 14F:
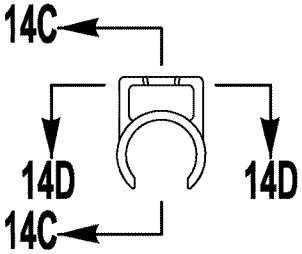

Referring now to FIGS. 3-5, an exemplary pivot hook 14 is shown. Pivot hook 14 can be used to attach a shower station, such as shower station 10, to a shower pipe (FIG. 31) or other protrusion (not shown). The pivot hook 14 comprises a first portion 30 and a second portion 32. The first and second portions 30, 32 together form a space through which the shower pipe extends to suspend the shower station 10. In this example, the first and second portions 30, 32 connect to form an annulus with an enclosed space 34 through which the shower pipe or other protrusion extends to support the system 10. The annulus in this example is substantially circular; other closed shapes forming a space could also suffice, e.g., oval-shaped, egg-shaped, triangular, rectangular, etc. The first portion 30 of the pivot hook 14 comprises a section 36 of about 270 degrees of the approximately circular annulus. The second portion 32 of the pivot hook 14 comprises a section 38 of about 90 degrees of the approximately circular annulus. In the alternative, differently-sized sections could also be used for the two sections 36, 38, e.g., 260 degrees and 100 degrees, 280 degrees and 80 degrees, and other groups of two sections (or three or more sections) adding up to about 360 degrees to form a close shape with a space for the shower pipe.

The various portions of the pivot hook interlock or are otherwise affixed to form a sturdy annulus to support the pivot hook and a corresponding shelving unit by a shower pipe or other support. For example, the various portions might be affixed using an interference-fit joint or a snap-fit joint, e.g., a cantilever snap joint and/or an annular snap joint and/or a torsional snap joint, or some other means of quickly connecting the portions without tools. The ability to quickly form a closed pivot hook without tools is a significant advantage over typical shower caddies. In exemplary embodiments, the portions of the pivot hook are connected by hand to form the pivot hook without tools using, e.g., a force of about 5 pounds, or a force of 4-7 pounds or a force of 3-10 pounds or a force of 5-15 pounds used to press the two pieces together to interlock them. In the example of FIGS. 3 and 4, a user aligns the first and second portions 30, 32 and applies a force to snap the first and second portions 30, 32 together to form the pivot hook. More specifically, the first portion 30 of the pivot hook 14 and the second portion 32 of the pivot hook 14 interlock using a snap-fit joint, with the first portion 32 having a tapered slot 40 ending in a space 42 that accepts a post 44 on the second portion 32. The portions 30, 32 of the pivot hook 14 are connected by hand to form the pivot hook 14 without tools using a force of about 5 pounds, or a force of 4-7 pounds or a force of 3-10 pounds or a force of 5-15 pounds used to press the two pieces 30, 32 together to interlock them.

Optionally, the pieces of the pivot hook can be configured so that some of the pieces forming the pivot hook can be separated by hand without tools to remove the pivot hook and corresponding shelving unit from the shower pipe or other support. The ability to quickly open a closed pivot hook without tools is a significant advantage over typical shower caddies. For example, in the case of pivot hook portions snap-fit together, the pieces could be configured so that a force in a direction opposite the locking direction, e.g., a force of about 5 pounds, or a force of 4-7 pounds or a force of 3-10 pounds or a force of 5-15 pounds used to separate the two pieces together to disconnect them.

Figure 42:
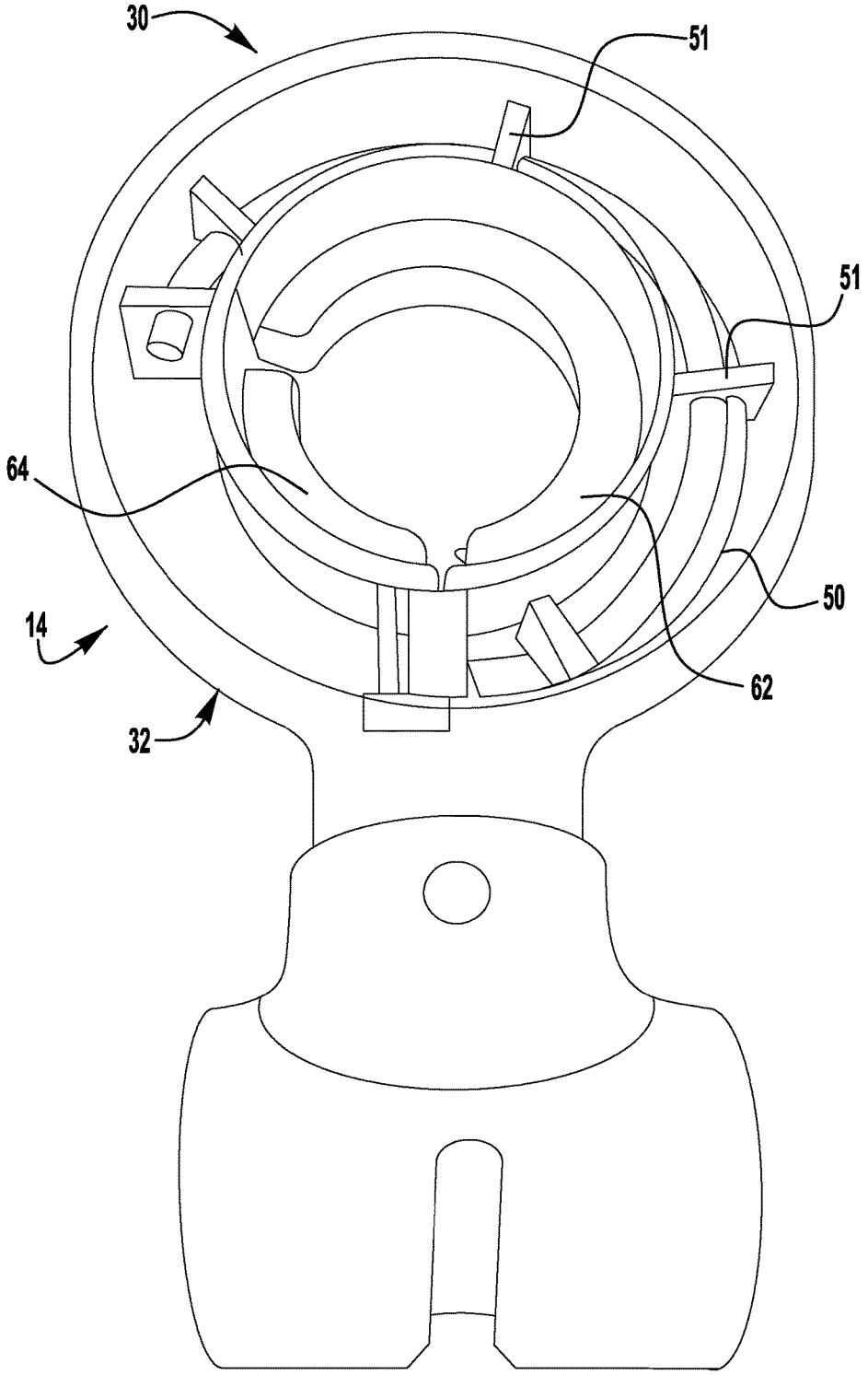
FIG. 42 shows an additional view of pivot hook 14 and associated optional C-shaped support piece of FIGS. 3-5.

The pivot hook 14 of FIGS. 3-5 has an optional internal support to improve the strength of the pivot hook and prevent it from flexing under the weight of the shower station (or other mass or force) and distorting, which might disconnect the first portion 30 from the second portion 32 or pull the pivot hook 14 off of the shower pipe. More specifically, pivot hook 14 has an optional C-shaped piece of metal 50 (e.g., bent steel wire) that conforms to an internal cavity 52 of the first portion 30 to improve the strength of the pivot hook and prevent it from flexing under the weight of the shower station (or other mass or force) and distorting, which might disconnect the first portion 30 from the second portion 32 or pull the pivot hook 14 off of the shower pipe. The cavity 52 and support 50 are configured so that the support begins at a point 54 below the space 34, extends up and around the space 34 (which permits it to extend up and over the shower pipe or other support), and extends back down to a point 56 below the top of the space (which permits it to extend down below the top of the shower pipe or other support). The support 50 can be insert molded in the pivot hook, e.g., insert molded into ribs 51 (FIG. 42) of pivot hook 14. In the alternative, support 50 can be press-fit, snap-fit, or interference-fit in the cavity, or secured by other means, e.g., adhesive or ultrasonic welding.

The pivot hook 14 of FIGS. 3-5 also has an optional flexible spacer 60 that can cause the pivot hook 14 to firmly engage the shower pipe or other support (or engage the shower pipe or other support with less slack space therebetween). The spacer 60 in this example is formed by a first piece of material 62 affixed to the inside wall of first portion 30 and a second piece 64 affixed to the inside wall of second portion 32. The pieces 62, 64 can be made of rubber or another elastic material that has been affixed to first and second portions 30, 32, respectively, e.g., press-fit, snap-fit, or interference-fit in the cavity, or secured by other means, e.g., adhesive. The portions 30, 32 of pivot hook 14, as shown in FIG. 5, have an integrally molded inward flange 66 that extends into a similarly-sized slot in the rubber pieces 62, 64. As shown in FIG. 3, the pieces 62, 64 substantially surround the space 34, which causes the pieces to firmly engage a shower pipe. The radial distance between the inner surfaces of pieces 62, 64 will be determined by the target shower pipe diameter and the compressibility of the material chosen for the pieces 62, 64. For a shower pipe having a diameter of ¾" inches, radial distance between the inner surfaces of pieces 62 and 64 is an interference fit, with pieces 62, 64 formed out of soft durometer plastic.

The pivot hook 14 also has a means for connecting to the frame 12 of the shower station 10, e.g., integrally forming one portion 30, 32 with the frame 12 or otherwise affixing the frame 12 to one of the portions 30, 32, e.g., with a fastener, press-fit, snap-fit (cantilever snap joint and/or an annular snap joint and/or a torsional snap joint), or interference-fit, or secured by other means, e.g., adhesive. In the example of FIGS. 3-5, the first portion 30 of pivot hook 14 has a connector 70 than can connect to a vertical member integral with or otherwise attached to the frame 12. Connector 70 has a cylindrical portion 72 with an opening 74 extending through one side. A pin 76 can be used to connect the connector 70 to a frame 12 of a shower station. Connector 70 can directly connect to shower carries and other shower stations having a vertical member extending down from the shower pipe or other support (e.g., the example of FIG. 31).

In the shower station of FIGS. 1-2, the frame 12 extends perpendicular to the connector 70, so a T-connector 80 is used. The T-connector can be integrally formed with connector 70 or otherwise affixed with a fastener, press-fit, snap-fit (cantilever snap joint and/or an annular snap joint and/or a torsional snap joint), or interference-fit, or secured by other means, e.g., adhesive. In the example of FIGS. 3-5, T-connector 80 has a first portion forming a cylindrical cavity 82 that accepts cylindrical portion 72 of connector 70. The pin 76, which is a friction fit into both cylindrical portions, secures the T-connector 80 to the connector 70 of the pivot hook 14. The T-connector 80 shown also has a second cavity 84 that is perpendicular to the cavity 82. The second cavity can accept a piece or tubing or another portion of frame 12.

FIGS. 6-9 show first and second portions 30', 32' that are the same as first and second portions 30, 32 described above, except first and second portions 30', 32' do not have the metal support ring 50 and is made from thinner material. Like parts of first and second portions 30', 32' have been identified with reference characters the same as first and second portions 30, 32, except the have been primed. The snap-fit components 40, 42, 44 are virtually identical to snap-fit components 40', 42', 44' that are shown in FIGS. 6-9.

Using the inventive pivot hook 14 ought to be straightforward based on this disclosure. The first portion 30 affixed to the frame 12 is hung from the shower pipe or other support, the second portion 32 is aligned with the first portion, and the second portion is pressed to snap-fit the second portion 32 to the first portion 30, which closes the space 34 and firmly engages the spacers 62, 64 with the shower pipe or other support. No tools are required and the shower station 10 is quickly and securely attached to the shower pipe.

Referring back to FIG. 1, the shower station 10 has a plurality of section cups 18 removably affixed to the frame 12 via respective suction cup clips 20. The suction cup clips 20 snap-fit to tubing forming the frame 12, which permits very easy assembly and permits the clips 20 and respective suction cups 18 to be moved to different locations on the frame without tools, e.g., to avoid grout spaces between tiles. Additionally, the suction cup clips snap-fit to the suction cups, which permits easy assembly and easy replacement of the suction cups without tools.

FIGS. 10-15B show an exemplary suction cup clip 20 and suction cup 18. Exemplary suction cup clip 20 comprises a first portion 90 coupled to a second portion 92. The first portion 90 is configured to removably couple to a tubular frame member of frame 12 without tools or fasteners or adhesive. The second portion 92 is configured to removably couple to suction cup 18 without tools. More specifically, the first portion 90 comprises a piece with a cylindrical inside surface 94 forming a cylindrical inside space 95 coupled to a snap-fit connector 96 forming the second portion 92. The specific example of FIGS. 10-15B, the first portion 90 comprises or consists of a section of a cylinder 98 having a cylindrical hollow therein and a radial opening into the cylindrical hollow portion (as though a portion of the cylindrical wall had been removed to form the radial opening). Thus, the first portion 90 has an opening each end (each being a section of a circle) and a longitudinally extending (extending in the same direction as the axis of the cylindrical hollow) radial opening running the length of the cylindrical wall. This gives the first portion 90 a saddle shape, as can be seen from the figures. A tubular member of frame 12 is this held in place simply by the cylindrical walls flexing to permit entry and flexing back to secure the tube to the first portion 90. This is coupled to the second portion 92, which comprises or consists of a second section of a cylinder 99 having a cylindrical hollow, with an end cap 100 having a narrow channel 102 that widens into a wider space 104 that accepts a narrow portion 106 (FIGS. 15A and 15B) of suction cup 18. A wide portion 108 of the suction cup 18 is inside a hollow 109 formed by the second section of a cylinder 99.

In exemplary embodiments, the suction cup clip 20 can be configured and material and material thickness chosen to provide a target force required to force the clip 20 onto a member of frame 12 and, perhaps, a target force to remove the clip 20 from the frame member. The specific suction cup clip 20 of FIGS. 10-15B can be connected to a frame member using, e.g., a force of 5-6 pounds or a force of 4-7 pounds used to press the two pieces together to interlock them.

Referring back to FIG. 1, the shower station 10 has a plurality of adjustable baskets 16. The baskets 16 are adjustable in the sense that they may be adjusted vertically along the frame 12 without tools without fasteners and without adhesives. More specifically, the shelves 16 carry (e.g., affixed thereto) a compression sleeve that is secured to a tubular member forming the frame 12 by a compression collar threaded to the compression sleeve.

Figure 16:
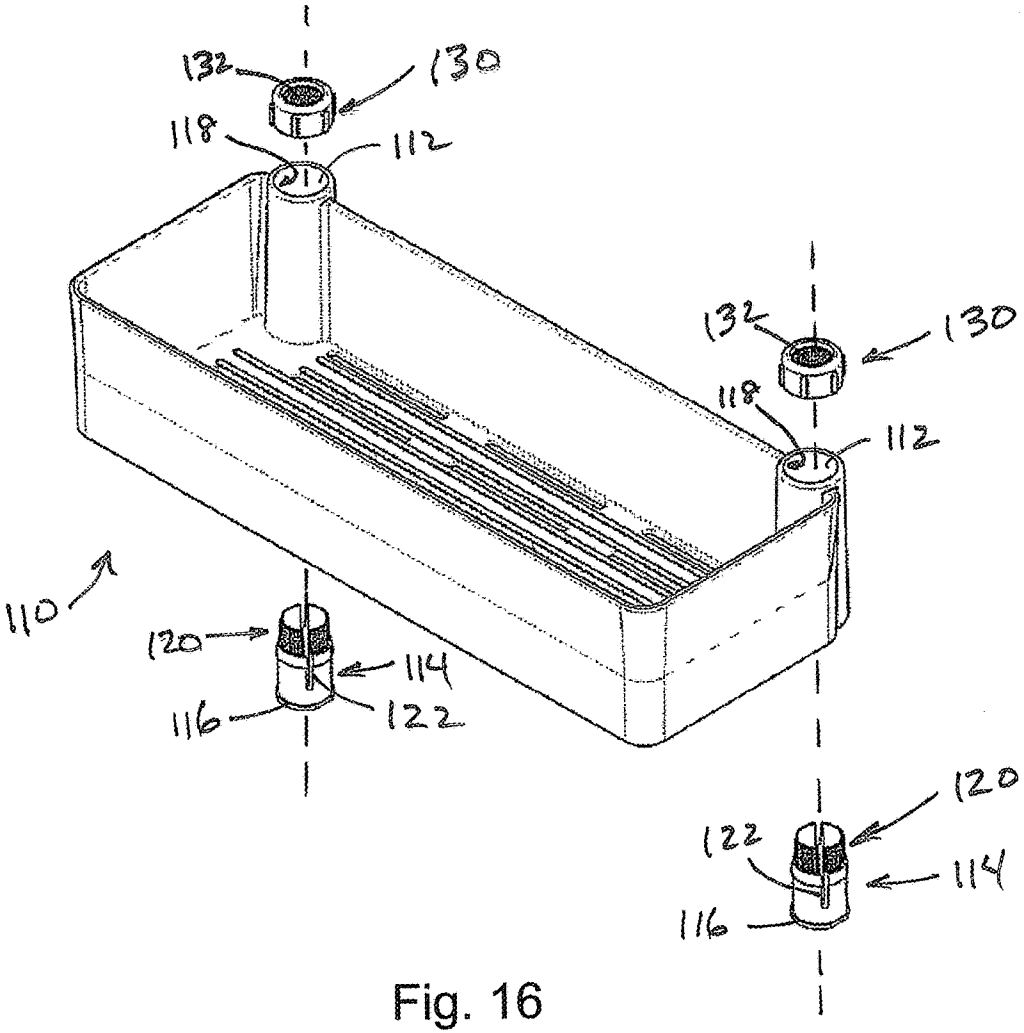
FIGS. 16 and 17 show an exemplary adjustable basket.
Figure 17:
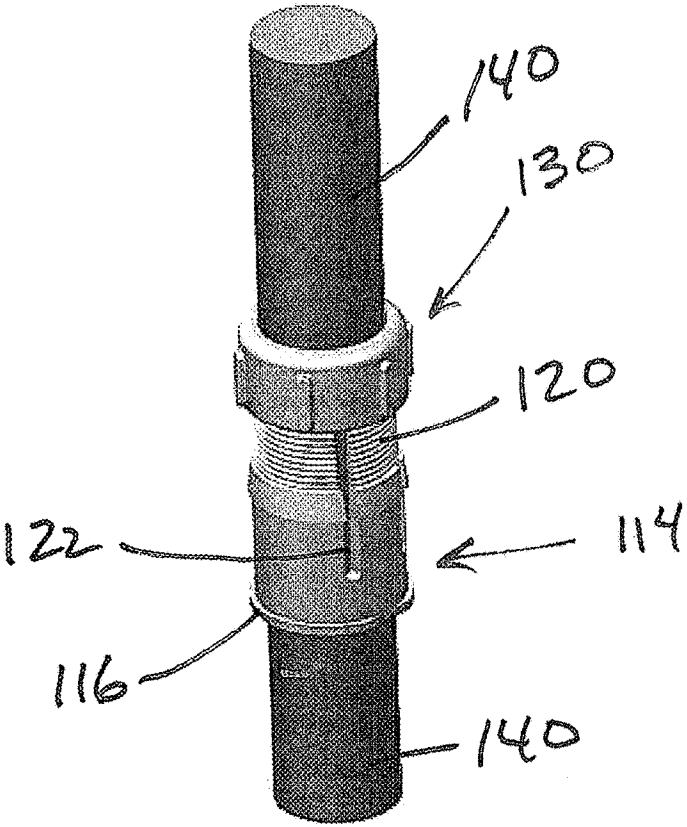

Referring to FIGS. 16-17, an exemplary adjustable basket 110 is shown. Although FIG. 1 shows wire shelves/baskets, the application applies equally to other shelves such as the molded shelf shown in FIG. 16. Adjustable basket 110 has a plurality of vertically oriented openings 112 that accept a compression sleeve 114 that has a flange 116. The compression sleeve 114 is inserted into the opening 112 from below and the flange 116 engages a flange 118 inside the opening 112, which flange retains the sleeve 114 in the opening 112 by preventing further movement upward inside the opening 112. In the alternative, a flange on the compression sleeve 114 engages the bottom of the collar or other structure with the opening 112 and that retains the sleeve in the opening by preventing further movement upward inside the opening 112. The compression sleeve 114 has a threaded end 120 at an upper end and a plurality of notches 122 that permit the opening of the compression sleeve 114 to decrease in diameter as a compression collar 130 is having a threaded inner surface 132 threaded onto the threaded end 120 of the sleeve 114. In the alternative, the shelf can be molded with an integral compression collar having slots and a threaded end. Referring now to FIG. 17, during assembly, a tubular member 140 is inserted into the compression sleeve 114, which has already been inserted into opening 112 of basket 110 (the basket 110 is not shown in FIG. 17 to permit the compression sleeve to be seen), and a compression collar 130 also placed over the tubular member 140. Next, basket 110 is positioned in a desired location and compression collar is threaded onto the threaded end 120 of sleeve 114 to tighten the opening of the sleeve 114 and secure the basket 110 to the tubular member 140. To move the shelf, the one or more compression collars are loosened, the shelf height is adjusted, and the compression collars are re-tightened.

Figure 19:
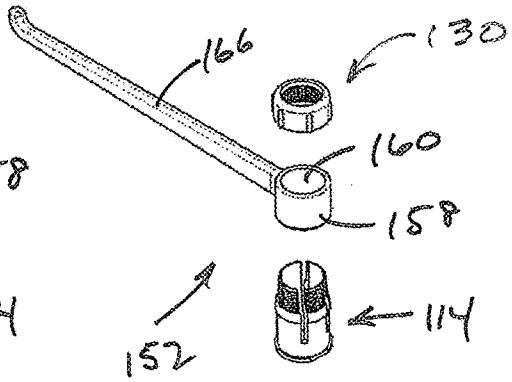
FIGS. 18-21 show exemplary adjustable accessories.
Figure 18:
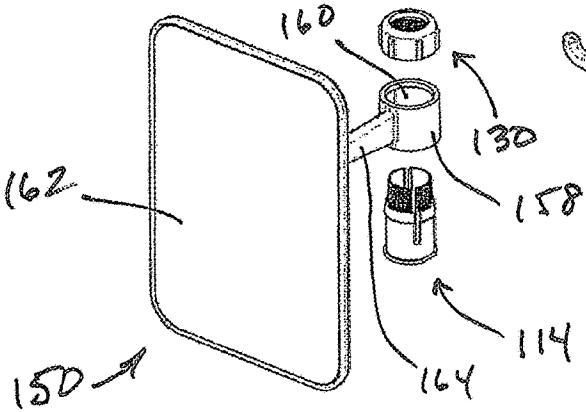
Figure 21:
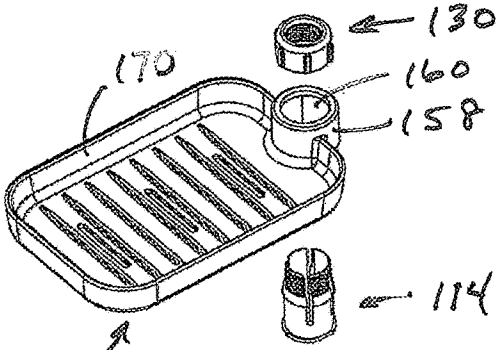
Figure 20:
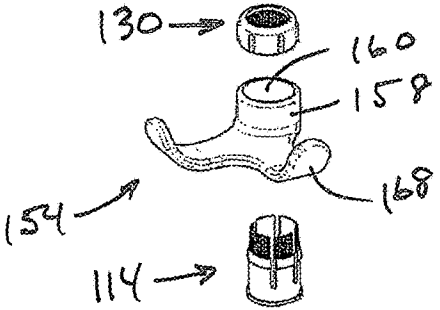

Compression sleeves and collars can be used to movably secure various accessories to a tubular member 140 of a frame 12. Shower station 10 is shown in FIG. 1 with a soap dish and a pivoting towel bar held in place to the frame 12 by a compression sleeve and collar. Referring now to FIGS. 18-21, various accessories are shown. They can each be held in place to the frame 12 by a compression sleeve and collar and can be adjusted vertically by loosening the compression collar, moving the accessory, and re-tightening the collar. A kit with written instructions having the foregoing adjustment instructions printed thereon can be included with a shower caddy or shower caddy kit or shower station or shower station kit including any one or any two or more of these accessories 150, 152, 154, 156. FIG. 18 shows a moveable mirror 150, FIG. 19 shows a pivoting towel bar 152, FIG. 20 shows a moveable double-hook 154, and FIG. 21 shows a moveable soap dish 156. Each of these has a collar 158 having an opening 160 with an inner flange like opening 112 and flange 118 discussed above. In the alternative, a flange on the compression sleeve 114 engages the bottom of the collar or other structure with the opening 160 and that retains the sleeve in the opening by preventing further movement upward inside the opening 160. Thus, each collar 158 can retain in the opening a compression sleeve 114 extending upward therethrough, as discussed above in connection with basket 110. The collar 158 of each of the accessories carries an accessory. More specifically, collar 158 of moveable mirror 150 carries a mirror 162 on arm 164, collar 158 of pivoting towel bar 152 carries a towel bar 166, collar 158 of moveable double-hook 154 carries a hook 168, and collar 158 of moveable soap dish 156 carries a soap dish 170. These accessories can each be held in place to the frame 12 by a compression sleeve and collar and can be adjusted vertically by loosening the compression collar, moving the accessory, and re-tightening the collar. Additionally, the collar 158 of each of these accessories can each be configured to have the accessory be capable of rotating about the axis of tubular member 140 of frame 12 when secured in place by the compression sleeve 114 and collar 130. In the alternative, the collar 158 of each of these accessories can each be configured to have the accessory be incapable of rotating (i.e., fixed) about the axis of tubular member 140 of frame 12 when secured in place by the compression sleeve 114 and collar 130.

Figure 22:
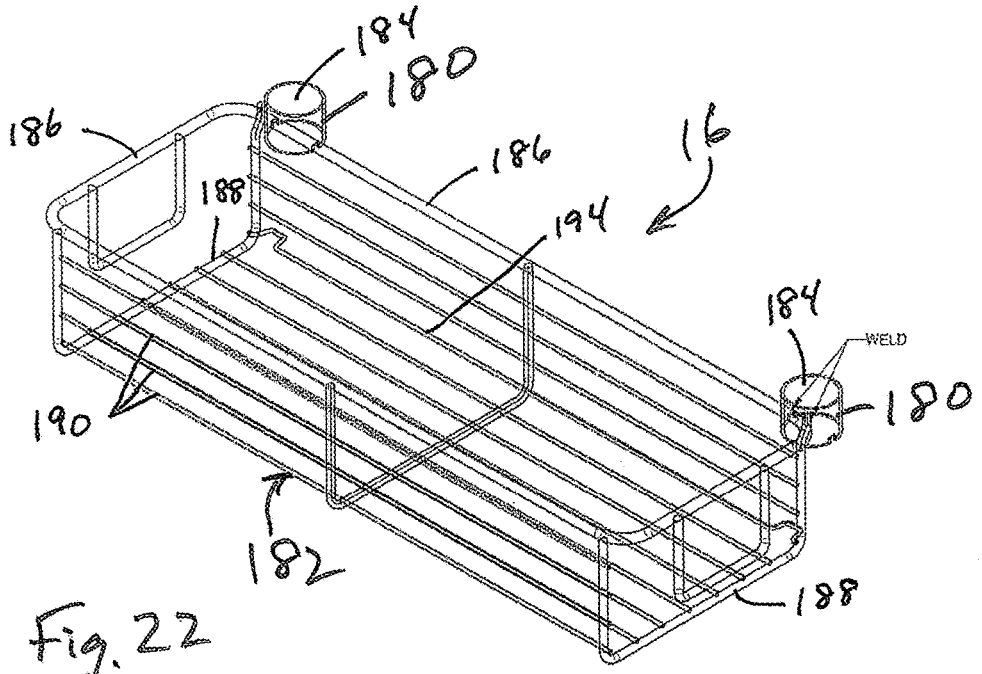
FIGS. 22 and 23 show another exemplary adjustable basket.
Figure 23:
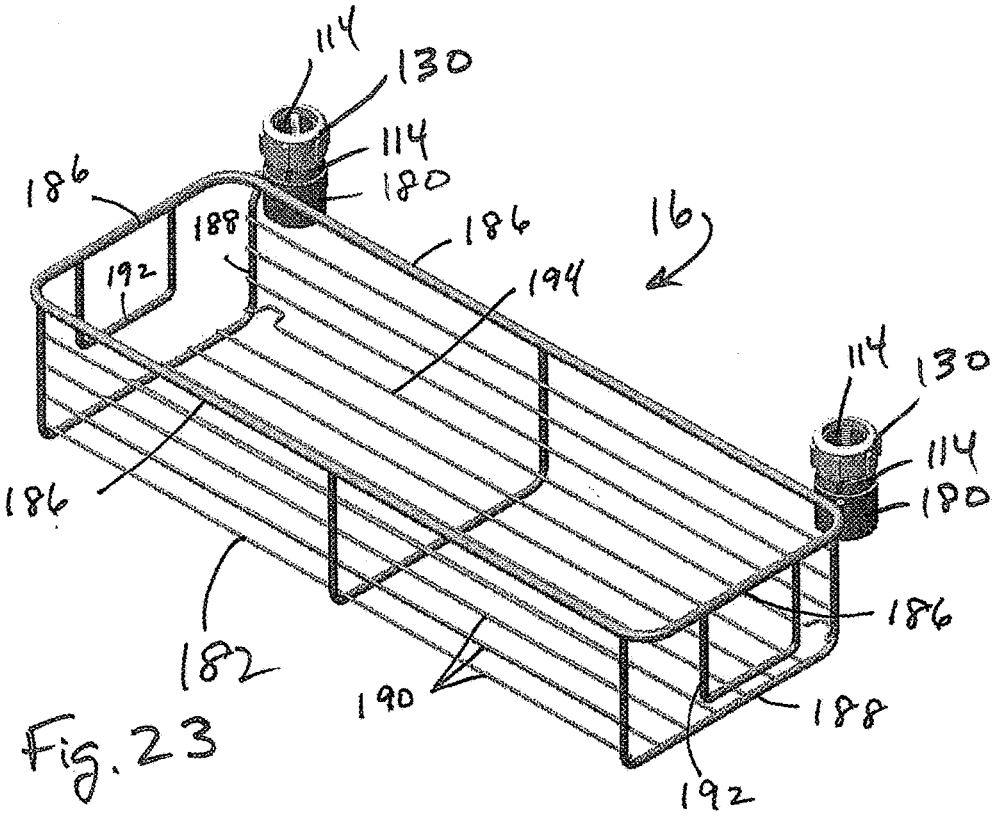

FIGS. 22 and 23 show an adjustable wire basket 16 modified to be held in place to the tubular members of frame 12 by a compression sleeve 114 and collar 130 and configured to be adjusted vertically by loosening the compression collars 130, moving the basket 16, and re-tightening the collars 130. A kit with written instructions having the foregoing adjustment instructions printed thereon can be included with a shower caddy or shower caddy kit or shower station or shower station kit including one or two or more of these adjustable wire baskets 16. The adjustable wire basket 16 has a collar 180 welded to a basket 182 in locations where it is to be carried by the frame via compression sleeves 114 and compression collars 130. Like the openings of basket 110, collars 180 of basket 16 have a vertically oriented opening 184 that accepts and is supported by a compression sleeve 114 (retains in the sense that the compression sleeve can be inserted only so far into the opening 184 and then it stops). In the alternative, a compression sleeve can be affixed to the basket in desired locations using different means, e.g., by adhesives, over-molding, fasteners, etc. The basket 182 is formed from at least one main support wire 186 and a plurality of secondary support wires 188 extending from the main support wire 186. A plurality of basket wires 190 extend between each wire of the secondary support wires 188 and perhaps also extend between wires of the secondary support wires 188 and the main support wire 186. All these wires can be welded together or otherwise affixed. The main support wire 186 can be made from 0.08" to 0.25" wire, the secondary support wires 188 can be made from 0.04" to 0.10" thick steel, and the basket wires can be made from 0.08" to 0.16" steel wire. In this example, a stop is formed at each lateral end of the basket 182 by a wire 192 extending between one part of the main support wire 186 and another part of the main support wire 186. Also, in this example, the collar 180 is welded to the main support wire 186, but it could also optionally be affixed to some of the secondary support wires 188 and/or some of the basket wires 190. In addition, in this example, one of the wires (here a basket wire 194) has a plurality of bends forming a portion of wire 196 that is vertically aligned with the opening 184 of the collar 180 to provide another surface for the basket 182 that can engage the vertical tubular members forming frame 12 to support the welded collar. When a vertical tubular member of frame 12 is secured in the opening 184 by the sleeve 114 and collar 130, the portion of wire can rest against the tubular member if a heavy object is placed in the basket 182.

A kit with the pieces shown in FIGS. 1A-23 could be provided with instructions to assemble the frame 12 with the baskets 16 in place, install the pivot hook 14 to a shower pipe as discussed above, and secure one or more section cups 18 to the frame 12 via respective suction cup clips 20, and secure the suction cups 18 to the wall or other surface, and vertically adjust the heights of the baskets 16 to a desired location, e.g., to avoid the shower controls (i.e., locate the baskets above or below the shower controls). The shower station 10 can be 22 to 72 inches in height (e.g., 40 inches) from the opening in the pivot hook to the bottom of the frame 12. This height would perhaps position a fixed basket over or too close to shower controls, which vary in height above the ground and vary in distance between controls and shower pipe. Thus, the vertical adjustability of the baskets is important.

Figure 24A:
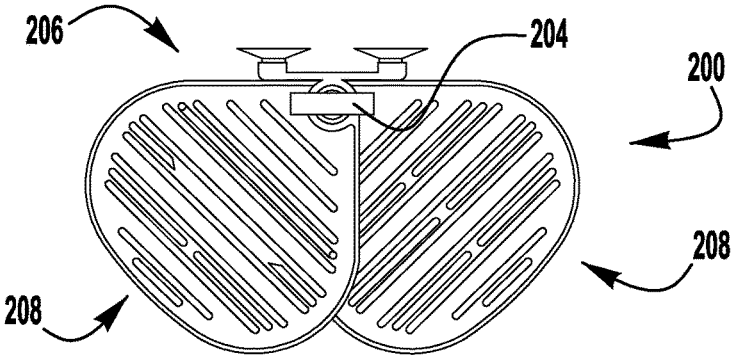
FIGS. 24A and 24B are front elevational and top plan views of another exemplary shower station according to the present application.
Figure 24B:
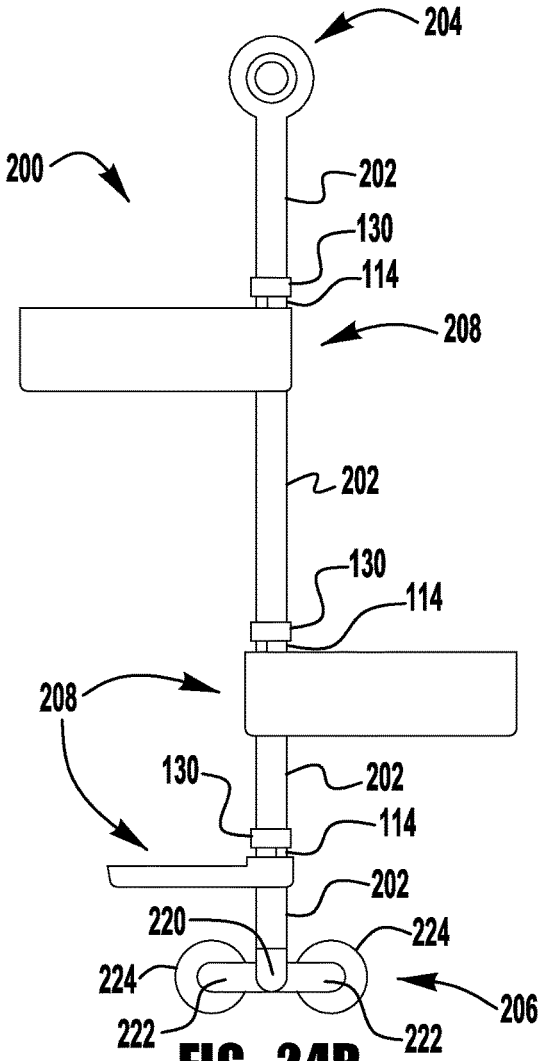

FIGS. 24A and 24B show another exemplary shower station 200. Shower station 200 comprises a tubular member 202 with a pivot hook 204 at one end, a suction cup assembly 206 at the other end, and a plurality of adjustable baskets 208 along its length. The pivot hook 204 is identical to the pivot hooks discussed above, e.g., pivot hook 14. The adjustable baskets 208 are held in place (secured to the member 202) by a compression sleeve and collar and very similar to the adjustable shelves 110 and accessories 150, 152, 154, 156 discussed above, with an integrally molded opening that accepts and is supported by a compression sleeve 114. The baskets 208 can each be held in place to the member 202 by a compression sleeve 114 and collar 130 and can be adjusted vertically by loosening the compression collar 130, moving the basket 208, and re-tightening the compression collar 130. A kit with written instructions having the foregoing adjustment instructions printed thereon can be included with a shower caddy or shower caddy kit or shower station or shower station kit including one or two or more of these adjustable baskets 208.

Figure 25C:
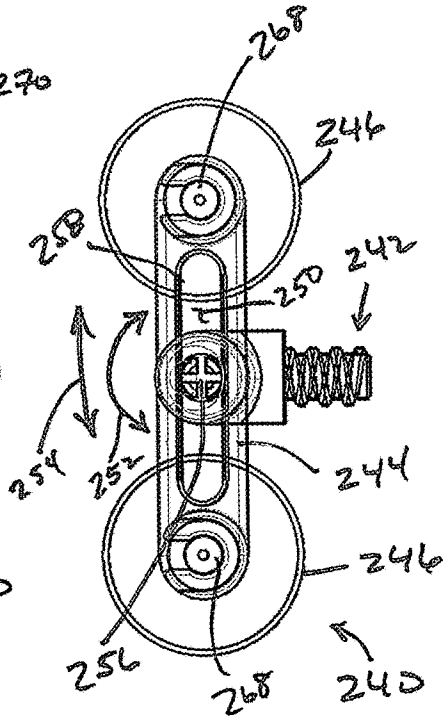
FIGS. 25A-25C are perspective, bottom, and front views of an exemplary adjustable suction cup assembly according to the present application.
Figure 25B:
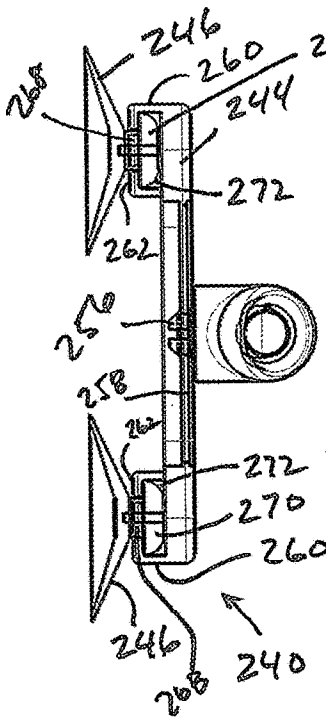
Figure 25A:
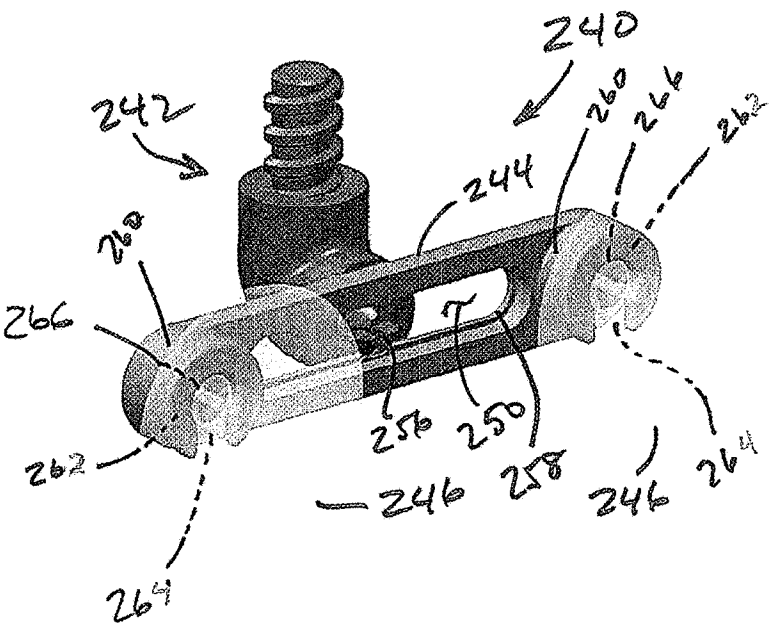

The suction cup assembly 206 shown in FIGS. 24A and 24B is a fixed suction cup assembly 206. More specifically, suction cup assembly 206 comprises an end cap 220 coupled to a T-member 222 with a suction cup 224 at each end. In the alternative, an adjustable suction cup assembly 230 of Figures can be used at the lower end of tubular member 202. Such an adjustable suction cup assembly would provide for rotational and/or lateral motion of the suction cups relative to the bottom of the tubular member 202. FIGS. 25A-25C show an exemplary adjustable suction cup assembly 240 according to the present application. Adjustable suction cup assembly 240 comprises an end cap 242 coupled to a rotor arm 244 with a suction cup 246 at each end. The end cap in the example comprises a threaded member 242. The rotor arm 244 provides for both rotational and lateral motion of the suction cups relative to the end cap 242, which end cap couples to the bottom of tubular member 202. In this example, the rotor arm 244 has a longitudinal channel 250 that couples to the end cap 242 in a manner that provides for both rotational motion (252 in FIG. 25C) and lateral motion (e.g., 254 in FIG. 25C) of the suction cups relative to the end cap 242. The rotational motion 254 is motion around a pivot point caused by a connector 256 between the channel 250 and the end cap 242. The lateral motion 254 is motion along the longitudinal axis of the channel 250. In this example, the connector 256 comprises a snap-fit connection that engages a flange 258 extending around the inner periphery of channel 250. At each end of the rotor arm 244 there is an integrally molded piece 260 having an end cap 262 with a narrow channel 264 that widens into a wider space 266 that accepts a narrow portion 268 of suction cup 246. A wide portion 270 of the suction cup 246 is inside a hollow 272 formed by the piece 260.

Figure 26C:
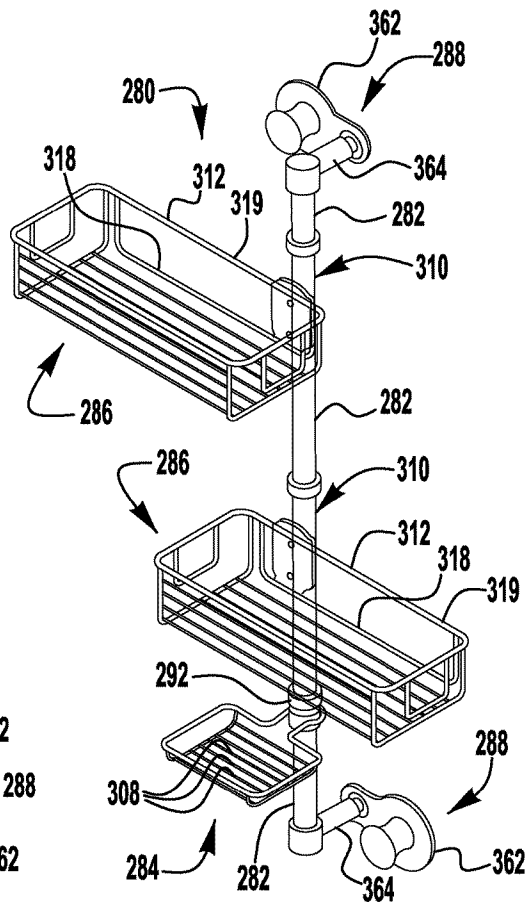
FIGS. 26A-26C are front elevational and front/right/top perspective views of another exemplary shower station with adjustable baskets.
Figure 26B:
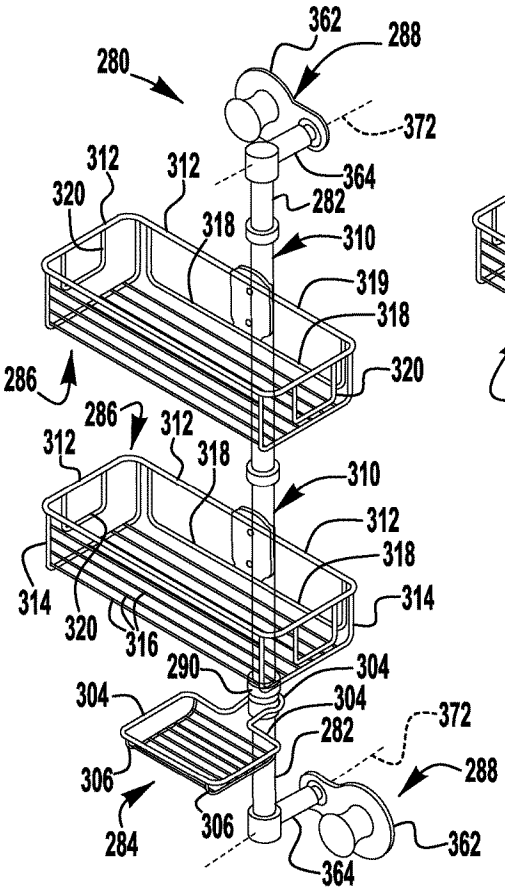
Figure 26A:
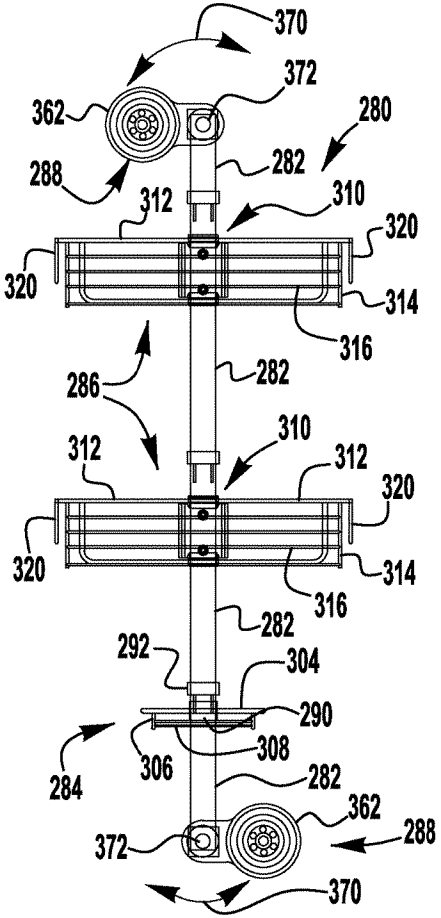

FIGS. 26A-26C show another exemplary shower station 280. Shower station 280 comprises a tubular member 282 with an adjustable dish/basket 284, a plurality of adjustable baskets 286, and a pivoting suction cup with rotational stability 288 at each end of the tubular member 282.

The dish 284 connects to the tubular member in essentially the same way as accessories 150, 152, 154, 156 do; it is held in place to the frame 282 by a compression sleeve and collar and can be adjusted vertically by loosening the compression collar, moving the accessory, and re-tightening the collar. A kit with written instructions having the foregoing adjustment instructions printed thereon can be included with a shower caddy or shower caddy kit or shower station or shower station kit including one or two or more of these dishes 284. Like accessories 150, 152, 154, 156, dish 284 has a collar 290 like collar 158 discussed above, having an opening with an inner flange like opening 112 and flange 118 discussed above. In the alternative, a flange on the compression sleeve 114 engages the bottom of the collar or other structure with the opening 112 and that retains the sleeve in the opening by preventing further movement upward inside the opening 112. Thus, collar 290 can retain in the opening a compression sleeve extending upward therethrough, to be retained to the frame 282 by a compression collar 292 threadably engaged to the threads of compression sleeve, as discussed above in connection with basket 110. Like basket 182, dish 284 is formed from at least one main support wire 304 and a plurality of secondary support wires 306 extending from the main support wire 304. A plurality of basket wires 308 extend between each wire of the secondary support wires 306 and perhaps also extend between wires of the secondary support wires 306 and the main support wire 304. All these wires can be welded together or otherwise affixed. The main support wire 304 can be made from 0.08" to 0.25" steel wire, the secondary support wires 306 can be made from 0.08" to 0.25" steel wire, and the basket wires 308 can be made from 0.08" to 0.25" steel wire. In the example of FIGS. 26A-26C, the main support wire 304 is secured to the collar 290. In the specific embodiment shown, the main support wire 304 is wrapped around the back of and welded to the collar 290.

In exemplary embodiments, the baskets can be adjusted both horizontally and vertically. For example, as discussed herein, many baskets can be adjusted vertically by loosening at least one compression collar from a corresponding compression sleeve, sliding the basket vertically up or vertically down as desired, and then tightening the at least one compression collar back onto its respective compression sleeve to re-secure the basket relative to the frame.

As another example, many of the baskets herein can be adjusted horizontally by hand without tools using, e.g., a force of about 5-10 pounds, or a force of 4-15 pounds or a force of 3-20 pounds, to physically slide the basket relative to the frame or relative to a bracket affixed to the frame or to be affixed to the frame or adjustably mounted to the frame (a force of below the lower force value in these ranges would not be sufficient to slide the basket). In exemplary embodiments, the baskets can be adjusted horizontally by hand without tools simply by applying a force (i.e., without also moving something, such without loosening a fastener or loosening a compression collar or without moving a lever or other unlocking mechanism), e.g., a force of about 5-10 pounds, or a force of 4-15 pounds or a force of 3-20 pounds, to physically slide the basket (a force of below the lower force value in these ranges would not be sufficient to slide the basket) relative to the frame or relative to a bracket affixed to the frame or to be affixed to the frame or adjustably mounted to the frame.

Baskets 286 in FIGS. 26A-26C can be adjusted vertically and horizontally without tools. The baskets 286 can be adjusted vertically by loosening at least one compression collar from a corresponding compression sleeve, sliding the basket vertically up or vertically down as desired, and then tightening the at least one compression collar back onto its respective compression sleeve to re-secure the basket relative to the frame. Additionally, the baskets 286 can be adjusted horizontally by hand without tools using, e.g., a force of about 5-10 pounds, or a force of 4-15 pounds or a force of 3-20 pounds, to physically slide the basket 286 (a force of below the lower force value in these ranges would not be sufficient to slide the basket) left or right relative to the frame 282 or relative to a bracket 310 affixed to the frame or to be affixed to the frame 282 or adjustably mounted to the frame 282. Like basket 182, basket 286 is formed from at least one main support wire 312 and a plurality of secondary support wires 314 extending from the main support wire 312. A plurality of basket wires 316 extend between each wire of the secondary support wires 314 and perhaps also extend between wires of the secondary support wires 314 and the main support wire 312. In the specific embodiment shown, the main support wire 312 has an extension 318 welded or otherwise affixed thereto. The extension 318 extends essentially parallel to the rear straight portion 319 of the main support wire. Also in this example, a stop is formed at each lateral end of the basket 286 by a wire 320 extending between one part of the main support wire 312 and another part of the main support wire 312. All these wires can be welded together or otherwise affixed. The main support wire 312, its extension 318, and the stops 320 can be made from 0.08" to 0.25" steel wire, the secondary support wires 314 can be made from 0.08" to 0.25" steel wire, and the basket wires 316 can be made from 0.08" to 0.25" steel wire. In the example of FIGS. 26A-26C, the main support wire 312 (more specifically the rear straight portion 319 of the main support wire) and the extension 318 of the main support wire 312 are secured to the frame 282 by a bracket 310 having a compression sleeve 330 integrally molded therewith or otherwise affixed thereto. In FIGS. 26A and 26B, the baskets 286 are approximately centered. In FIG. 26C, the top basket 286 has been slid horizontally by hand without tools to the left relative to the frame 282 and the bottom basket 286 has been slid horizontally by hand without tools to the right relative to the frame 282. The exemplary baskets 286 are about 9 to 16 inches wide and they can be horizontally slid from one extreme to another, which makes them able to slide about 80% of their width.

FIGS. 27A-27D show an exemplary bracket 310 used to secure basket 286 to a compression sleeve 312, which is used to secure the bracket 310 and basket 286 to the frame 282. The bracket 310 is rigidly secured to the compression sleeve 312, which has an opening 314 and slots 316 discussed above. A compression collar 318 secures the compression sleeve 312 and the bracket 310 to a portion of the frame 282 in the opening 314, as discussed above. The location of baskets 286 can be adjusted vertically by loosening the compression collars 318, moving the basket 286, and re-tightening the collars 318. A kit with written instructions having the foregoing adjustment instructions printed thereon can be included with a shower caddy or shower caddy kit or shower station or shower station kit including any one or any two or more of these baskets 286 with brackets 310.

The bracket has two openings 330, 332 that slidably carry the basket 286, here the openings slidably retain the rear straight portion 319 of the main support wire and the extension 318 of the main support wire in a manner that permit the basket to be slid horizontally to the right or to the left by hand without tools. More specifically, opening 330 slidably retains the rear straight portion 319 of the main support wire 312 and opening 332 slidably retains the extension 318 of the main support wire 312. The openings 330, 332 of bracket 310 are sized and otherwise arranged and configured to permit the basket 286 to adjusted horizontally by hand without tools using, e.g., a force of about 5-10 pounds, or a force of 4-15 pounds or a force of 3-20 pounds, to physically slide the basket relative to bracket 310 (a force of below the lower force value in these ranges would not be sufficient to slide the basket). In exemplary embodiments, the same bracket 310 is rigidly affixed to the compression sleeve 312, which can be adjusted to rigidly secure the basket to the frame 282. In the specific embodiment of FIGS. 26A-27D, the baskets 286 can be adjusted horizontally by hand without tools simply by applying a force (i.e., without also moving something, such without loosening a fastener or loosening a compression collar or without moving a lever or other unlocking mechanism), e.g., a force of about 5-10 pounds, or a force of 4-15 pounds or a force of 3-20 pounds, to physically slide the basket (a force of below the lower force value in these ranges would not be sufficient to slide the basket) relative to the bracket 310 affixed to the frame 282 or to be affixed to the frame 282, while at the same time the bracket 310 rigidly attaches to the frame 282 or rigidly attaches to a compression collar 312, or other mechanism, capable of rigidly attaching to the frame 282. In the alternative (not shown) the bracket can be made so that something must be moved before the baskets can be adjusted horizontally within openings 330, 332, such as loosening a fastener or loosening a compression collar or moving a lever or moving another unlocking mechanism (not shown) while at the same time the bracket 310 rigidly attaches to the frame 282 or rigidly attaches to a compression collar, or other mechanism, capable of rigidly attaching to the frame 282.

The force that is required to adjust the baskets horizontally by hand without tools by simply applying that force is determined, in part, by projections 334, 336 within the brackets 310. The projections 334, 336 are sized to physically and frictionally engage the rear straight portion 319 of the main support wire and the extension 318 of the main support wire in a manner that permit the basket to be slid horizontally to the right or to the left by hand without tools and merely by applying the force. This force can, for example, be applied with one hand while holding the frame 282 or bracket 310 with the other hand. A kit with written instructions having the foregoing adjustment instructions printed thereon can be included with a shower caddy or shower caddy kit or shower station or shower station kit including any one or any two or more of these baskets 286 with brackets 310. That is, the projections 334, 336 are both radially size (in a direction toward the central axis of the wires 318, 319) and longitudinally sized (in a direction along the longitudinal axis of the wires 318, 319) to provide the desired adjustment force, e.g., a force of about 5-10 pounds, or a force of 4-15 pounds or a force of 3-20 pounds, to physically slide the basket (a force of below the lower force value in these ranges would not be sufficient to slide the basket) relative to bracket 310.

Figure 28A:
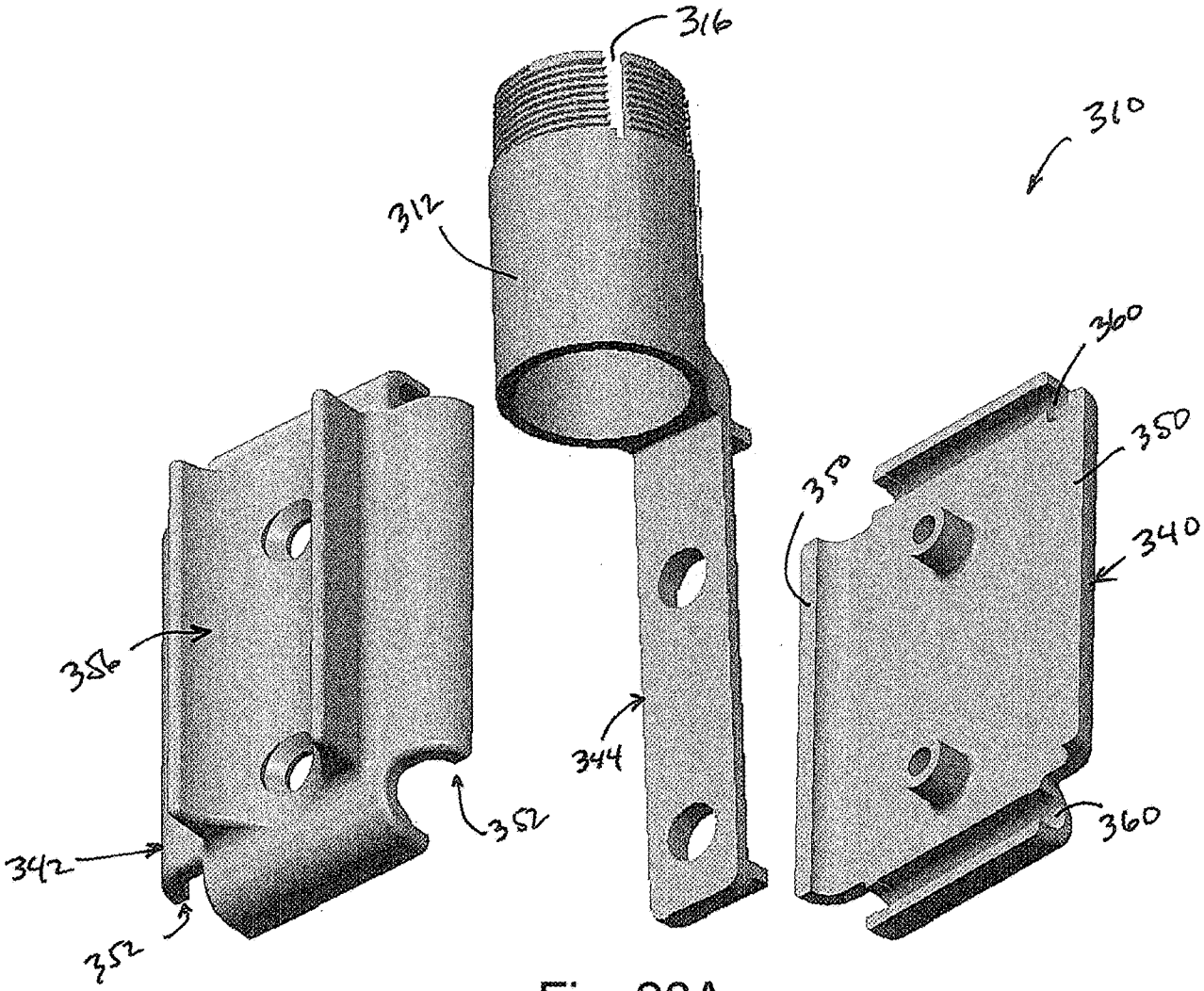
Figure 28B:
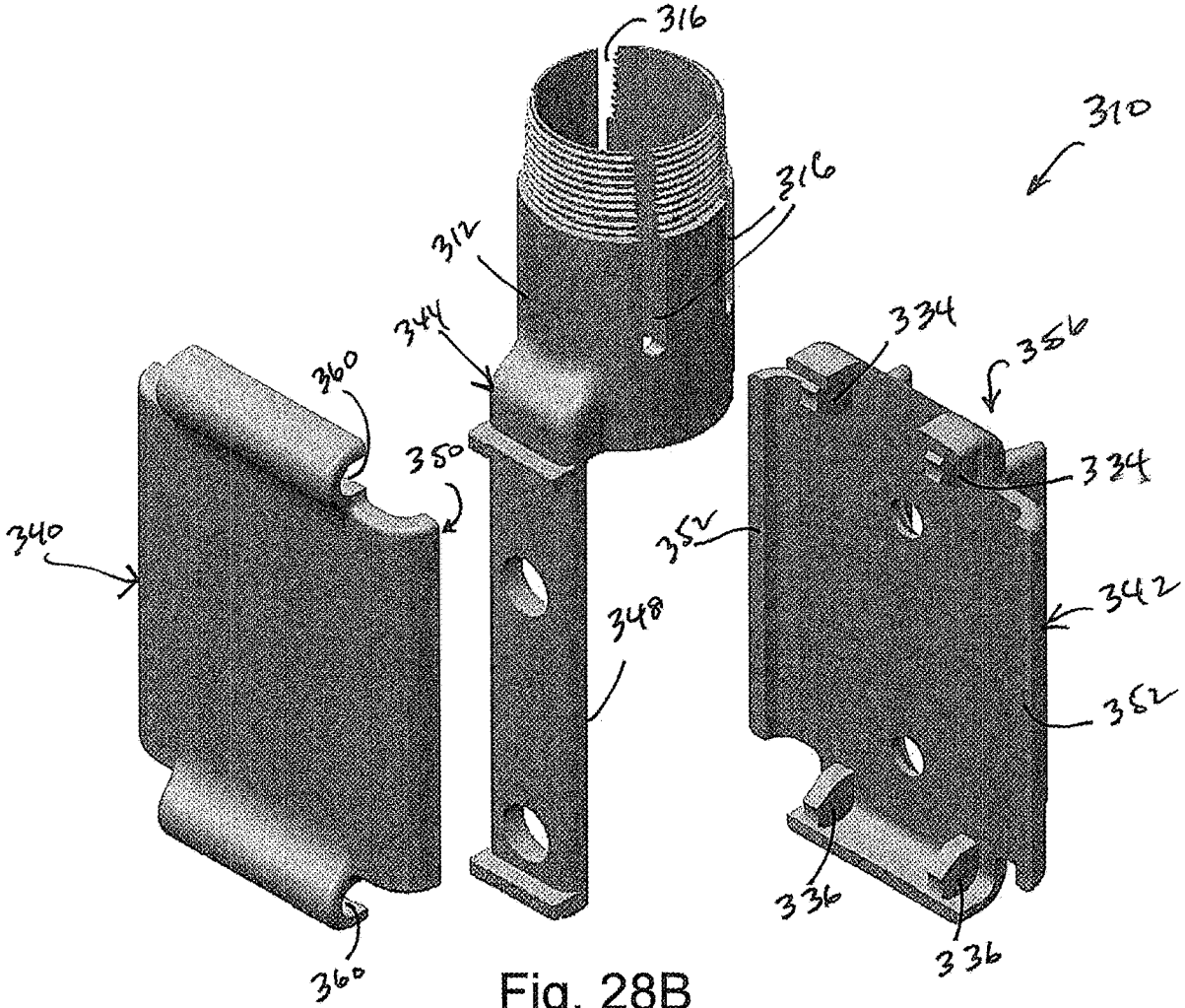
Figure 28C:
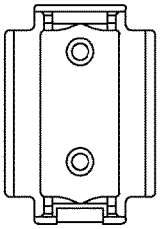
FIGS. 28C-28G show various views of a bracket back of FIGS. 27A-28B.
Figure 28D:
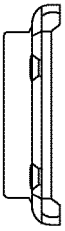
Figure 28E:
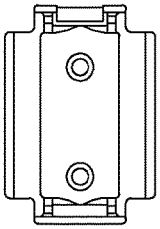
Figure 28F:
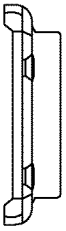
Figure 28G:
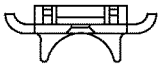
Figure 28L:
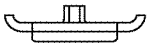
FIGS. 28H-28M show various views of a bracket front of FIGS. 27A-28B.
Figure 28K:
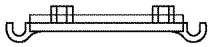
Figure 28H:
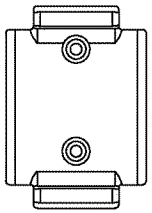
Figure 28J:
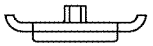
Figure 28M:
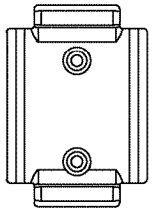
Figure 28I:
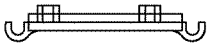
Figure 28Q:
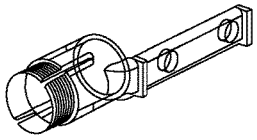
FIGS. 28N-28*r* show various views of a compression sleeve of FIGS. 27A-28B.
Figure 28O:
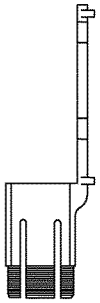
Figure 28P:
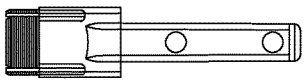
Figure 28R:
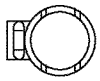
Figure 28N:
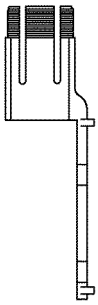
Figure 29B:
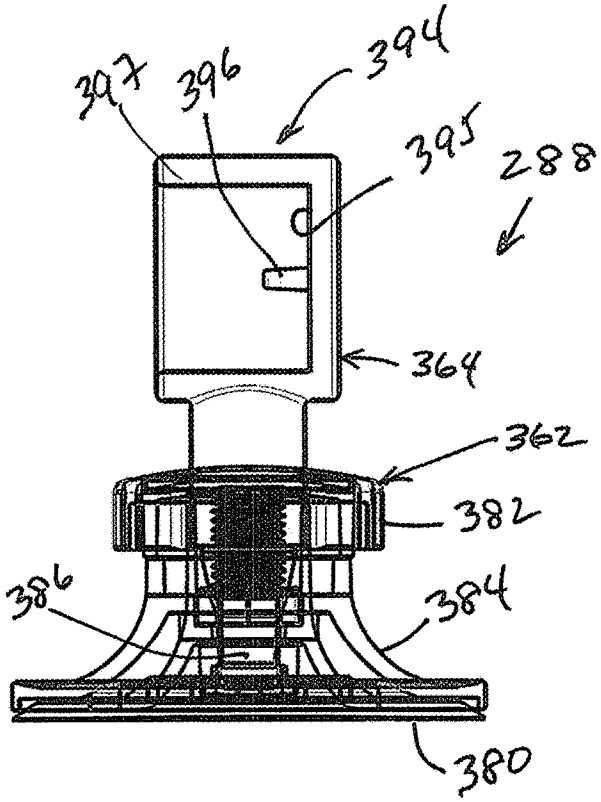
FIGS. 29A-29I show an exemplary pivoting suction cup unit with rotational stability.
Figure 29A:
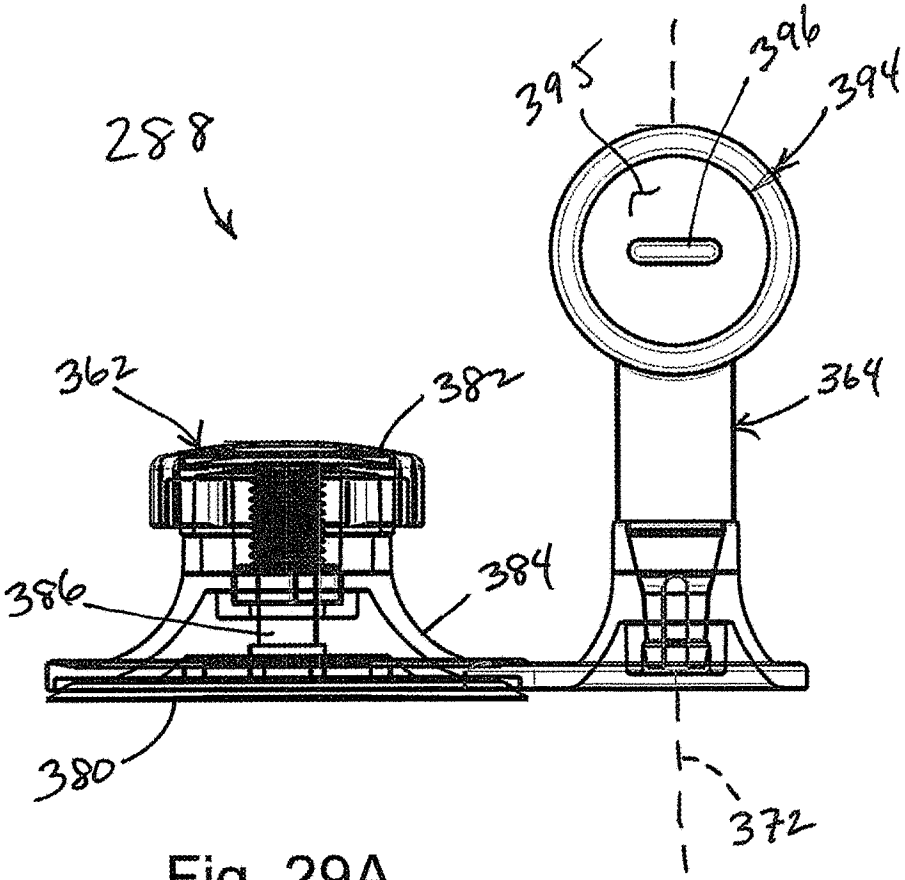
Figure 29D:
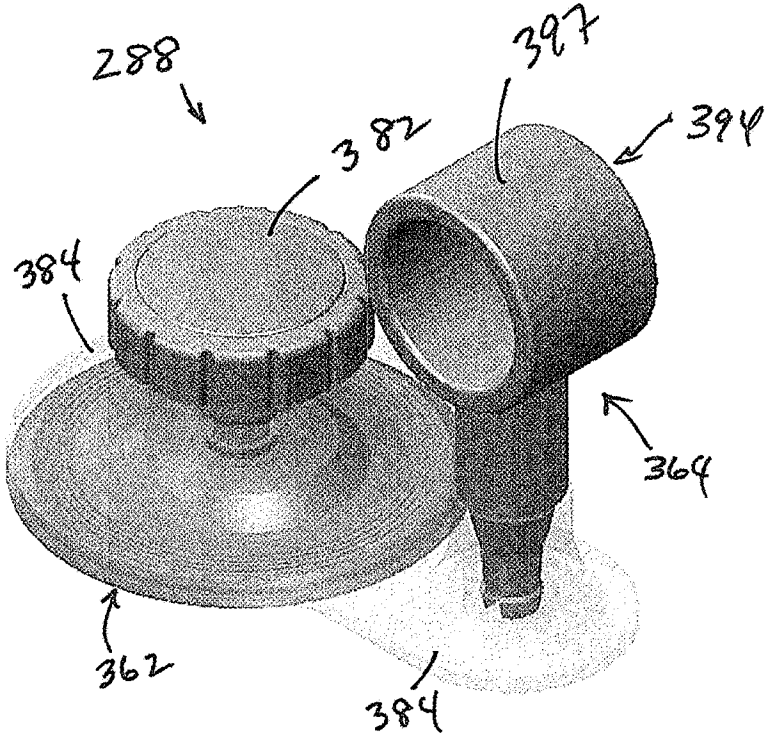
Figure 29C:
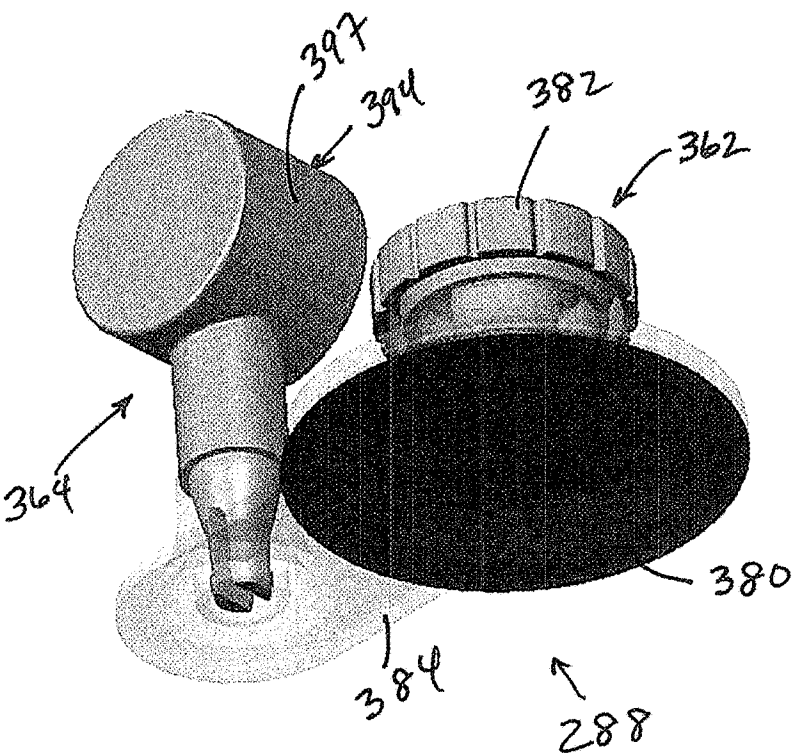
Figure 29F:
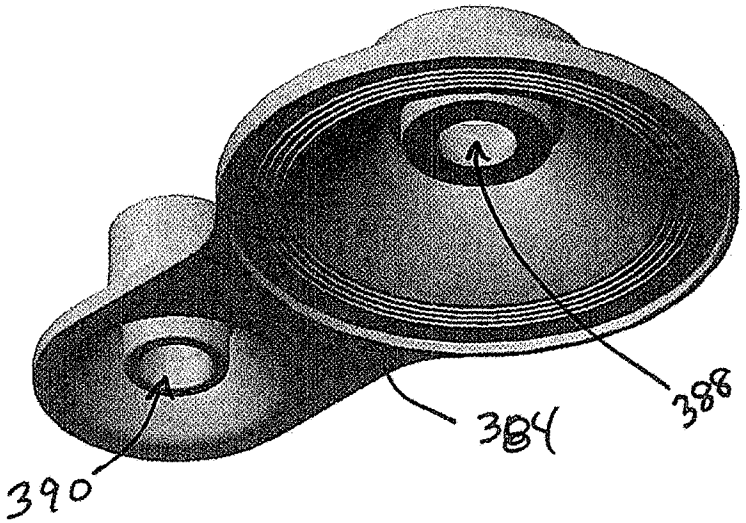
Figure 29E:
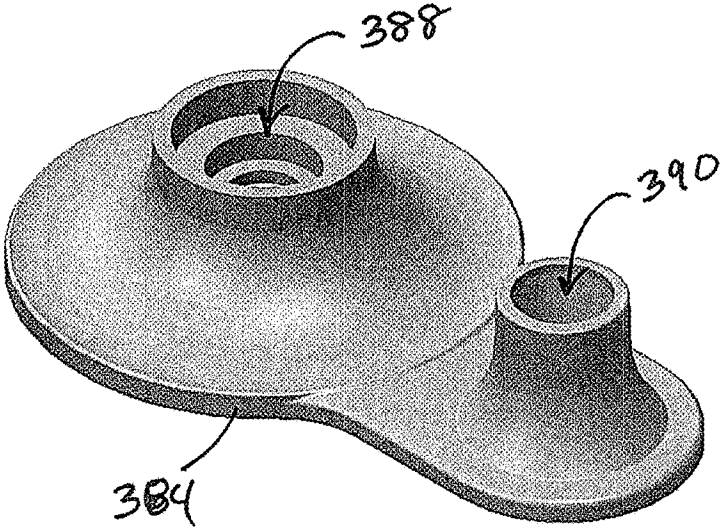
Figure 29I:
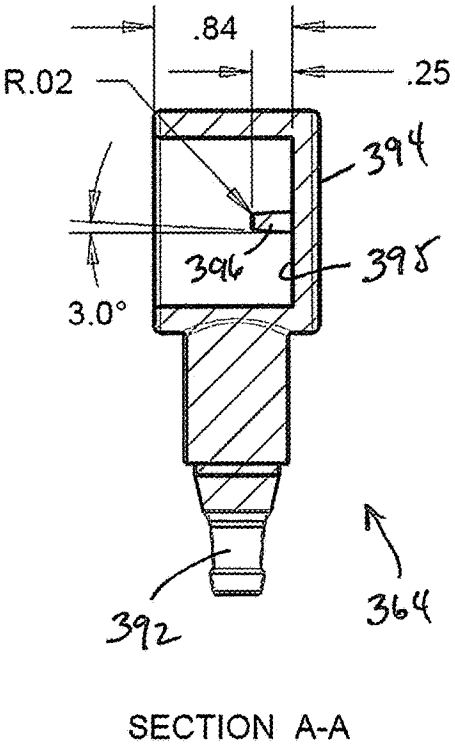
Figure 29H:
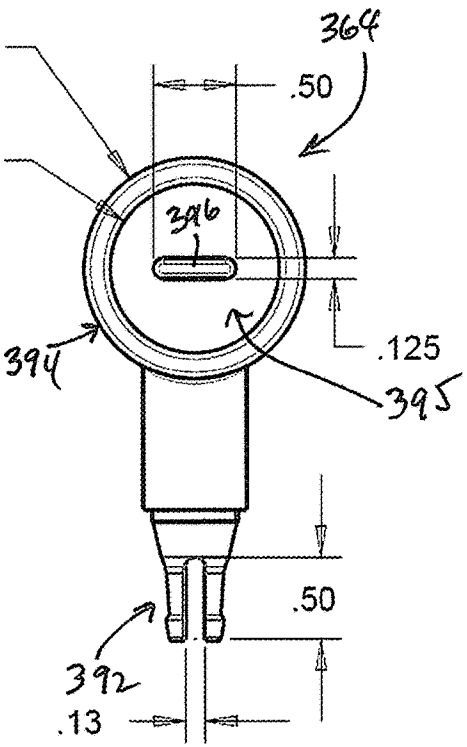
Figure 29G:
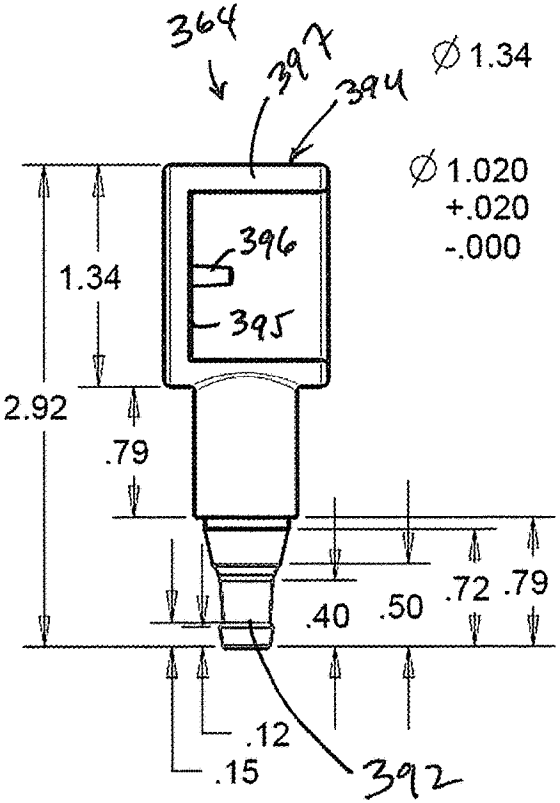

Referring now to FIGS. 28A-28B, two pieces 340, 342 forming the bracket 310 and a piece 344 carrying the compression sleeve 312 are shown separated from each other. Additional details of the three pieces 340, 342, 344 are shown in the three sheets following FIG. 28B. The two bracket pieces 340, 342 are secured together with two fasteners 346 (FIGS. 27A-27D) with an arm 348 of the piece 344 sandwiched therebetween. The two bracket pieces 340, 342 forcibly meet at surfaces 350, 352 and are held together by a force provided by the fasteners 346 extending through holes in the bracket piece 342 through holes in arm 348 and into screw bosses carried by bracket piece 340. The arm 348 has holes sized slightly larger than the outer diameter of the screw bosses. The wire pieces 318, 319 are slidably secured in the bracket 310 in a channel 360 of piece 340 on one side and on the other side by the projections 334, 336, which are carried by bracket piece 342 in this example. In addition to the configuration of the projections 334, 336, the force that is required to adjust the baskets 286 horizontally by hand without tools by simply applying that force is also determined by the length of channel 360, the diameter of wires 318, 319, and the finish on these parts. These are selected to provide, the desired adjustment force, e.g., a force of about 5-10 pounds, or a force of 4-15 pounds or a force of 3-20 pounds, to physically slide the basket (a force of below the lower force value in these ranges would not be sufficient to slide the basket) relative to bracket 310 without tools and without loosening anything. In this example, bracket piece 342 also has a cylindrical channel 356 (shown best in FIG. 28A) that is aligned with the opening 314 of the compression sleeve 312 and sized the same as or slightly larger than the tubular members forming the frame 282.

Referring back to FIGS. 26A-26C, shower station 280 has a pivoting suction cup unit with rotational stability 288 at each end of the tubular member 282. The pivoting suction cup unit with rotational stability 288 has a suction cup assembly 362 pivotally coupled to an arm 364 that couples to and supports the frame 282 of the system 280. The pivoting suction cup unit 288 pivots in the sense that it can be rotated in a direction 370 about an axis 372 running along arm 364 to permit a user to attempt to avoid a grout line between two tiles and securely fasten the suction cup to a single tile (not shown) without the axis 372 moving. The arm 364 cooperates with the ends of frame 282 to rotationally lock the frame 282 in place, e.g., with a tongue-and-groove or geometric shape interference (e.g., a square or hexagonal or other shaped extension on arm 362 or the end of the frame 282 and a similarly shaped opening on the end of the frame 282 or in arm 362).

Referring now to FIGS. 29A-29I, an exemplary pivoting suction cup unit 288 with rotational stability is shown. The suction cup assembly 362 comprises a suction cup 380 and a knob 382 carried by a body 384. The suction cup 380 is threadably coupled to the knob 382 via a rod 386 through an opening 388 in body 384. More specifically, placing the suction cup assembly 362 onto a smooth support surface (at least a smooth annular surface), e.g., a large bathroom tile or a portion of a fiberglass shower stall, and turning the knob 382 pulls the rod 386 toward the knob 382, which draws a central portion of suction cup 380 into body 384, which draws a partial vacuum between the smooth support surface (not shown) and the suction cup, which pulls the suction cup 380 tightly against the smooth support surface contacting a perimeter of the suction cup 380. Similarly, when the knob is rotated in the opposite direction, the suction cup 380 is pulled to a surface contacting the perimeter of the suction cup 380 with lesser force.

Figure 30:
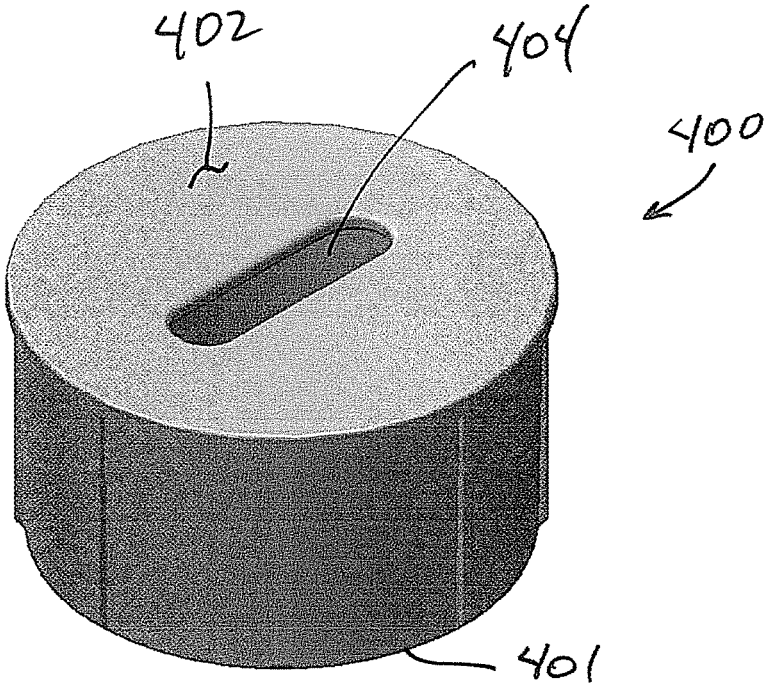
FIG. 30 shows an exemplary keyed plug.

As mentioned above, the suction cup assembly 362 is also pivotally coupled to arm 364, which couples to and supports the frame 282 of the system 280. In this example, the arm 364 snap-fits into an opening 390 of body 384 in a manner that provides for 360 degree rotation of arm 364 with respect to the body 384. The arm 364 comprises a snap-fit connector 392 having a wider portion distal a narrower portion at one end and a frame securing portion 394 at the other end. In this example, the frame securing portion 394 comprises a support surface 395 and a projection 396 that interlocks with a like-shaped opening in a distal end of frame 282 to prevent rotation of the frame 282 with respect to the pivoting suction cup unit 288. FIG. 30 shows an exemplary keyed plug 400 that cooperates with projection 396 to prevent rotation of the frame 282 with respect to the pivoting suction cup unit 288. An end 401 of the keyed plug 400 is inserted into an opening (not shown) of a tubular distal end of frame 282 where the suction cup assembly 362 is to be used. The end 401 and the opening are sized to provide a tight fit to prevent motion of the keyed plug 400 in the opening. Exemplary keyed plug 400 has a surface 402 with a slot 404 that is about the same shape and size as the linear projection 396 of frame securing portion 394 of arm 364. The slot 404 accepts and cooperates with the linear projection 396 to prevent rotation of the frame 282 (i.e., prevents rotation insufficient to force the keyed plug 400 to rotate inside the opening of frame 282). As mentioned above, other opening shapes and corresponding projection shapes (not shown) could be used to prevent rotation of the frame 282, e.g., a + sign projection extending from support surface 395 of frame securing portion 394 and a + sign shaped opening in keyed plug 400. If two keyed plugs 400 are used (one at each end of frame 282), the openings should have approximately the same orientation, corresponding to the orientation of the projection 396 of the of frame securing portion 394 of arm 364.

A kit can be provided with the components shown in FIGS. 26A-30, i.e., a kit comprising tubular member for frame 282, two of the keyed plugs 400, two (or more) adjustable baskets 286, an adjustable dish 284, and two pivoting suction cup units with rotational stability 288, and, optionally, any one or any two or more of the optional accessories 150, 152, 154, 156, and an instruction sheet setting forth the instructions discussed herein for the included components. The keyed plugs 400 can be pre-inserted in the tubular member 282 or instructions can be provided in the kit to insert the two keyed plugs in approximately the same orientation, corresponding to the orientation of the projection 396 of the of frame securing portion 394 of arm 364. The instructions can then instruct the user to position a pivoting suction cup unit 288 with the axis 372 in the location where the bottom of the frame 282 is to be located and the suction cup 380 on a surface in a desired location, e.g., located on a single tile, push the knob to initially secure the suction cup 380 to the surface, and, while holding the body 384, turning the knob 382 to fully secure the suction cup 380 to the surface. If the dish 284, baskets 286, and optional accessories are not already positioned on the frame, the instructions would instruct the user to extend the frame 282 through the respective compression sleeves with the baskets in the desired orientation and secure them to the frame with the respective compression collars, as discussed above. Then the instructions could instruct the user to insert the bottom of the frame 282 (with the secured dishes, baskets, and optional accessories in place) into the frame securing portion 394 of arm 364 with the projection 396 extending into the slot 404. The instructions could then instruct the user to hold the frame 282 substantially vertically, push the upper frame securing portion 394 of arm 364 of the second pivoting suction cup unit 288 with the second projection 396 extending into the second slot 404, rotate the second, upper section cup about the second, upper axis 372 to position the second, upper suction cup in a desired location, e.g., located on a single tile, push the second, upper knob 382 to initially secure the suction cup 380 to the surface, and, while holding the body 384 and the frame, turning the knob 382 to fully secure the second, upper suction cup 380 to the surface. Because the space between the two surfaces 395 is about the same height as the height of the frame 282, ring portions 397 of the two frame securing portions 394 of the two arms 364 secure the frame 282 in place. The coupling of the two projections 396 and the two slots 404 prevent rotation of the frame 282. The instructions could then instruct the user to change the rotation of the dish, baskets, and optional accessories if desired (e.g., to make them parallel to the wall or support surface) by loosening the respective compression collars, changing the rotational orientation of the parts, and re-tightening the compression collars. The kit instructions could also instruct a user to adjust the heights of the dish, baskets, and optional accessories as discussed above.

The frame can either be a single piece, e.g., a single tubular member, or a plurality of members connected to each other. For example, in FIGS. 26A-26C, a relatively short system, a single tubular member might be used. However, for taller shower stations, a series of tubular members might be coupled together, e.g., using inserts with male and female threading. The shower station in FIGS. 1-2, for example, would be created from a plurality of tubular members coupled together, e.g., using inserts with male and female threading.

Figure 31:
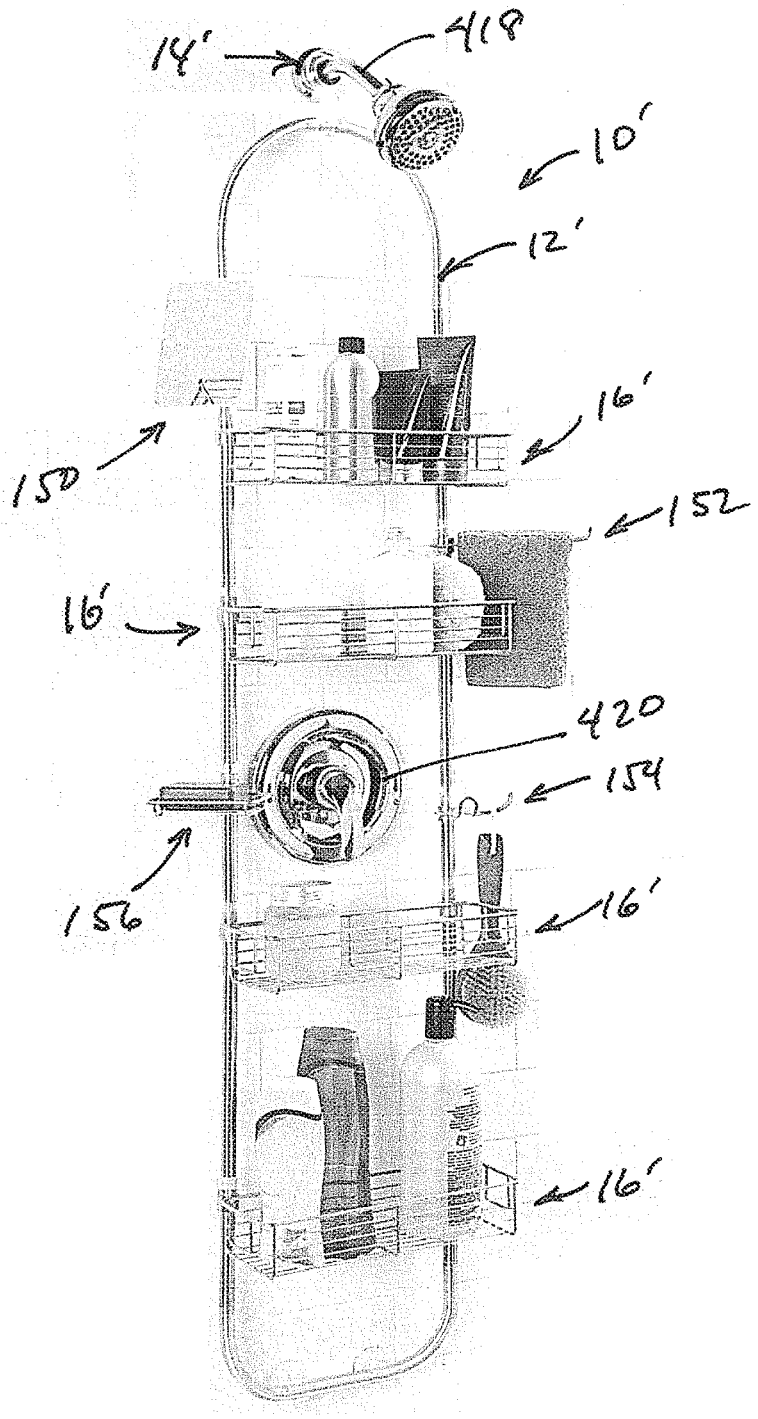
FIG. 31 shows another exemplary shower station embodiment.
Figure 32C:
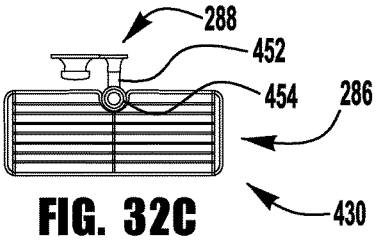
FIGS. 32A-32D show another exemplary shower station embodiment.
Figure 32A:
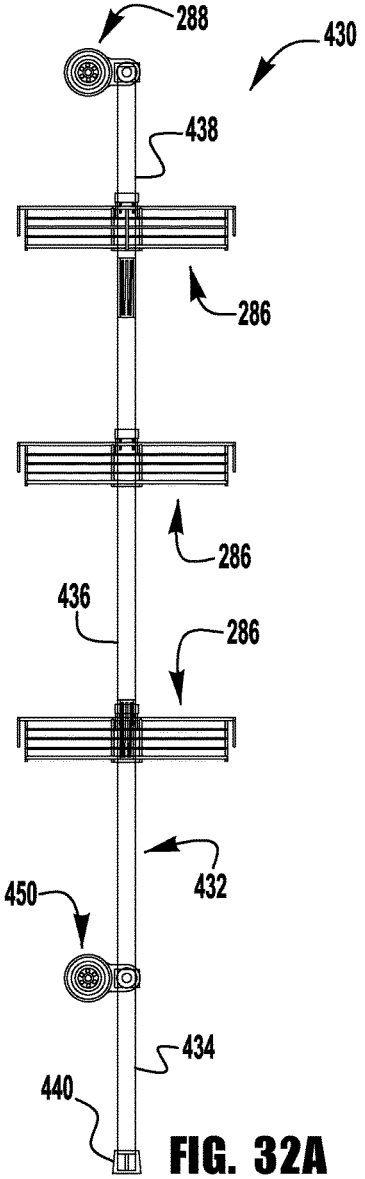
Figure 32B:
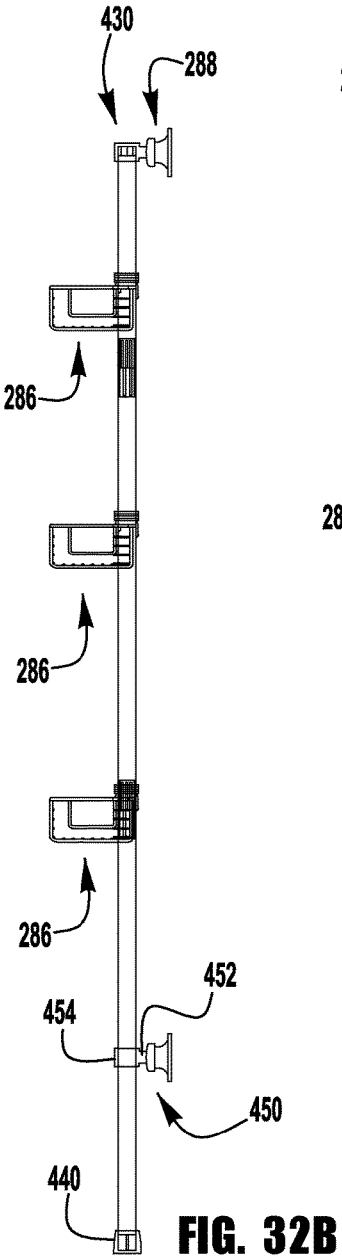
Figure 32D:
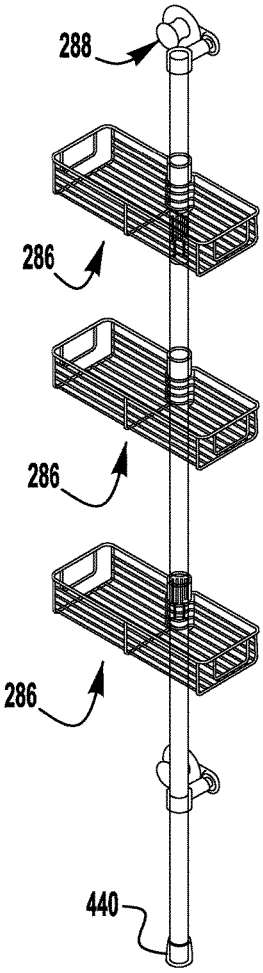
Figure 33C:
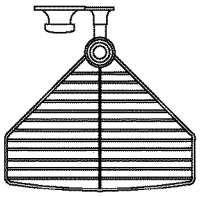
FIGS. 33A-33D show yet another exemplary shower station embodiment.
Figure 33A:
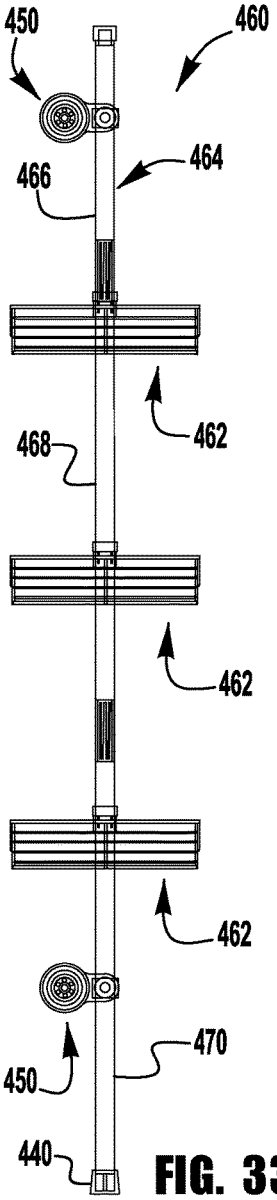
Figure 33B:
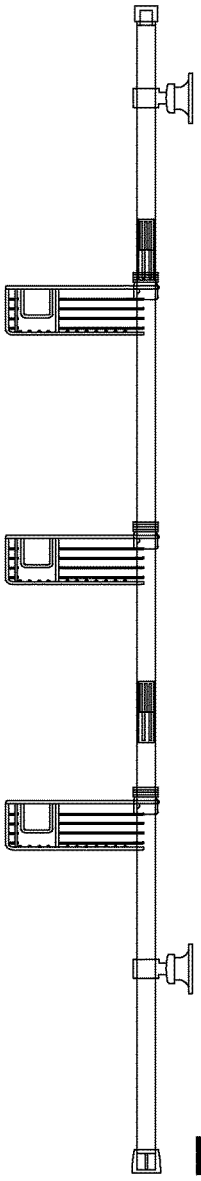
Figure 33D:
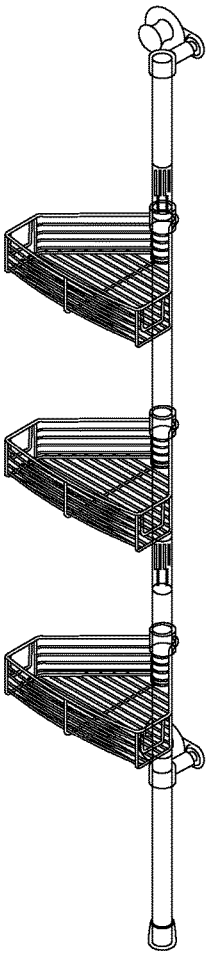
Figures 34A, 34B, 34C, 34D, 34E, 34F:
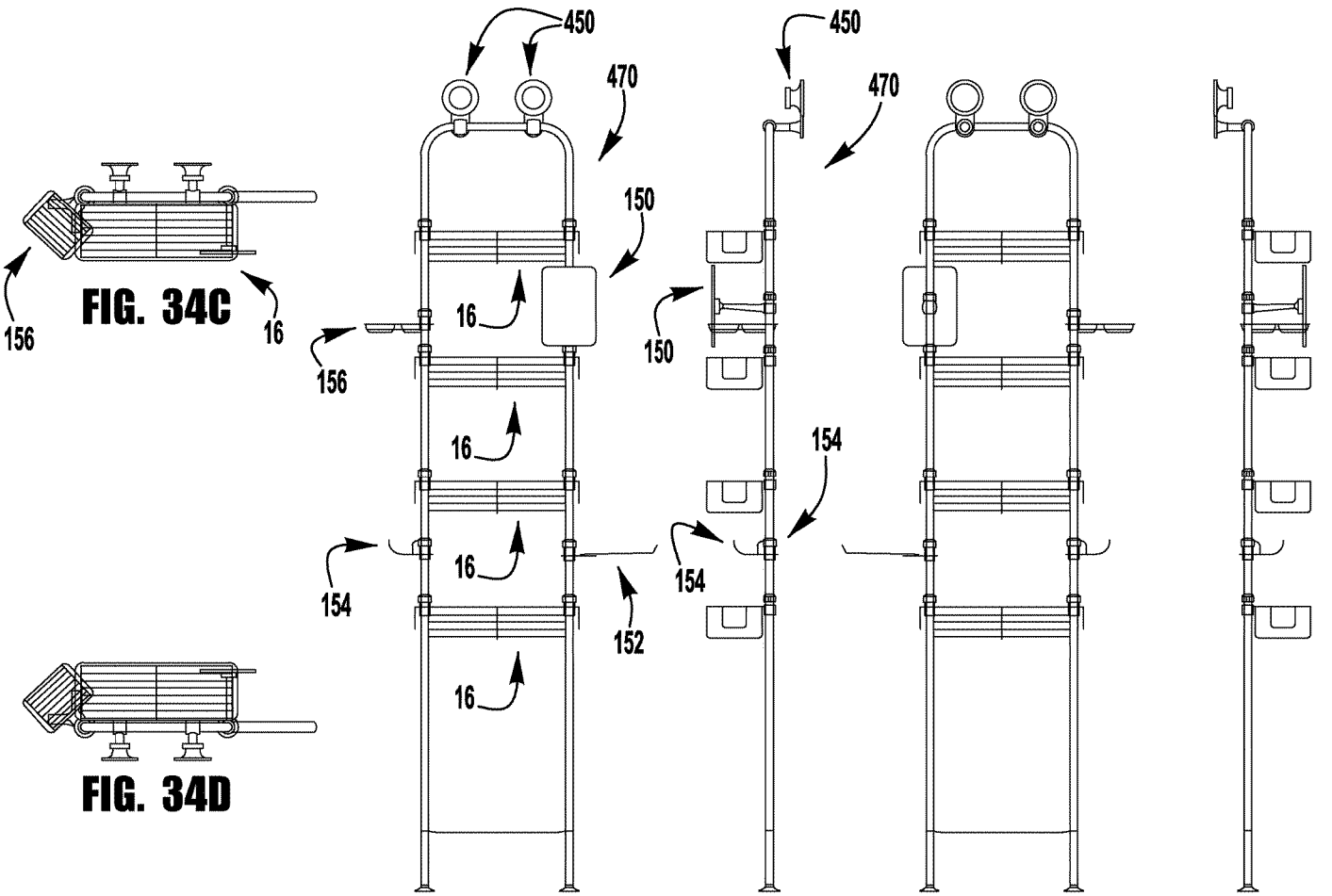

FIG. 31 shows a taller shower station very similar to the shower station 10 of FIGS. 1A-23, except it has four adjustable shelves 16 and has one each of the optional accessories 150, 152, 154, 156. Because of the similarity with FIGS. 1A-23, primed reference characters will be used. A kit to make the shower station 10' with the pieces shown in FIG. 31 could be provided with instructions to assemble the frame 12' with the four baskets 16' in place, install the pivot hook 14' to a shower pipe 418 as discussed above, and secure one or more section cups 18' to the frame 12' via respective suction cup clips 20', and secure the suction cups 18' to the wall or other surface, and vertically adjust the heights of the baskets 16' to a desired location, e.g., to avoid the shower controls 420 (i.e., locate the baskets above or below the shower controls 420). The shower station 10' can be 40 to 57 inches in height (e.g., about 57 inches) from the opening in the pivot hook to the bottom of the frame 12'. This height would perhaps position a fixed basket over or too close to the shower controls 420, which vary in height above the ground and vary in distance between controls and shower pipe. Thus, the vertical adjustability of the baskets is important.

FIGS. 32A-32D show another exemplary shower station embodiment 430. Shower station 430 uses three of the horizontally adjustable and vertically adjustable wire baskets 286, discussed above, and one of the adjustable suction cup units 288, discussed above, at an upper end of frame 432. Frame 432 comprises three tubular sections 434, 436, 438 assembled using plastic plugs. In this embodiment, the adjustable wire baskets 286 can be vertically adjusted to virtually anywhere along the length of frame 432 by loosening their respective collar. The adjustable wire baskets 286 can also be adjusted horizontally left or right by hand without tools. At the top of the shower station 430, the adjustable suction cup unit 288 secures the frame 432 to the wall, e.g., to a tile or to a shower stall surface. At the bottom of shower station 430, the frame 432 rests on the floor, e.g., on the bottom of a shower stall or bathtub (not shown). A foot cap 440 covers the lower end of frame 432 and provides a frictional engagement between the frame 432 and the floor. A modified adjustable suction cup unit 450 helps keep the lower end of the frame 432 secured to the wall. The adjustable suction cup unit 450 is the same as the adjustable suction cup unit 288, discussed above, except the frame engaging part of the arm is different. More specifically, the adjustable suction cup unit 450 differs from adjustable suction cup unit 288 in that the arm 452 has a frame retaining end 454 that has a collar 454 affixed to the arm 452 through which the frame extends (instead of a surface and projection, like the adjustable suction cup unit 288). The arm 452 of adjustable suction cup unit 450 rotates with respect to the rest of the adjustable suction cup unit 450 (like in the adjustable suction cup unit 288). The collar 454 allows the adjustable suction cup unit 450 to be positioned at virtually any location along the frame 432. The adjustable suction cup unit 450 is used the same, and the instructions in a kit would be the same, as adjustable suction cup unit 288, except the frame extends through the collar 454. A kit with the components shown in FIGS. 32A-32D can be provided along with instructions. The instructions would be the same as for a kit for FIGS. 26A-26C, except the user may rest foot 440 at the lower part of frame 432 on the floor, and the lower adjustable suction cup unit 450 can be installed before or after the adjustable suction cup unit 288 at the top, which makes installation simpler. The shower station 430 can be 24 to 72 inches in height from the top of the frame to the bottom of the frame.

FIGS. 33A-33D show another exemplary shower station embodiment 460. Shower station 460 uses three horizontally adjustable and vertically adjustable wire baskets 462 and two of the modified adjustable suction cup units 450, discussed above, at upper and lower ends of frame 464. Frame 464 comprises three tubular sections 466, 468, 470 assembled using plastic plugs. The three horizontally adjustable and vertically adjustable wire baskets 462 that are the same as dish 284, discussed above (with a collar held by a compression sleeve), except they are triangular (for using the shower station in a corner) and are larger than dish 284. In this embodiment, the adjustable wire baskets 462 can be vertically adjusted to virtually anywhere along the length of frame 464 by loosening their respective collar. At the top and bottom of the shower station 460, the adjustable suction cup units 450 secure the frame 464 to the wall, e.g., to a tile or to a shower stall surface. A foot cap 440 covers the lower end of frame 464 and provides a frictional engagement between the frame 464 and the floor. A kit with the components shown in FIGS. 33A-33D can be provided along with instructions. The instructions would be the same as for a kit for FIGS. 32A-32D, except an adjustable suction cup unit 450 is used at the top and the shelves are not horizontally slidable. The shower station 460 can be 24 to 72 inches in height from the top of the frame to the bottom of the frame. A kit with the components of shower station 460 can be provided, along with instructions for each of the components, as discussed above.

The different structures disclosed herein can be used in shower stations and shower caddies in addition to the ones in which they are initially described. For example, FIGS. 34A-34G show another exemplary shower station embodiment 470 using two of the modified adjustable suction cup units 450 to secure the shower station to the wall at the top, four of the vertically adjustable shelves 16, and one each of the different accessories 150, 152, 154, 156. The shower station has an elongated U-shaped frame that rests on the floor in two places. The shower station 470 can be 24 to 72 inches in height from the top of the frame to the bottom of the frame. A kit with the components of shower station 470 can be provided, along with instructions for each of the components, as discussed above, including adjusting the baskets vertically to avoid any shower controls.

Figure 37C:
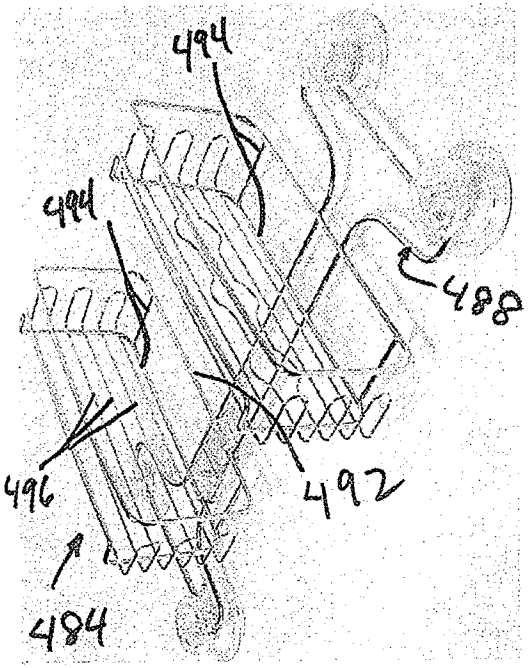
Figure 37B:
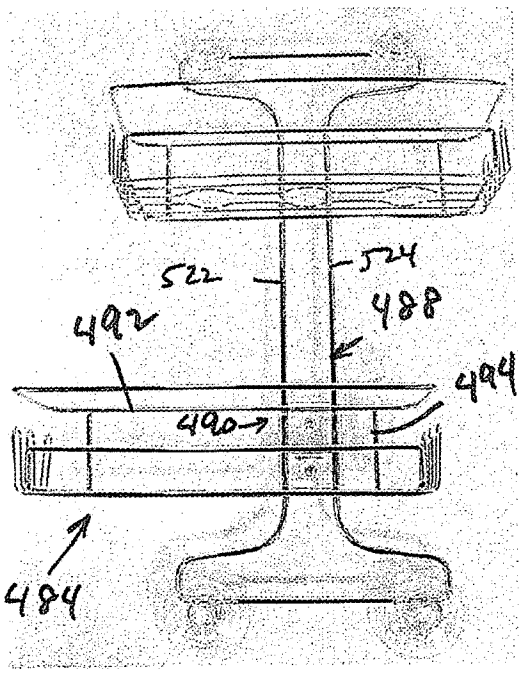
Figure 37A:
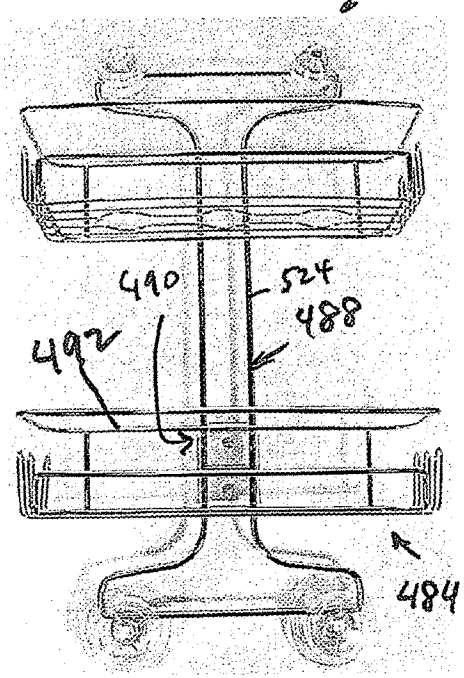

FIGS. 35A-35C show still another exemplary shower caddy 480 having a fixed basket 482, a horizontally adjustable basket 484, and four suction cup units 486 carried by a wire frame 488. The fixed basket 482 is welded to the wire frame 488. Basket 484 in FIGS. 35A-35C can be adjusted horizontally without tools. The basket 484 can be adjusted horizontally by hand without tools using, e.g., a force of about 5-10 pounds, or a force of 4-15 pounds or a force of 3-20 pounds, to physically slide the basket 484 (a force of below the lower force value in these ranges would not be sufficient to slide the basket) left or right relative to the frame 488 or relative to a bracket 490 affixed to the frame or to be affixed to the frame 488 or adjustably mounted to the frame 488. Basket 484 is formed from at least one main support wire 492 and a plurality of secondary support wires 494 extending from the main support wire 492. A plurality of basket wires 496 extend between the secondary support wires 494 and perhaps also extend between wires of the secondary support wires 494 and the main support wire 492. In this example, a stop is formed at each lateral end of the basket 484 by a curved portion of a basket wire 496. All these wires can be welded together or otherwise affixed. The main support wire 492 can be made from 0.08" to 0.25" steel wire, the secondary support wires 494 can be made from 0.08" to 0.25" steel wire, and the basket wires 496 can be made from 0.08" to 0.25" steel wire. In the example of FIGS. 35A-35C, the main support wire 492 one of the secondary wires 494 are secured to the frame 488 by a bracket 490. In FIGS. 35A and 37C, the basket 484 is approximately centered. In FIGS. 37B-37C, the basket 484 has been slid horizontally by hand without tools and without moving a latching mechanism to the left relative to the frame 488. The exemplary basket 484 is about 9 to 16 inches wide and can be horizontally slid from one extreme to another which makes it able to slide about 80% of its width. The shower station 480 can be 22 to 60 inches in height from the top of the frame to the bottom of the frame.

Figure 36A:
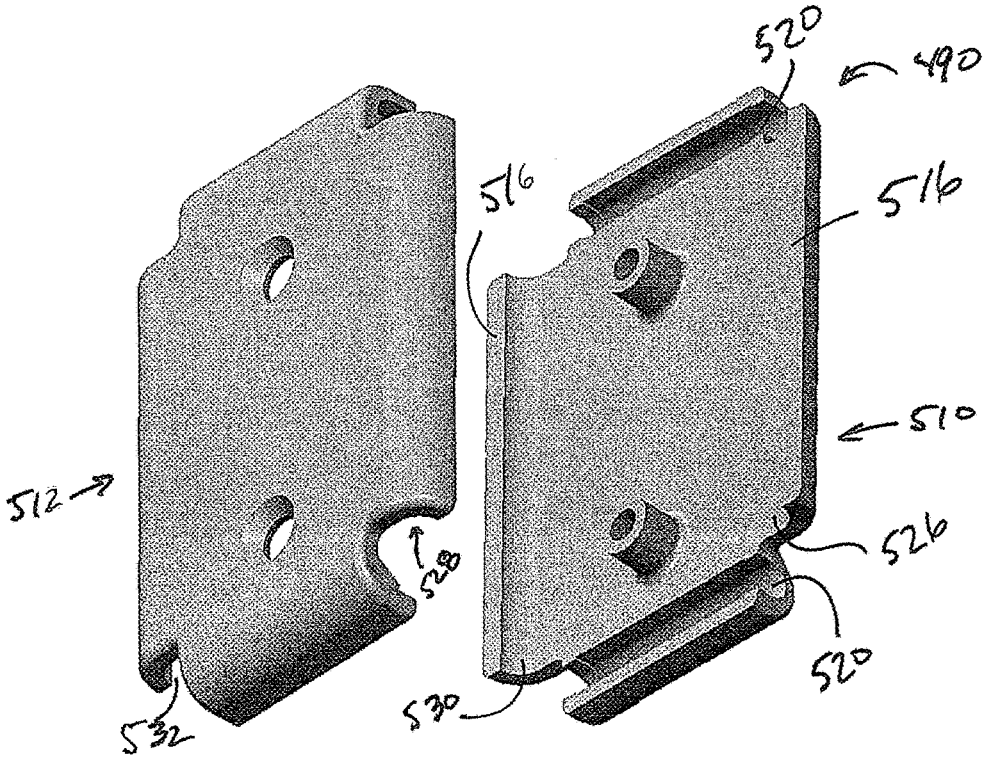
Figure 36B:
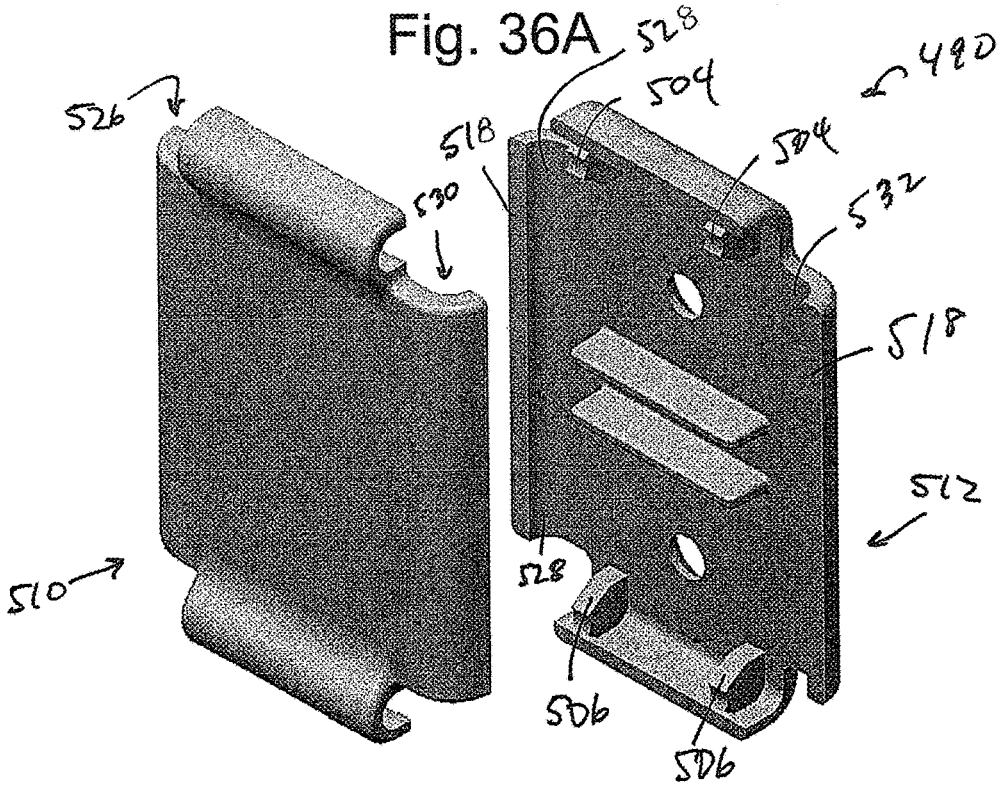
Figure 36C:
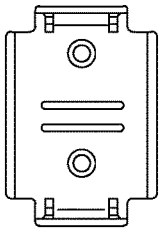
Figure 36E:
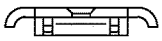
Figure 36D:
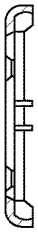
Figure 36H:
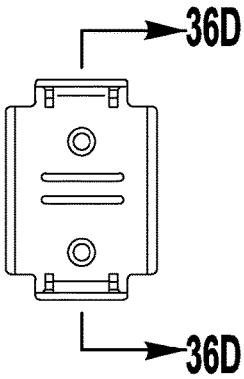
Figure 36F:
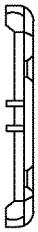
Figure 36G:
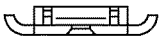

FIGS. 35B and 36A-36B show an exemplary bracket 490 used to secure basket 484 to the frame 488. The bracket 490 is tightly secured to the frame 488. The bracket has two openings 500, 502 that slidably carry the basket 484, here the openings slidably retain the main support wire 492 and one of the secondary support wires 494 in a manner that permit the basket 484 to be slid horizontally to the right or to the left by hand without tools. More specifically, opening 500 slidably retains the main support wire 492 and opening 502 slidably retains one of the secondary support wires 494. The openings 500, 502 of bracket 490 are sized and otherwise arranged and configured to permit the basket 484 to adjusted horizontally by hand without tools using, e.g., a force of about 5-10 pounds, or a force of 4-15 pounds or a force of 3-20 pounds, to physically slide the basket relative to bracket 490 (a force of below the lower force value in these ranges would not be sufficient to slide the basket). In exemplary embodiments, the same bracket 490 is tightly affixed to the frame 488. In the specific embodiment of FIGS. 25A-37C, the basket 484 can be adjusted horizontally by hand without tools simply by applying a force (i.e., without also moving something, such without loosening a fastener or loosening a compression collar or without moving a lever or other unlocking mechanism), e.g., a force of about 5-10 pounds, or a force of 4-15 pounds or a force of 3-20 pounds, to physically slide the basket (a force of below the lower force value in these ranges would not be sufficient to slide the basket) relative to the bracket 490 affixed to the frame 488 or to be affixed to the frame 488, while at the same time the bracket 490 tightly attaches to the frame 488 or to other mechanism, capable of tightly attaching to the frame 488. In the alternative (not shown) the bracket can be made so that something must be moved before the baskets can be adjusted horizontally within openings 500, 502, such as loosening a fastener or loosening a compression collar or moving a lever or moving another unlocking mechanism (not shown) while at the same time the bracket 490 rigidly attaches to the frame 488 or rigidly attaches to a compression collar, or other mechanism, capable of rigidly attaching to the frame 488.

The force that is required to adjust the baskets horizontally by hand without tools by simply applying that force is determined, in part, by projections 504, 506 within the brackets 490. The projections 504, 506 are sized to physically and frictionally engage the main support wire 492 and the secondary support wire 494 in a manner that permit the basket 484 to be slid horizontally to the right or to the left by hand without tools and merely by applying the force. This force can, for example, be applied with one hand while holding the frame 488 or bracket 490 with the other hand. A kit with written instructions having the foregoing adjustment instructions printed thereon can be included with a shower caddy or shower caddy kit or shower station or shower station kit including any one or any two or more of these baskets 484 with brackets 490. That is, the projections 504, 506 are both radially size (in a direction toward the central axis of the wires 492, 494) and longitudinally sized (in a direction along the longitudinal axis of the wires 492, 494) to provide the desired adjustment force, e.g., a force of about 5-10 pounds, or a force of 4-15 pounds or a force of 3-20 pounds, to physically slide the basket (a force of below the lower force value in these ranges would not be sufficient to slide the basket) relative to bracket 490.

Referring now to FIGS. 36A-36B, two pieces 510, 512 forming the bracket 490 are shown separated from each other. Additional details of the pieces 510, 512 are shown in the sheet following FIG. 28B and the sheet following FIG. 36B. Piece 510 is identical to piece 340. The two bracket pieces 510, 512 are secured together with two fasteners 514 (FIG. 35B). The two bracket pieces 510, 512 forcibly meet at surfaces 516, 518 and are held together by a force provided by the fasteners 514 extending through holes in the bracket piece 512 and into screw bosses carried by bracket piece 510. The wire pieces 492, 494 are slidably secured in the bracket 490 in a channel 520 of piece 510 on one side and on the other side by the projections 504, 506, which are carried by bracket piece 512 in this example. In addition to the configuration of the projections 504, 506, the force that is required to adjust the basket 484 horizontally by hand without tools by simply applying that force is also determined by the length of channel 520, the diameter of wires 492, 494, and the finish on these parts. These are selected to provide, the desired adjustment force, e.g., a force of about 5-10 pounds, or a force of 4-15 pounds or a force of 3-20 pounds, to physically slide the basket (a force of below the lower force value in these ranges would not be sufficient to slide the basket) relative to bracket 490 without tools and without loosening anything. In this example, two wire portions 522, 524 of frame 488 are tightly secured in bracket 490. More specifically, wire portion 522 is tightly secured in a channel 526 of bracket piece 510 on one side and a channel 528 of bracket piece 512 on the other side. Similarly, wire portion 524 is tightly secured in a channel 530 of bracket piece 510 on one side and a channel 532 of bracket piece 512 on the other side by a force provided by the fasteners 514. Thus, bracket 490 tightly secures wires 522, 524 and loosely secures wires 492, 494 to provide horizontal adjustability (loosely enough that they can be moved by hand, as discussed above). Of course, the position of basket 484 could be adjusted vertically if the fasteners 514 are loosened using a screwdriver.

As is apparent from the figures, FIGS. 28H-28M provide additional details about the exemplary bracket half 510 and FIGS. 36C-36H provide additional details about the exemplary bracket half 512. FIGS. 73-77 show various views of another exemplary shower caddy using the bracket of FIGS. 36A-36B.

Referring back to FIGS. 35A-35C, shower station 480 has a pair of suction cup units 486 at each end of the frame 488. The suction cup units 486 are identical to the pivoting suction cup unit with rotational stability 486, except the suction cup units 486 do not have the arm that engages the frame 488. Instead, the wires of the frame 488 extend through openings in the body of the suction cup units 486 to secure the suction cup units 486 to the frame 488. Like the pivoting suction cup unit with rotational stability 486, the suction cup units 486 have a knob 540 threadably connected to respective suction cups 542 in such a way that when the knob is turned in one direction, the suction cup 542 is pulled to a surface contacting the perimeter of the suction cup 542 with greater force. Similarly, when the knob is rotated in the opposite direction, the suction cup 542 is pulled to a surface contacting the perimeter of the suction cup 542 with lesser force. Instructions for installing the shower caddy 480 would include instructions to orient the shower caddy 480 as desired, push each of the knobs to provide an initial suction cup force, turn each suction cup knob to increase the hold force, and then horizontally adjust the basket to a desired orientation by sliding the basket 484 left or right by hand without using tools and only by applying a force.

Figure 38C:
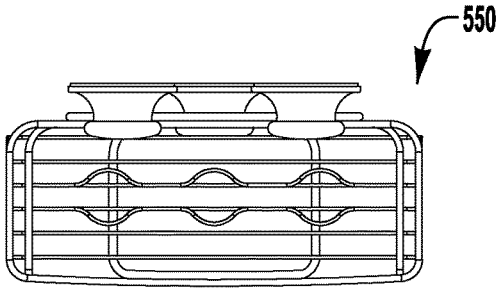
FIGS. 38A-38C show another exemplary shower station embodiment.
Figure 38A:
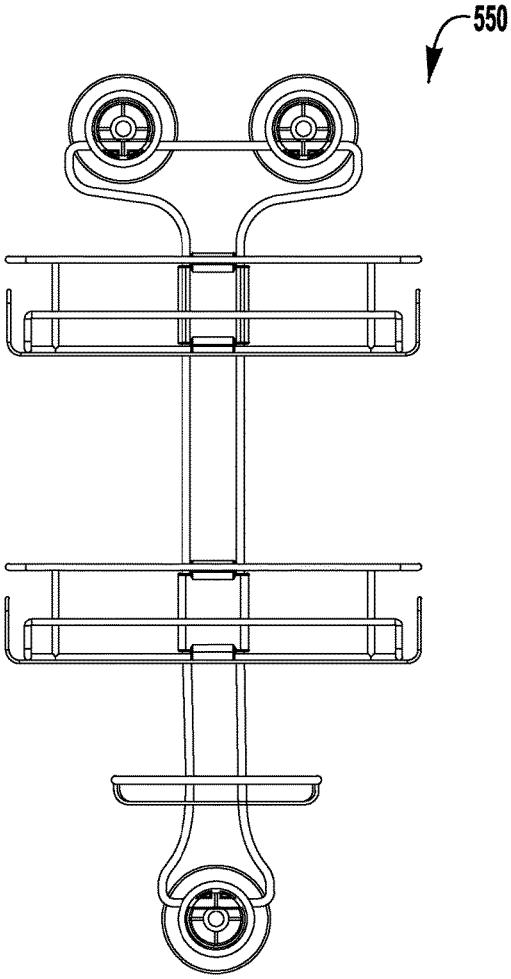
Figure 38B:
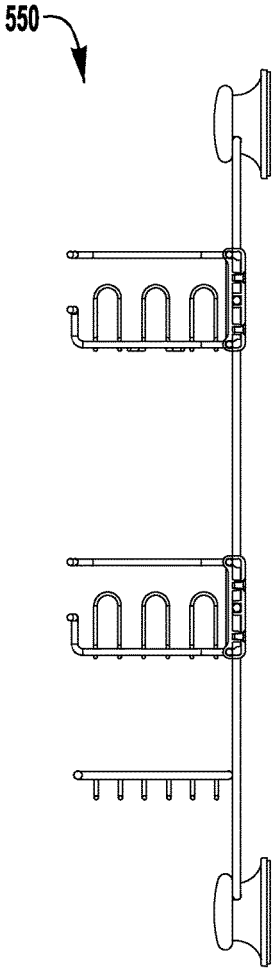
Figure 39G:
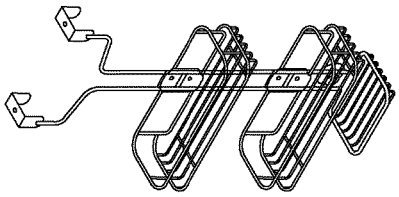
FIGS. 39A-39G show still another exemplary shower station embodiment.
Figure 39E:
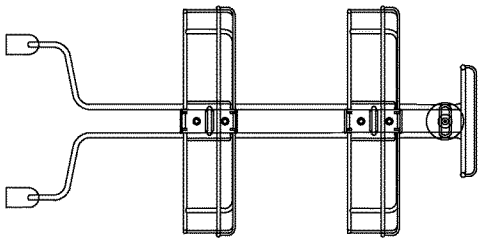
Figure 39B:
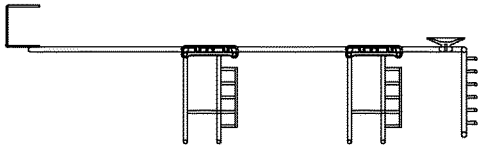
Figure 39C:
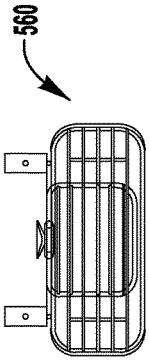
Figure 39A:
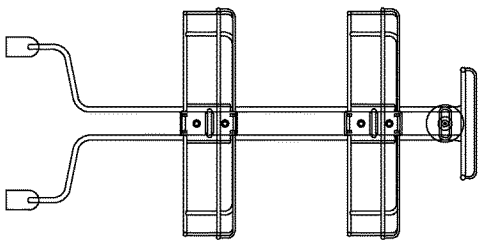
Figure 39D:
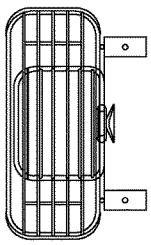
Figure 39F:
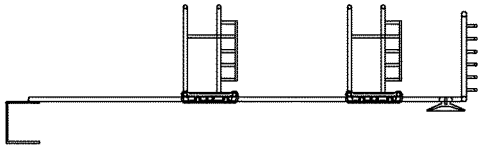
Figures 40A, 40B, 40C, 40D, 40E:
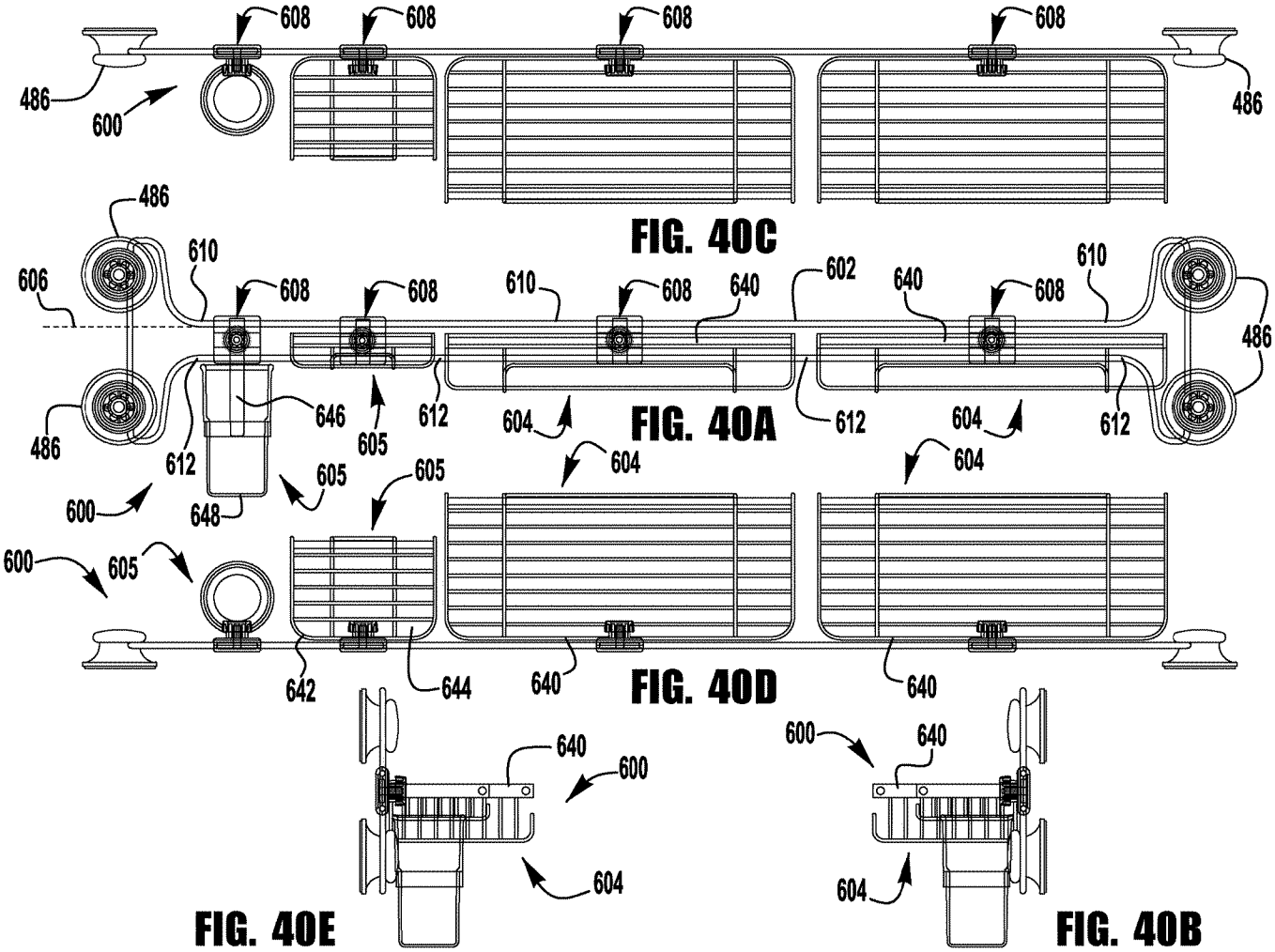
Figure 47H:
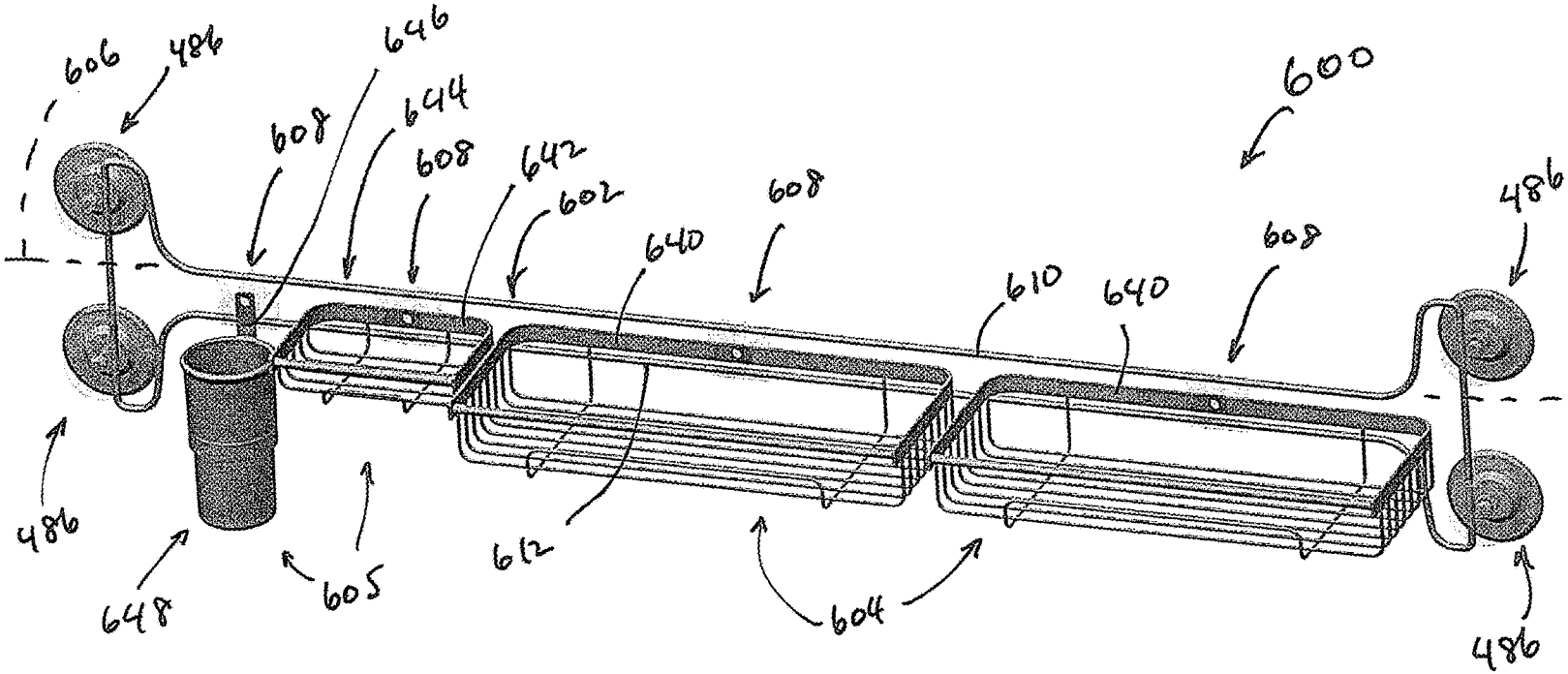
Figure 41E:
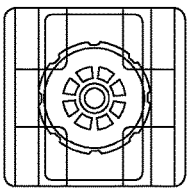
Figure 41B:
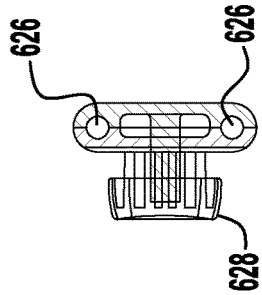
Figure 41C:
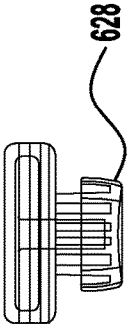
Figure 41A:
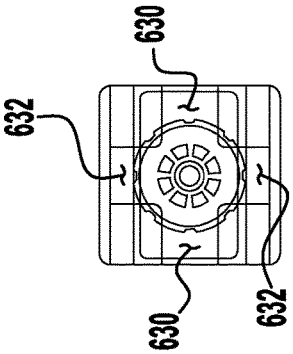
Figure 41D:
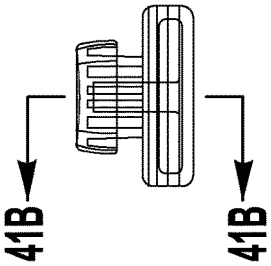
Figure 41F:
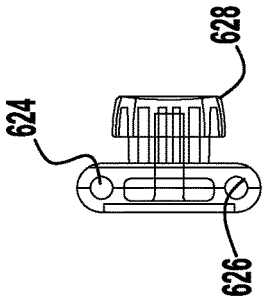
Figure 41H:
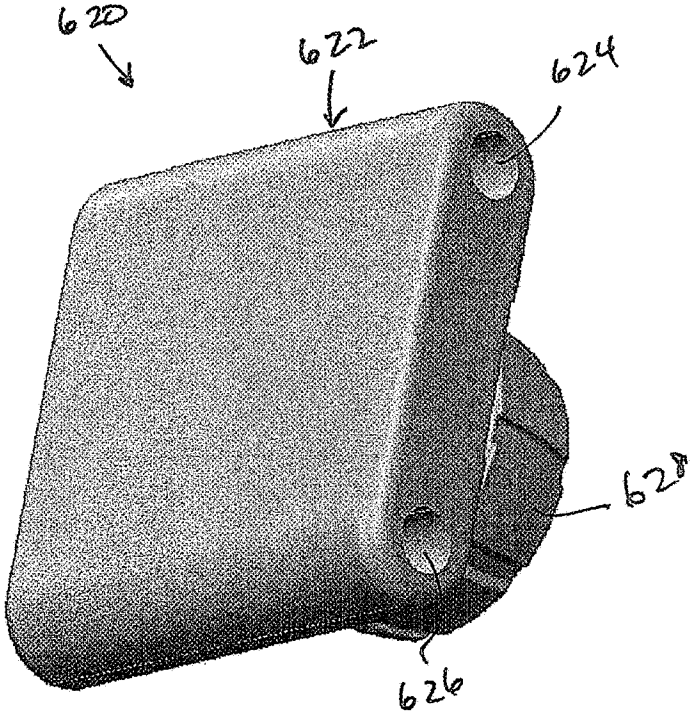
Figure 41G:
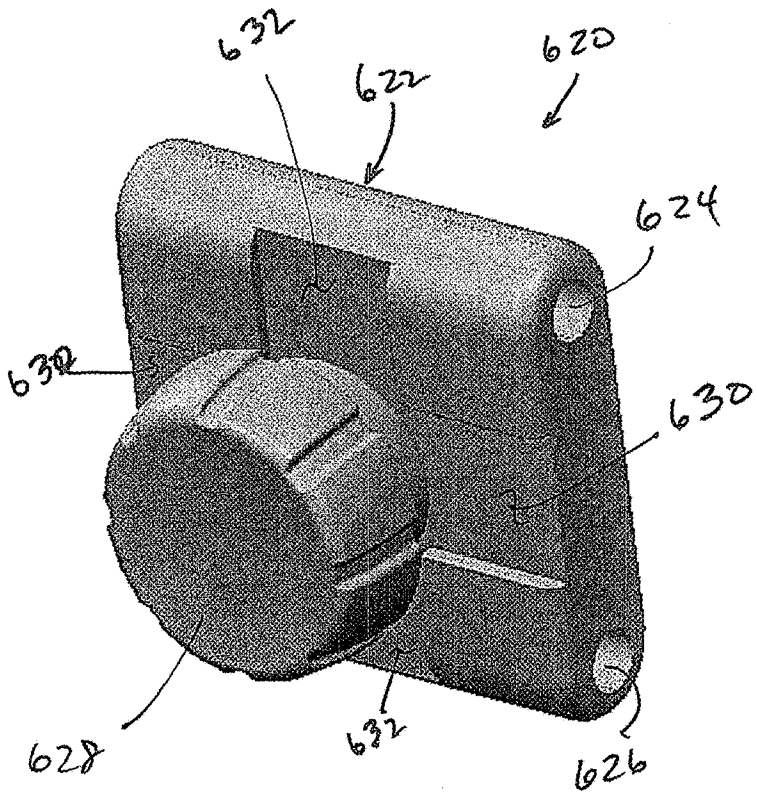

FIGS. 38A-38C show another exemplary shower caddy 550. Shower caddy 550 is identical to shower caddy 480, except it has a small basket welded to at a lower portion of the wire frame to act as a soap dish and except it has only one suction cup unit at the lower end of the frame. The shower station 550 can be 22 to 72 inches in height (e.g., about 22 inches) from the far edge of one suction cup to the far edge of the other suction cup.

FIGS. 39A-39G show another exemplary shower caddy 560 having two horizontally adjustable baskets held in place with brackets identical to the baskets 484 and brackets 490. In the embodiment 560, the frame wires flare out at the bottom and basket wires are welded therebetween to form an integral soap dish (as compared to a soap dish affixed thereto). At the top, the frame wires are secured to hooks to couple the caddy to a shower door. The shower station 560 can be 22 to 48 inches in height (e.g., about 22 inches) from the top of the hooks to the bottom of the frame.

FIGS. 40A-40F show a shower station 600 having the ability for the frame 602 to be oriented at angles other than horizontally or vertically while the baskets 604 and accessories can be oriented horizontally or vertically. In the previously discussed stations and caddies, the support surfaces of the baskets onto which a user places items are perpendicular to the longitudinal axis of the frame. In contrast, the shower station 600 has the ability for the frame 602 to be oriented at angles other than vertically while the baskets 604 can be oriented horizontally. For example, the longitudinal axis 606 of the frame 602 can be on a 30 degree angle with respect to horizontal and the baskets 604 can still be oriented horizontally. Similarly, the longitudinal axis 606 of the frame 602 can be oriented horizontally and the baskets 604 can still be oriented horizontally. This functionality is provided by twist connectors 608/620 that permit a basket 604 or accessory to be at virtually any angle with respect to the longitudinal axis 606 of the frame 602. The shower station 600 can be 24 to 72 inches from the far edge of one suction cup to the far edge of the other suction cup.

The frame 602 in this example comprises a wire bent as shown in FIGS. 40A-40F and welded to form a contiguous loop. At each end of the frame 602, there are two suction cup units 486 as discussed in connection with the embodiment of FIGS. 35A-35C. The frame wire extends through the body of the suction cup units 486. At a central portion of frame 602, two wire portions 610, 612 extend most of the length of frame 602 substantially equidistant from one another (substantially parallel). Special lock assemblies 620 (FIGS. 41A-41H) secure the wire portions 610, 612 to the baskets 604 and accessories 605. The lock assemblies 620 comprise a bracket 622 with a pair of openings 624, 626 that accept and selectively secure the bracket 622 (and items carried by the bracket) to the wire portions 610, 612 of frame 602. More specifically, a knob 628 of lock assembly 620 threadably engages a nylon thread inside the bracket 620. The bracket 620 also has two channels 630, 632 that are sized about the same size or slightly larger than bands 640 of baskets 604 and bands of accessories 605, such as band 642 of dish 644 and band 646 of cup 648. Each band 640, 642, 646 has an opening through which a fastener extends, which fastener is coupled to the knob 628 and the bracket 622 to provide the functionality described herein. Turning the knob 628 in one direction causes the bracket 622 to firmly engage the wire portions 610, 612 and tightens down the bands 640, 642, 646 of the baskets and accessories against the brackets 622. Turning the knob 628 in the opposite direction loosens the wire portions 610, 612 and the bands 640, 642, 646. In the orientation of FIGS. 40A-40F, the frame 602 is horizontal and the bands 640, 642 are in the horizontal groove 630 of their respective lock assemblies 620 and the band 646 is in the vertical groove 632 of its respective lock assembly 620.

As with the other embodiments, a kit might include the assembly of FIGS. 40A-40H and printed installation instructions. Instructions for installing the shower caddy 600 would include instructions to orient the shower caddy 600 as desired, push each of the knobs 628 to provide an initial suction cup force, turn each suction cup knob 628 to increase the hold force, and then loosening each knob to permit the baskets 604 and accessories 605 to be oriented as desired, e.g., horizontally even though the frame is neither vertical nor horizontal, orient the baskets 604 and accessories 605 as desired, and re-tighten the knobs 628 to tightly secure the baskets 604 and accessories 605 relative to the wire portions 610, 612.

All of the wire parts herein can be made from steel, e.g., stainless steel. All of the tubing, e.g., the tubular members forming the various frames herein, can be made of steel, e.g., stainless steel. Virtually all the other parts can be made of plastic, e.g., rigid durometer plastic or soft durometer plastic. The various suction cups and the pieces 60' and 64' in FIG. 3 are preferably made of soft durometer plastic.

Many of the devices above are configured to use a compression sleeve and compression to secure the device to one or more poles or other tubular members. For example, exemplary adjustable basket 110 (FIGS. 16-17) has a plurality of vertically oriented openings 112 that accept a compression sleeve 114 that has a flange 116. The compression sleeve 114 is inserted into the opening 112 from below and the flange 116 engages a flange 118 inside the opening 112, which flange retains the sleeve 114 in the opening 112 by preventing further movement upward inside the opening 112. In the alternative, a flange on the compression sleeve 114 engages the bottom of the collar or other structure with the opening 112 and that retains the sleeve in the opening by preventing further movement upward inside the opening 112. Exemplary adjustable basket 16 (FIGS. 22 and 23) has a very similar structure with an affixed collar 180 with a vertical opening 184 that accepts a compression sleeve secured by a compression collar. As other examples, exemplary moveable mirror 150 (FIG. 18), exemplary pivoting towel bar 152 (FIG. 19), exemplary moveable double-hook 154 (FIG. 20), and exemplary moveable soap dish 156 (FIG. 21) each have a collar 158 having a vertically oriented opening 160 with an inner flange like opening 112 and flange 118 that accepts a compression sleeve secured by a compression collar. In the alternative, a flange on the compression sleeve 114 engages the bottom of the collar or other structure with the opening 112 and that retains the sleeve in the opening by preventing further movement upward inside the opening 112. These devices are very securely affixed to the pole or other tubular member. That said, it can be inconvenient to move any of the pieces to change the order of pieces on the pole or tubular member. For example, in the example of FIGS. 1-2, to exchange the locations of soap dish 156 and towel bar 152, a user will need to decouple some of the members forming frame 12, remove the soap dish 156 from its respective pole or tubular member, remove the towel bar 152 from its respective pole or tubular member, place the soap dish 156 over the pole or tubular member where the towel bar 152 was located, place the towel bar 152 over the pole or tubular member where the soap dish 156 was located, and re-couple the tubular members to form frame 12.

FIGS. 43, 44A-44K, 45A-45K, 46A-46K, 47-55, 55A-55G, 56A-56G, and 57 show various views of accessories using an optional new adapter that permits the accessories to be removed from and attached to a frame without disassembling the frame and without tools, permitting the accessories to be re-sequenced on a frame, without disassembling the frame and without tools (the adapter stays attached to the frame and the accessory is removable from the adapter by hand without tools). Similarly, FIGS. 58A-58L, 59A-59L, and 60A-60L show various views of baskets and shelves using the optional new adapter that permits the baskets and shelves to be removed from and attached to a frame without disassembling the frame and without tools, permitting the accessories to be re-sequenced on a frame, without disassembling the frame and without tools (the adapter stays attached to the frame and the accessory is removable from the adapter by hand without tools).

In exemplary general embodiments, the adjustable accessory includes: a. an accessory affixed to at least one support that supports the accessory; and at least one adapter having a frame opening extending therethrough that accepts a portion of a frame member and is supported by the frame in a vertical orientation when in use, the adapter also having at least one support opening that removably accepts a portion of the at least one support; and wherein the at least one support and the at least one adapter cooperate to support the accessory and retain the accessory in an in-use orientation when the portion of the frame is in a vertical orientation; and wherein the at least one support can be removed from the at least one adapter by hand without tools permitting the accessory to be removed from the at least one adapter by hand without tools. In exemplary embodiments, the at least one support has a portion extending substantially parallel to an axis of the compression sleeve and the support opening in the at least one adapter also extends substantially parallel to an axis of the compression sleeve. In exemplary embodiments, the accessory can be removed from the at least one adapter simply by lifting the portion of the at least one support out of the support opening of the at least one adapter. In exemplary embodiments, the adapter is affixed to the frame using a compression sleeve inside the frame opening. In other exemplary embodiments, some other means of supporting the adapter on the frame (or affixing the adapter to the frame) is provided, e.g., any one or any two or more of: a set screw threaded into a threaded or non-threaded opening in the adapter that extends radially out from an axis of the adapter (e.g., an axis of rotational symmetry of the adapter) (not shown) which set screw can be moved into the frame opening to engage the frame and/or a clamping lever hinged to the adapter body (not shown) that provides a lever that can be manually moved to engage and disengage the frame to secure the adapter to the frame, and release the adapter from the frame, respectively.

In exemplary compression sleeve embodiments, the adjustable accessory includes: an accessory affixed to at least one support that supports the accessory; at least one adapter having a sleeve opening extending therethrough with a flange or other surface that accepts and is supported by a compression sleeve in a vertical orientation when in use, the adapter also having at least one support opening that removably accepts a portion of the at least one support; a compression sleeve for insertion in the opening of the adapter and having a threaded end; and a compression collar for threadably coupling to the compression sleeve to secure the adapter; and wherein the at least one support and the at least one adapter cooperate to support the accessory and retain the accessory in an in-use orientation when the compression sleeve is in a vertical orientation; and wherein the at least one support can be removed from the at least one adapter by hand without tools permitting the accessory to be removed from the at least one adapter by hand without tools. In exemplary embodiments, the at least one support has a portion extending substantially parallel to an axis of the compression sleeve and the support opening in the at least one adapter also extends substantially parallel to an axis of the compression sleeve. In exemplary embodiments, the accessory can be removed from the at least one adapter simply by lifting the portion of the at least one support out of the support opening of the at least one adapter.

Figure 43:
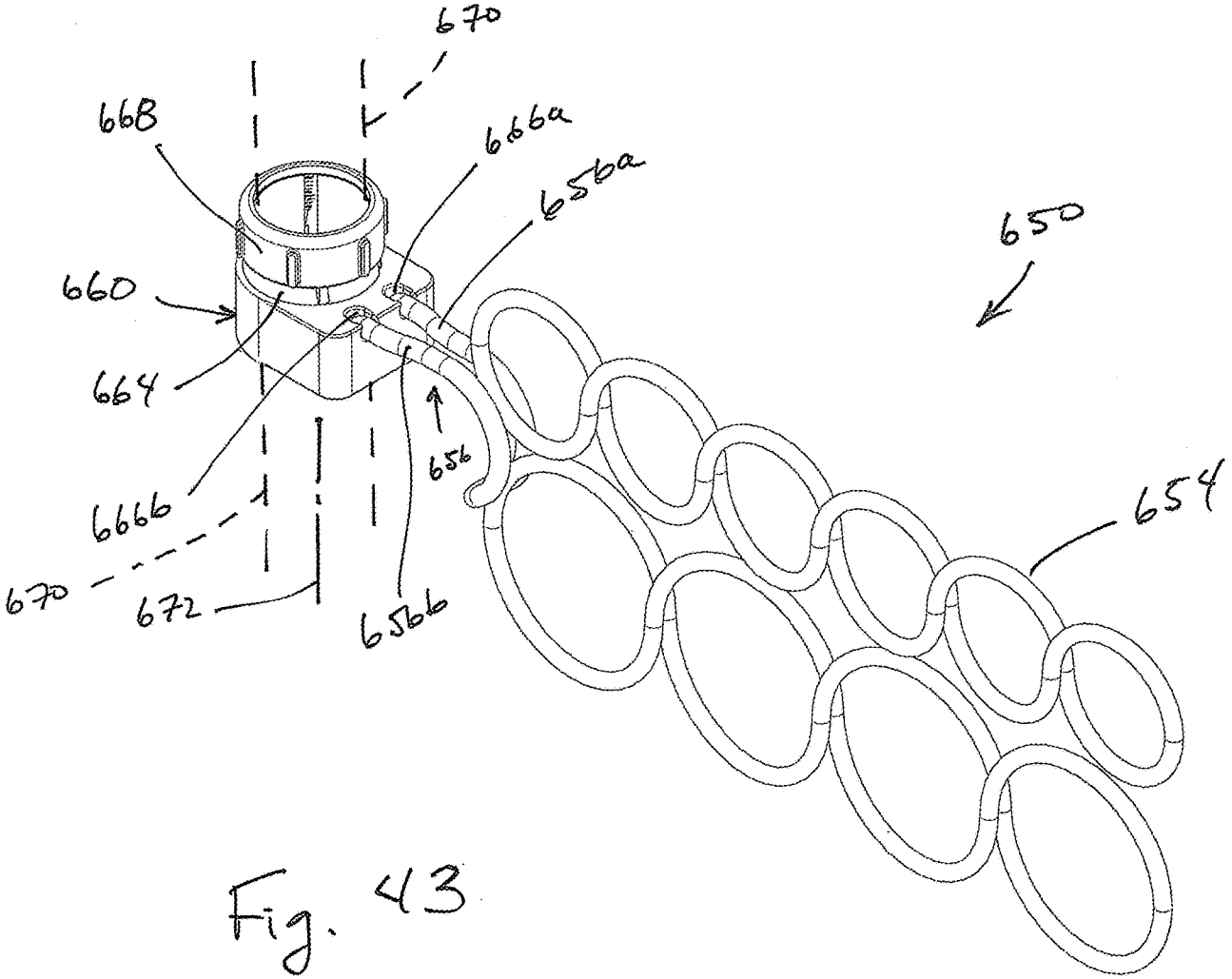
Figure 44H:
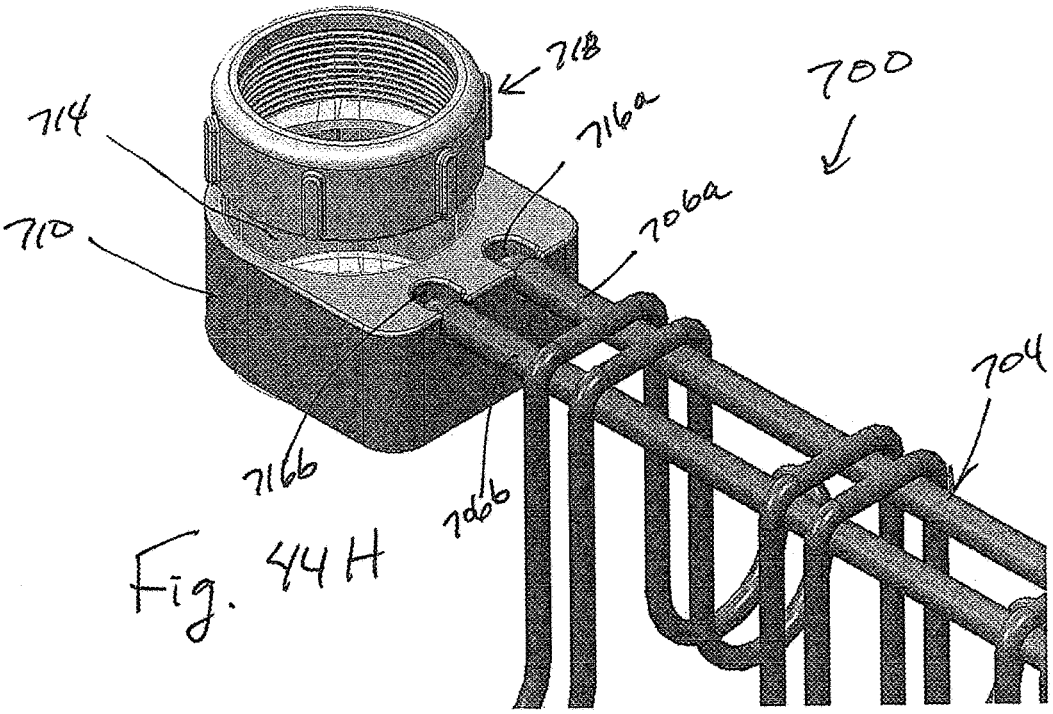
Figure 44I:
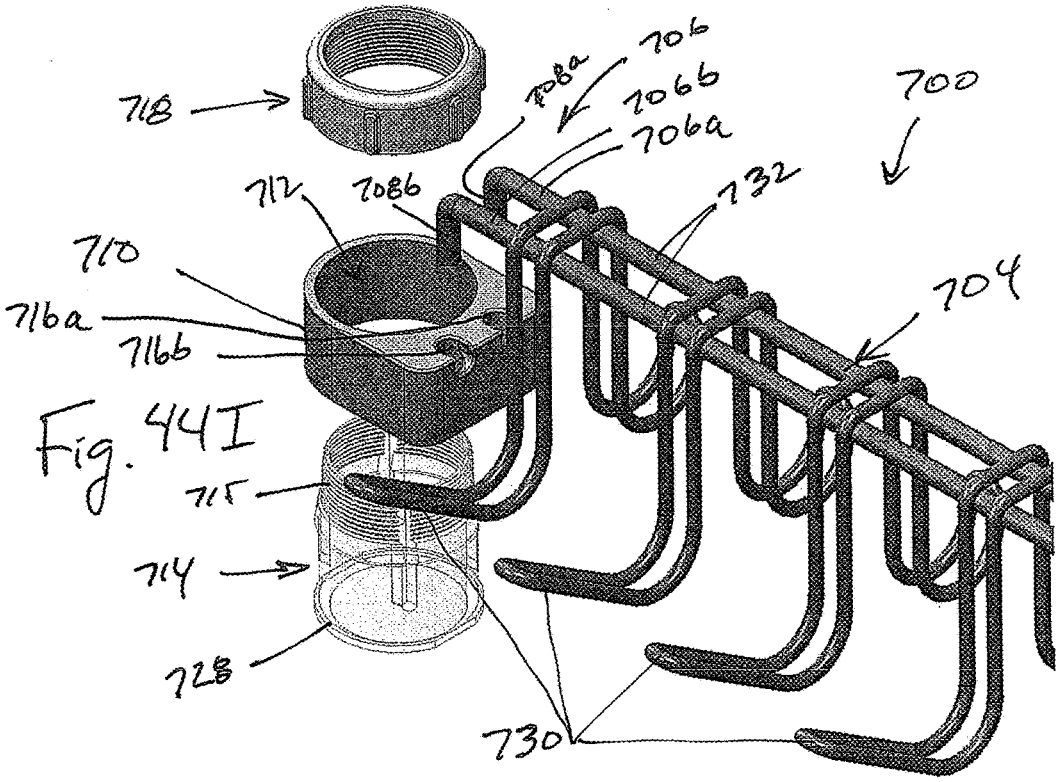
Figure 44J:
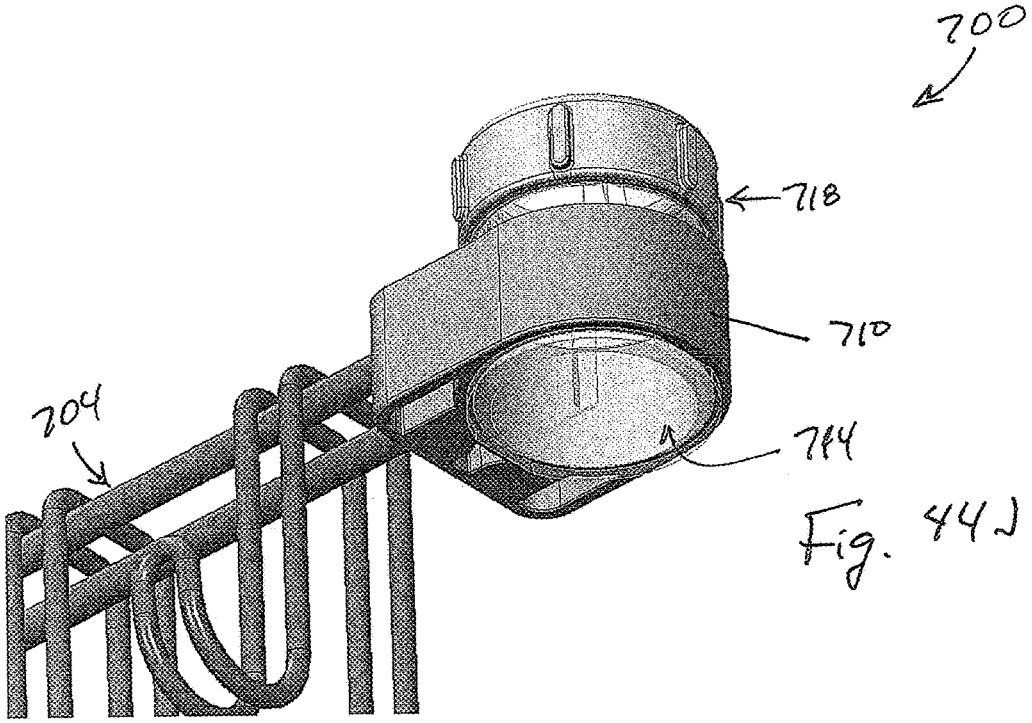
Figure 44K:
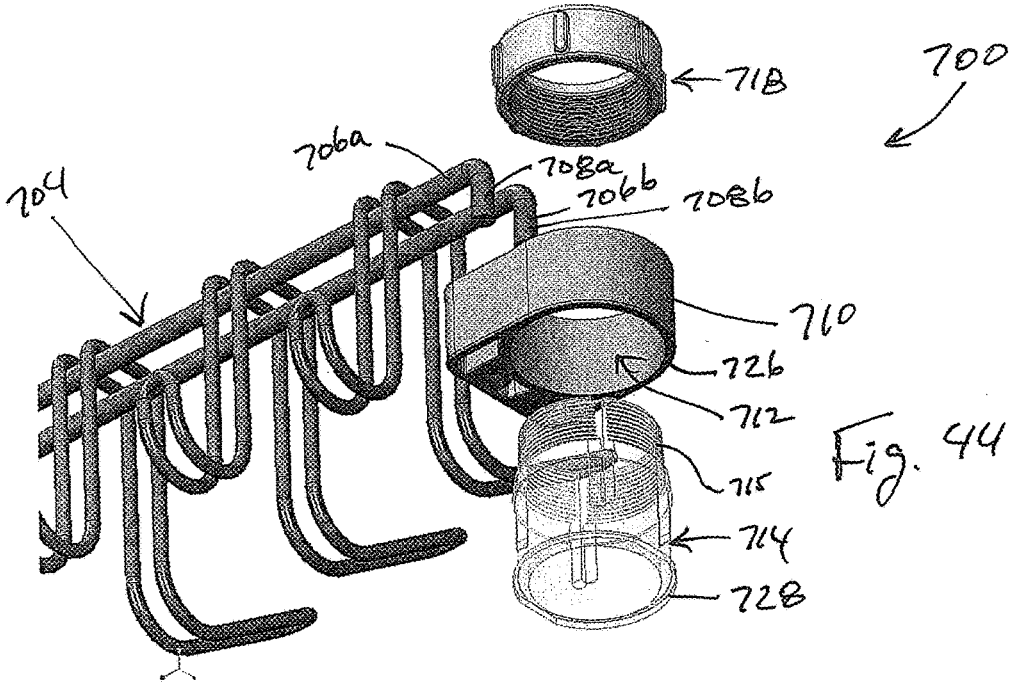
Figure 45G:
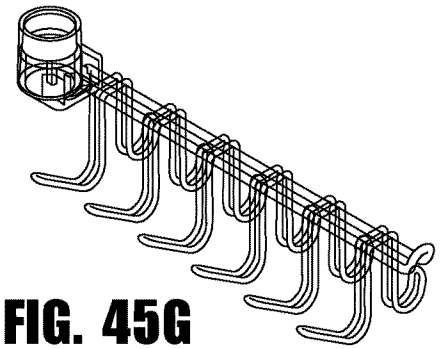
Figure 45E:
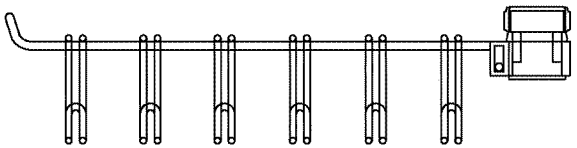
Figure 45B:
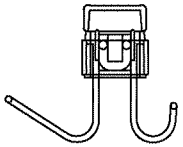
Figure 45C:
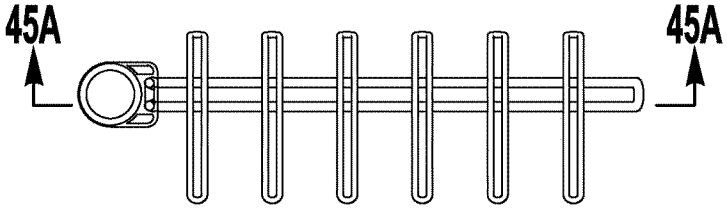
Figure 45A:
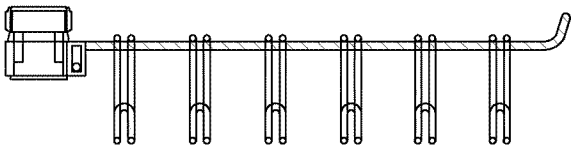
Figure 45D:
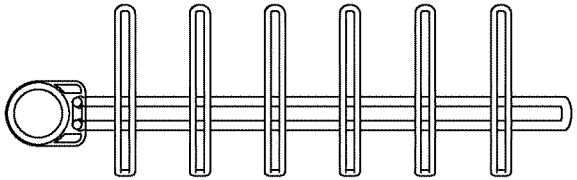
Figure 45F:
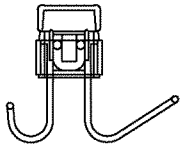
Figure 45H:
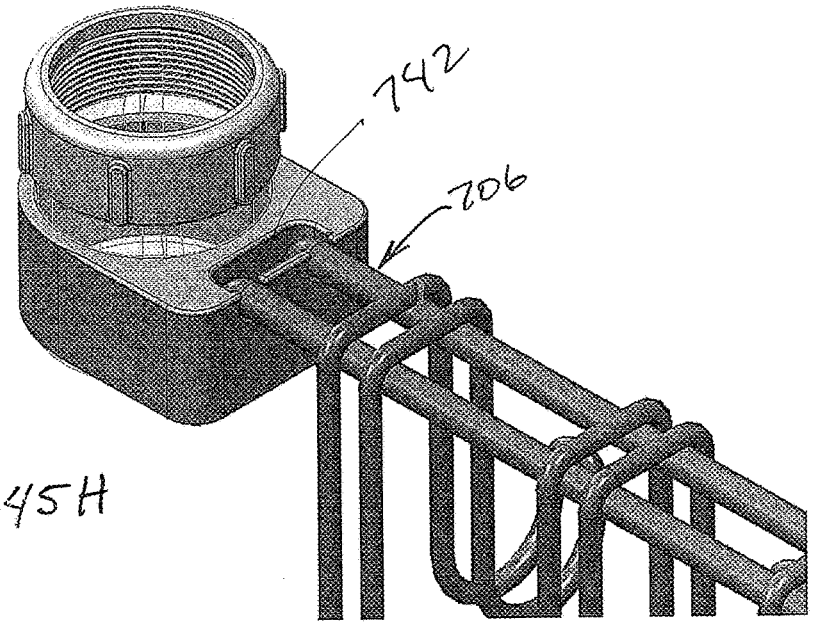
Figure 45I:
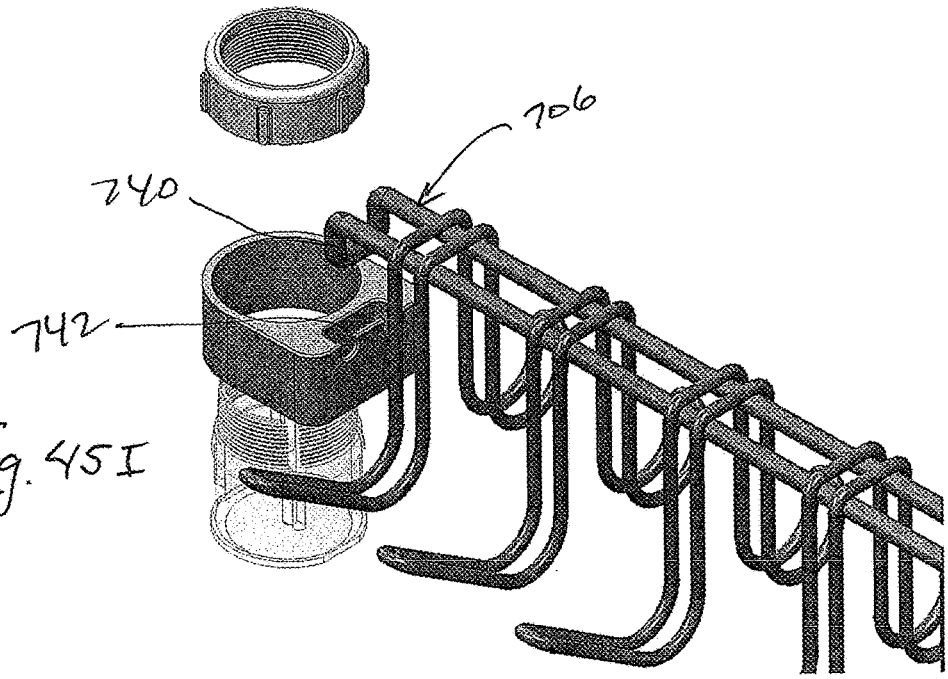
Figure 45J:
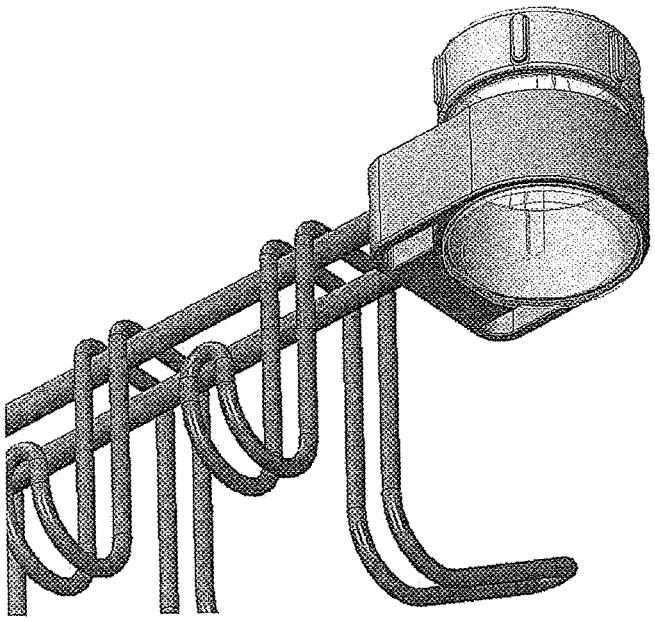
Figure 45K:
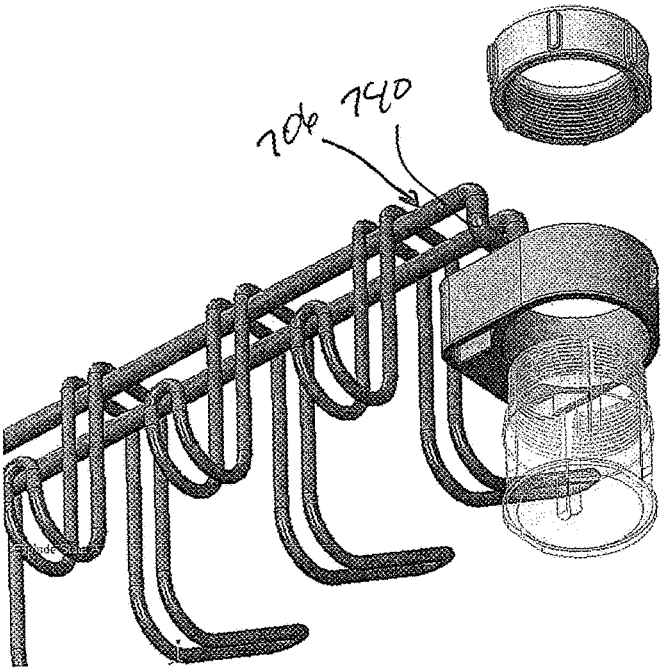
Figure 46G:
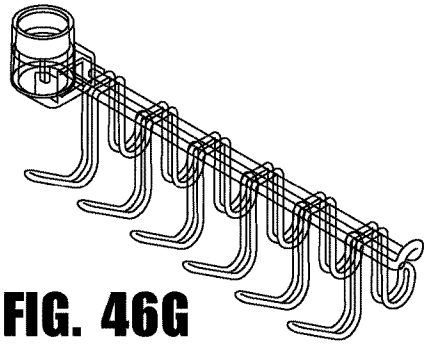
Figure 46E:
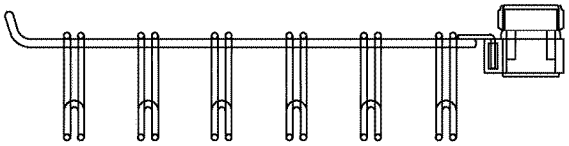
Figure 46B:
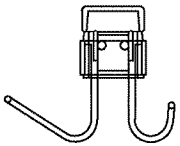
Figure 46C:
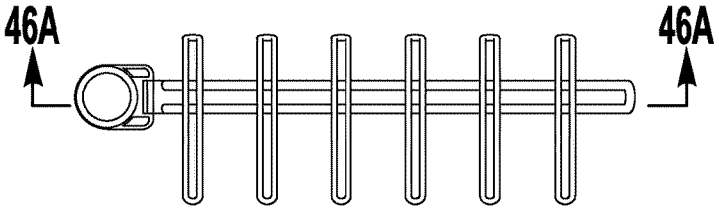
Figure 46A:
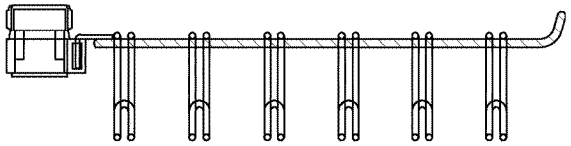
Figure 46D:
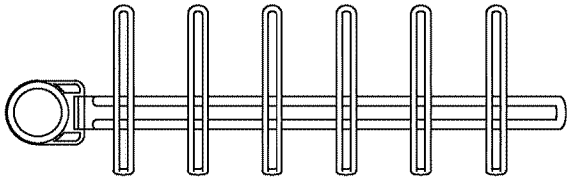
Figure 46F:
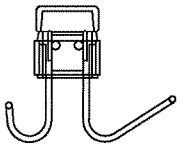
Figure 46H:
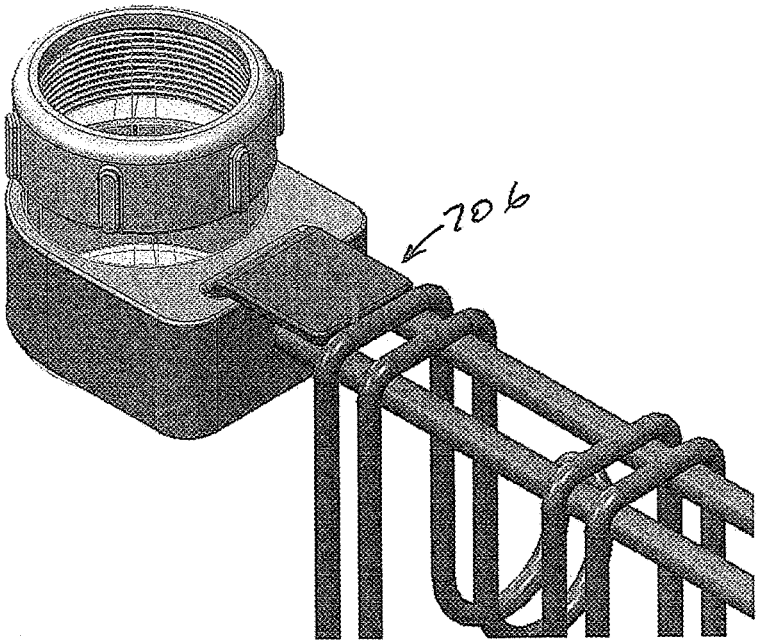
Figure 46I:
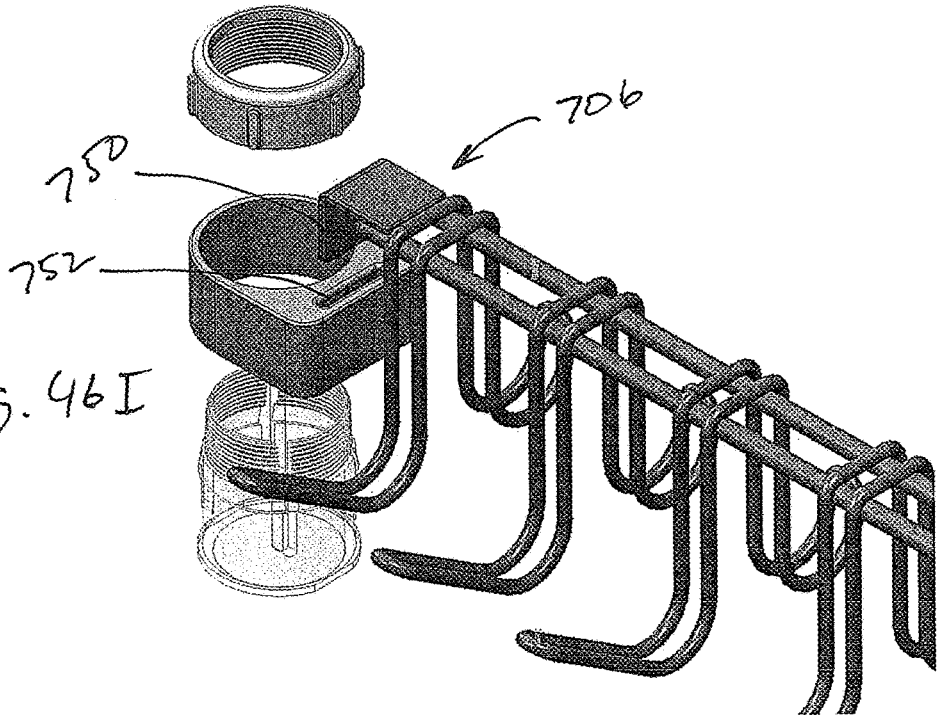
Figure 46J:
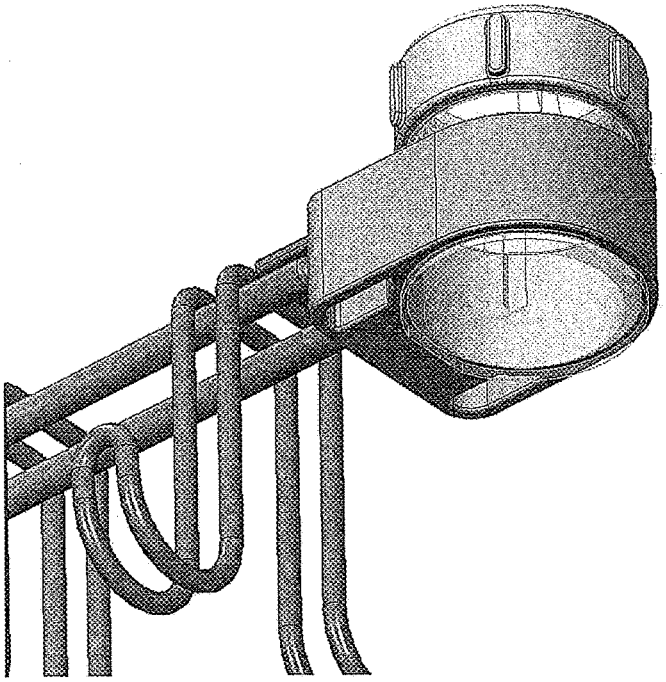
Figure 46K:
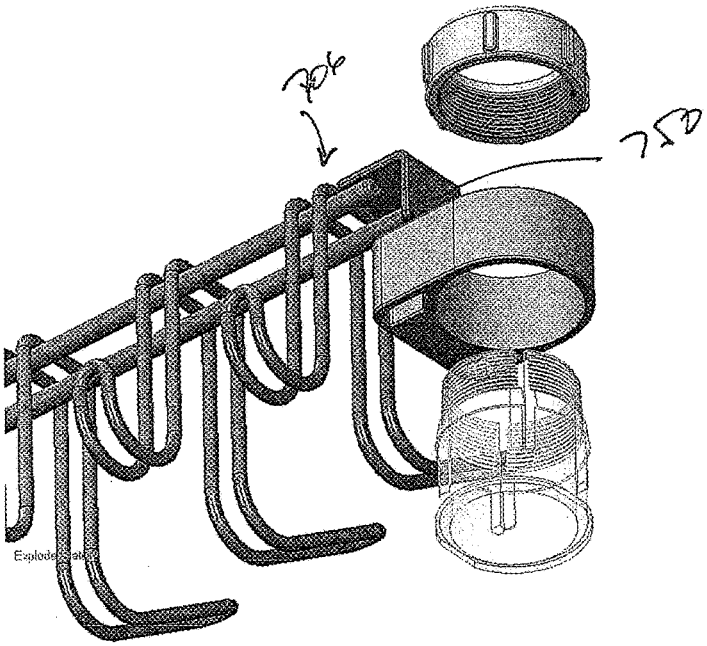
Figure 47:
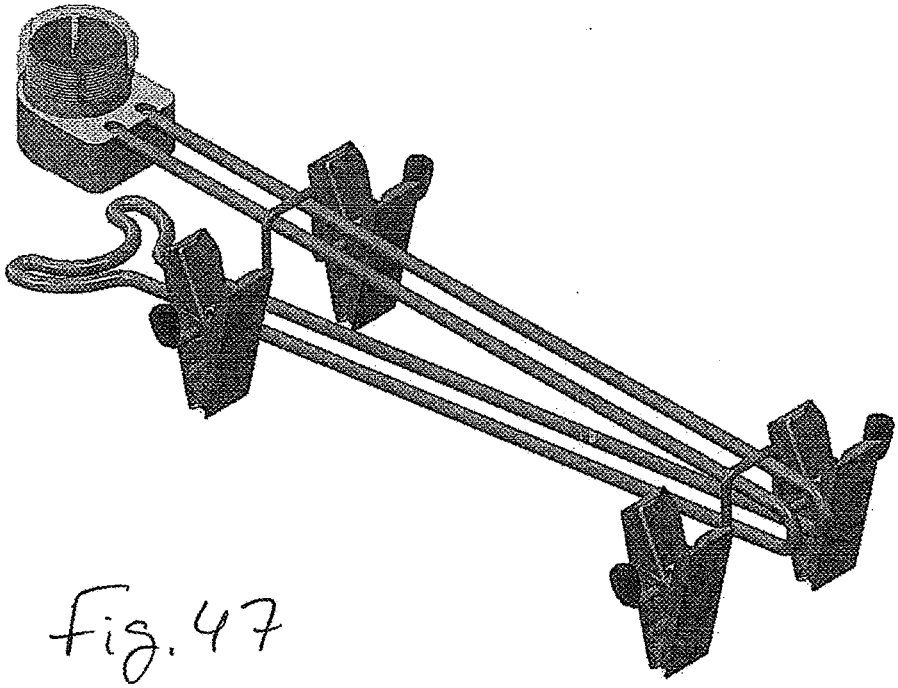
Figure 48:
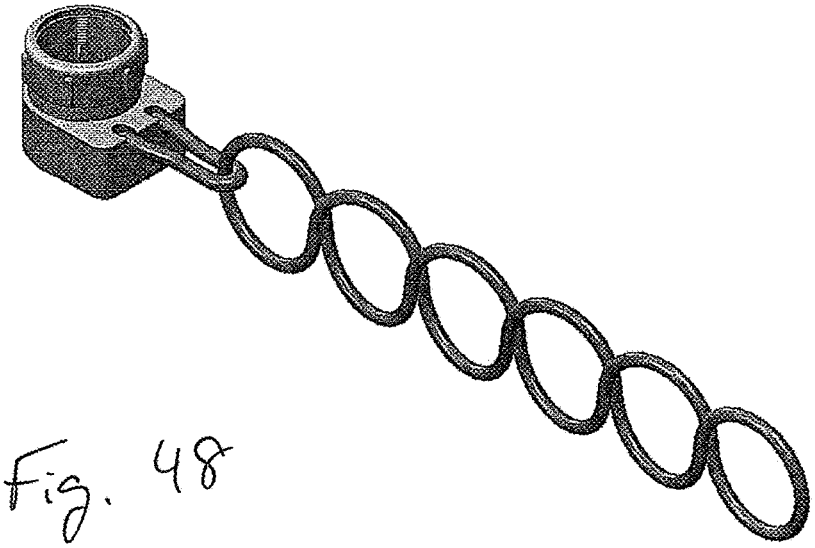
Figure 49:
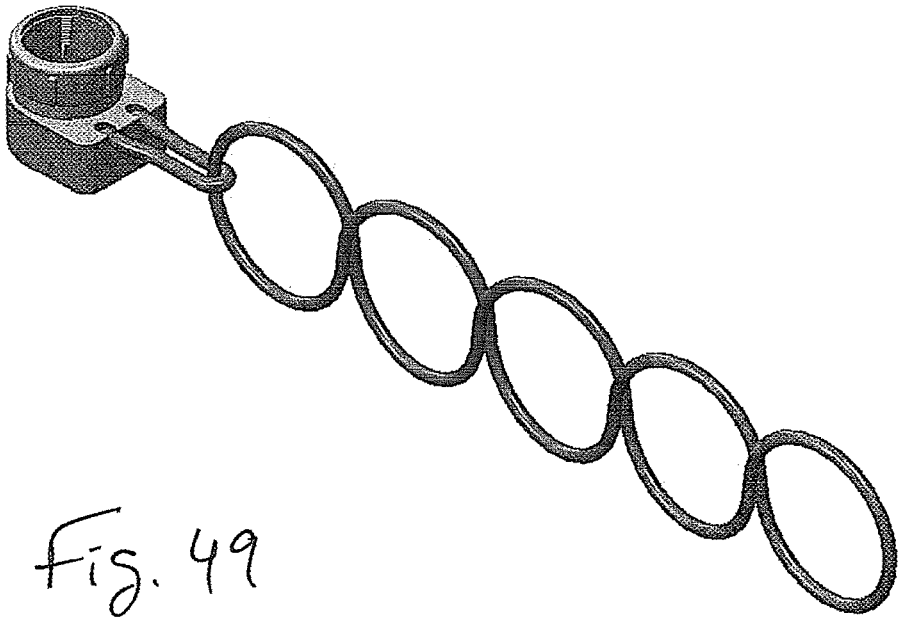
Figure 50:
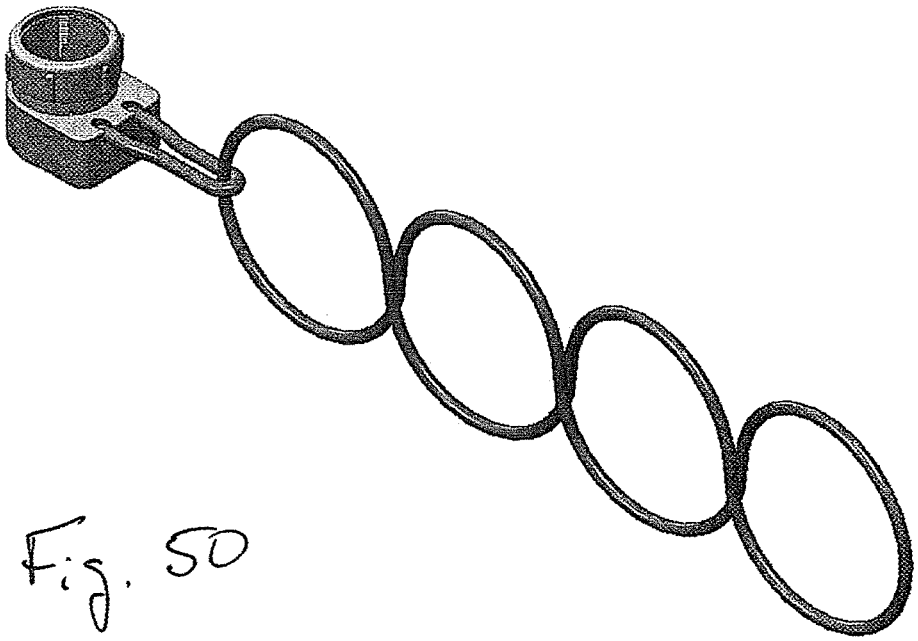
Figure 51:
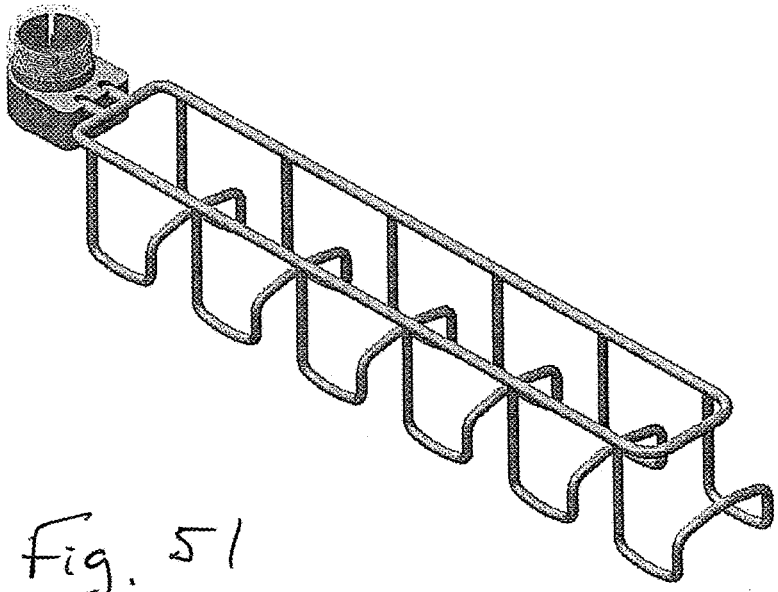
Figure 52:
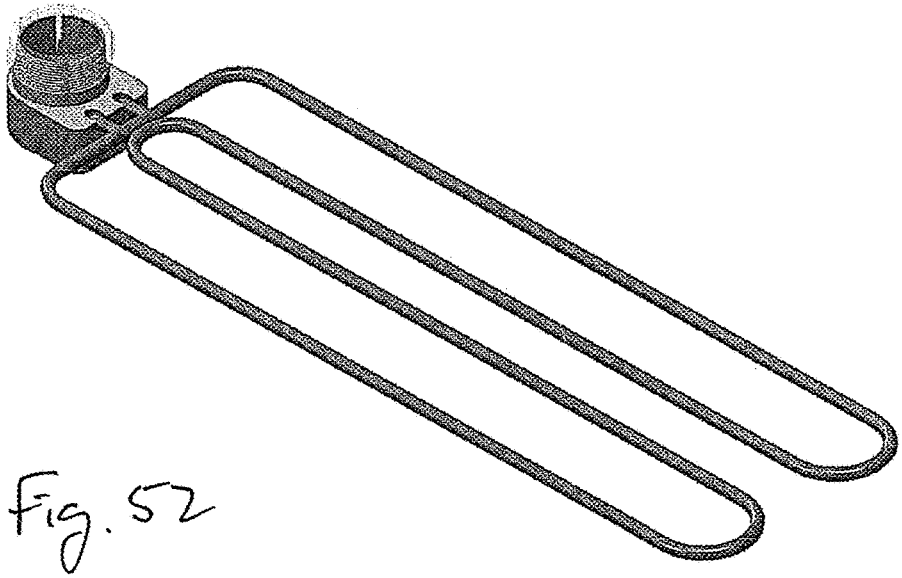
Figure 53:
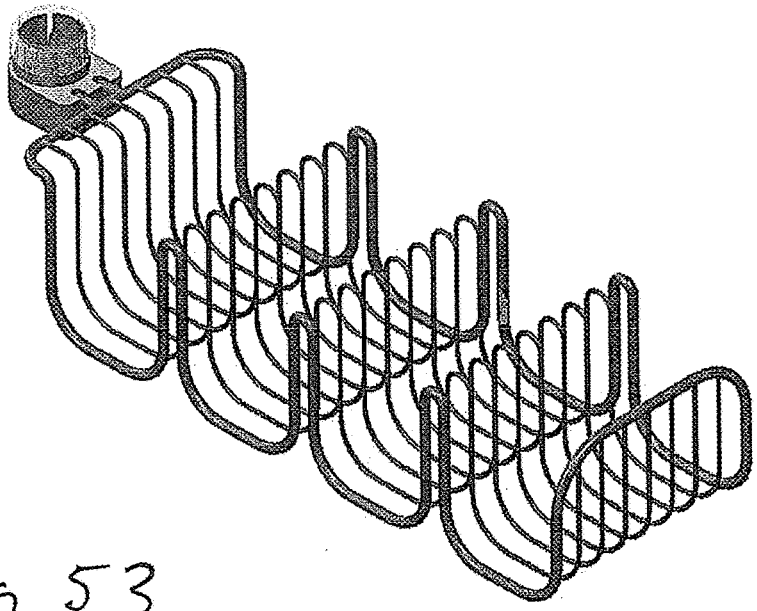
Figure 54:
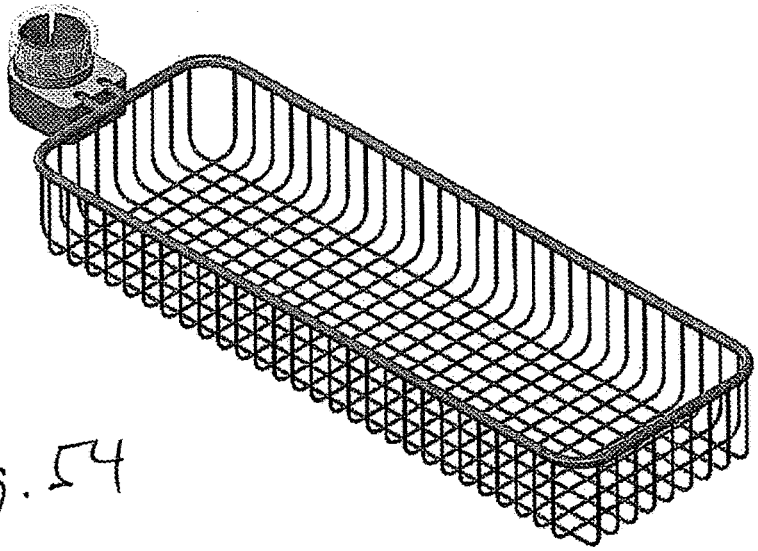
Figure 55F:
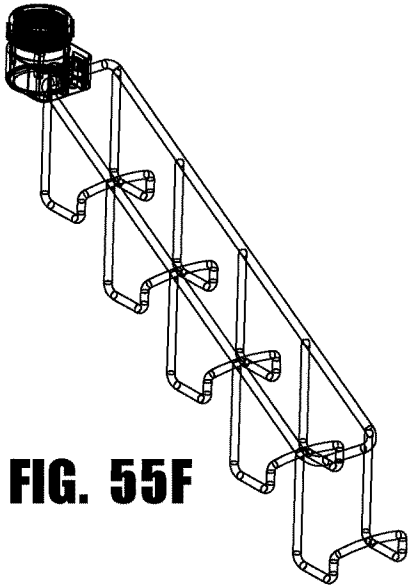
Figure 55B:
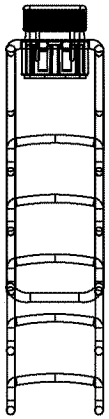
Figure 55C:
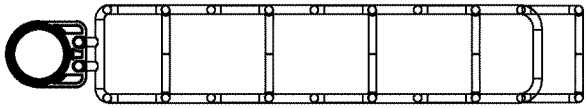
Figure 55A:
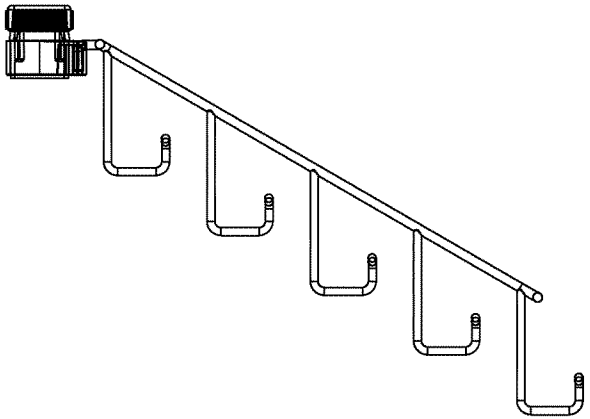
Figure 55D:
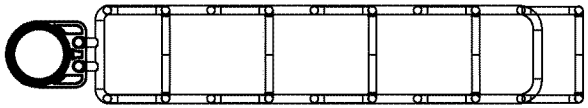
Figure 55E:
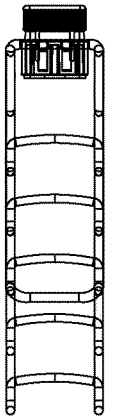
Figure 55G:
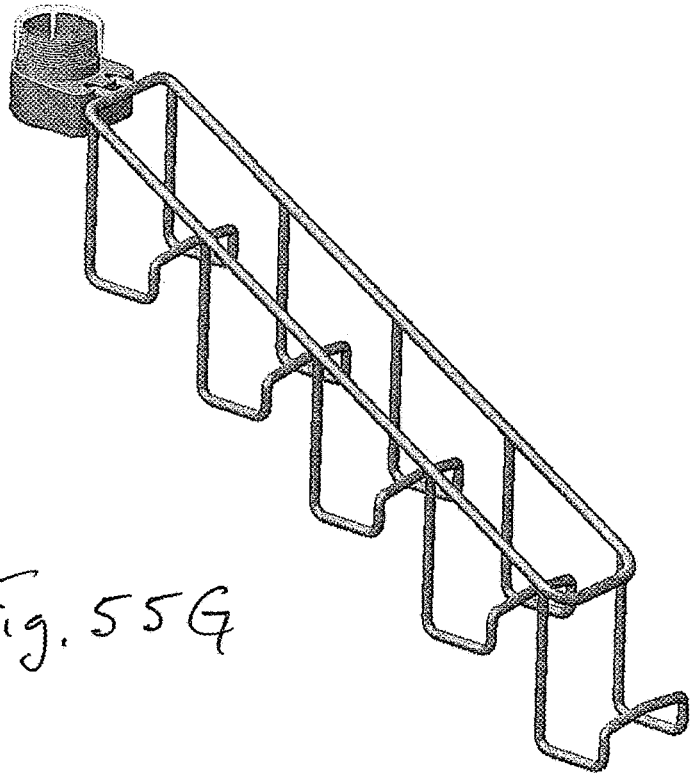
Figure 56G:
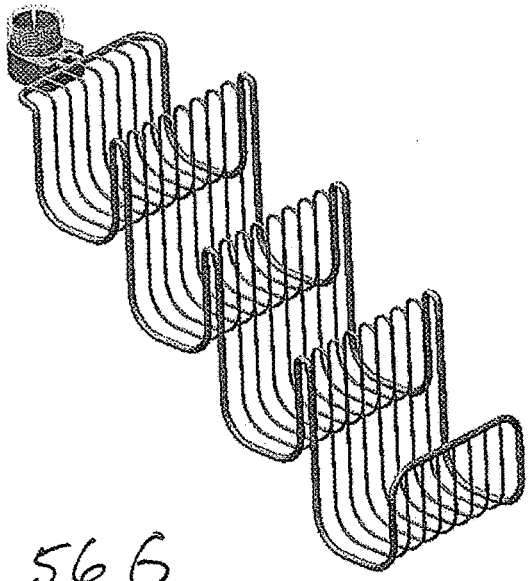
Figure 56F:
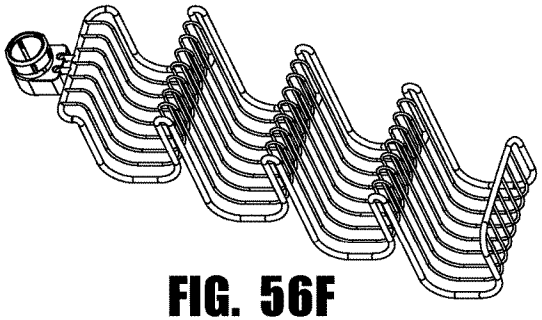
Figure 56B:
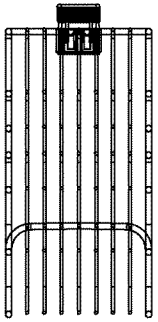
Figure 56C:
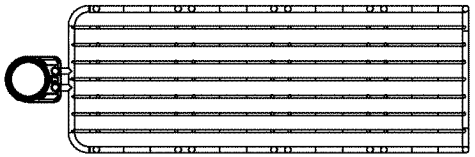
Figure 56A:
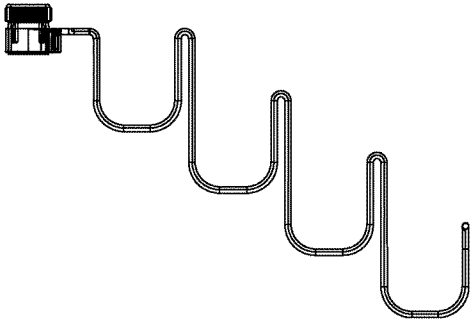
Figure 56D:
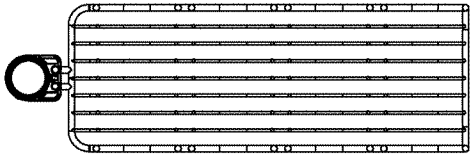
Figure 56E:
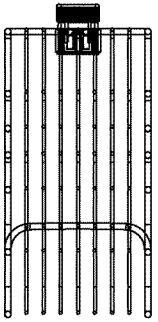
Figure 57:
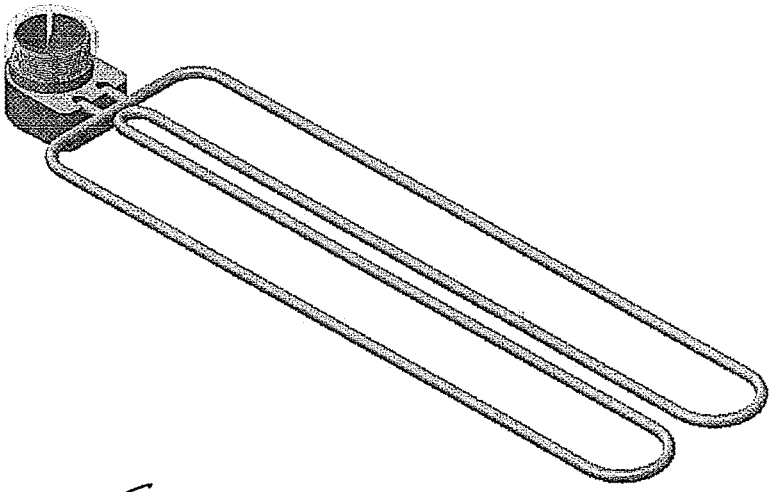
Figure 58F:
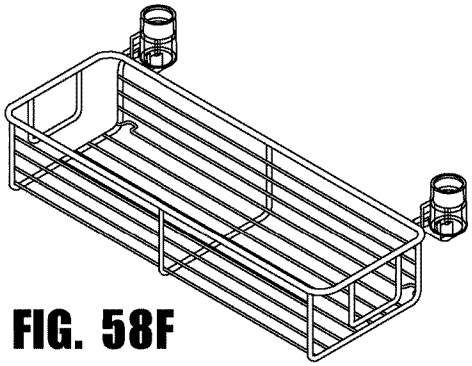
Figure 58E:
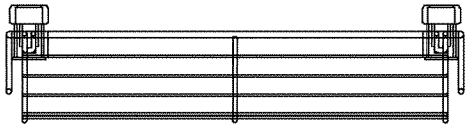
Figure 58B:
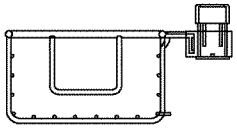
Figure 58C:
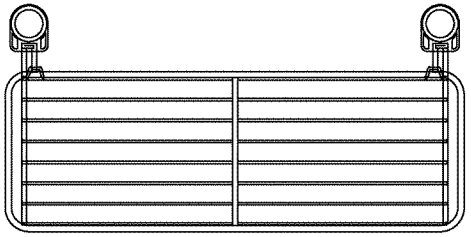
Figure 58A:
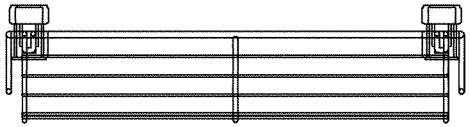
Figure 58D:
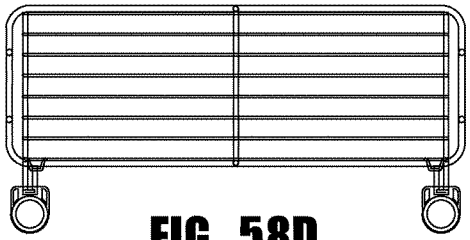
Figure 58H:
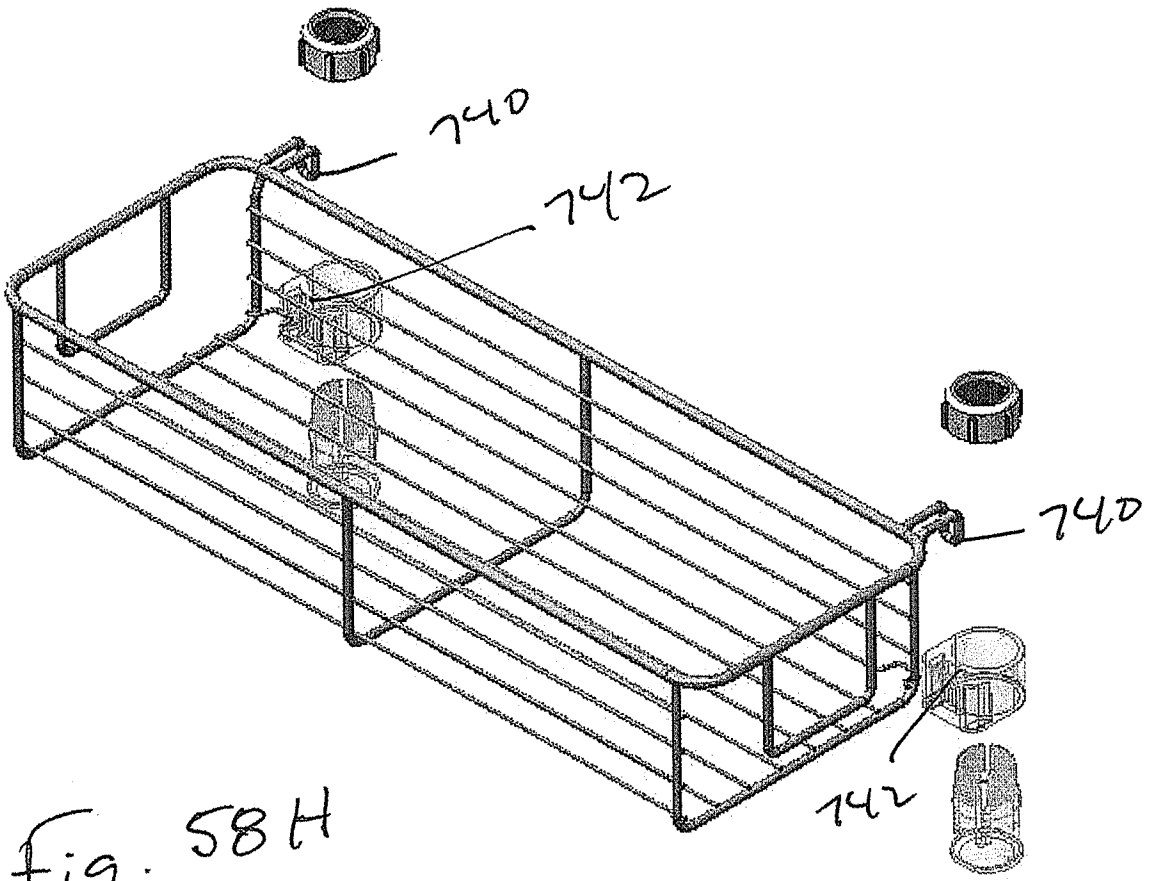
Figure 58I:
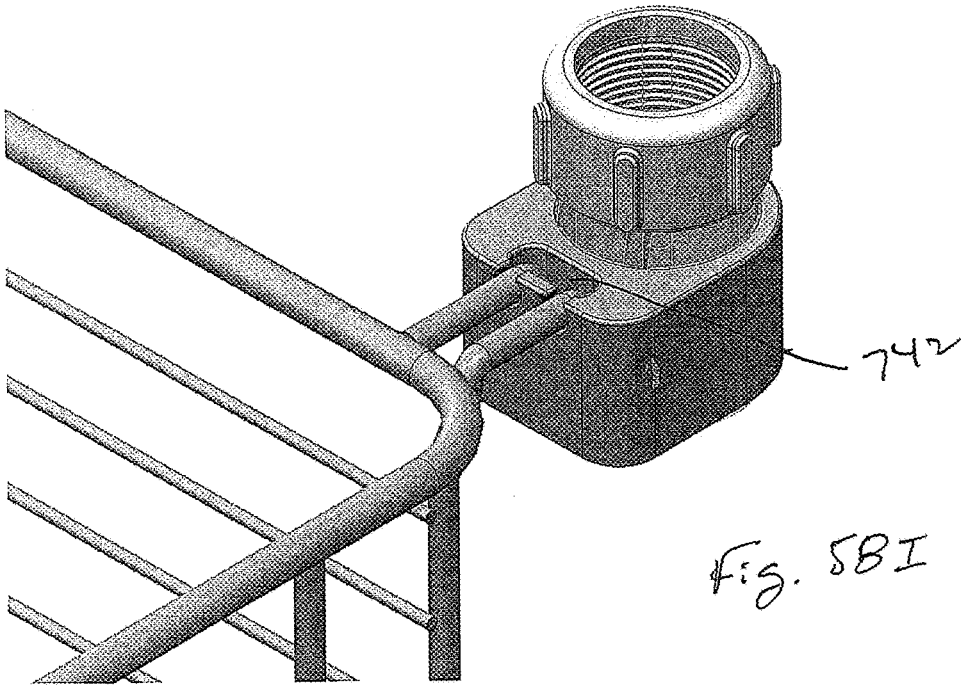
Figure 58J:
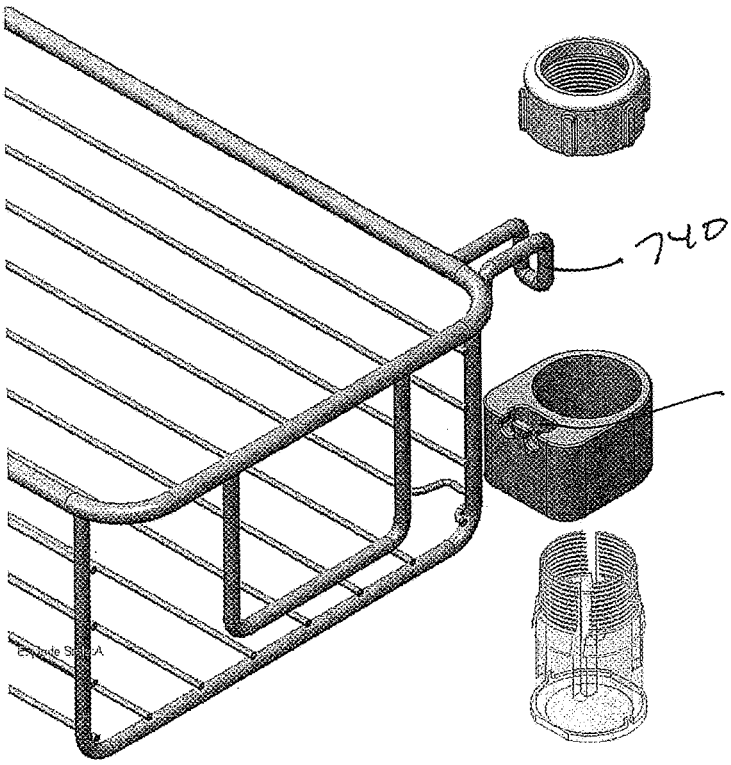
Figure 58K:
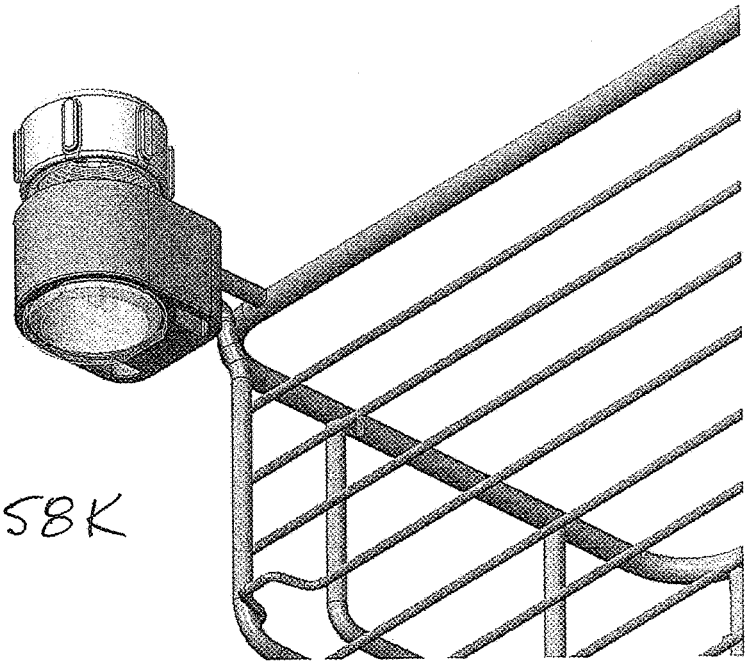
Figure 58L:
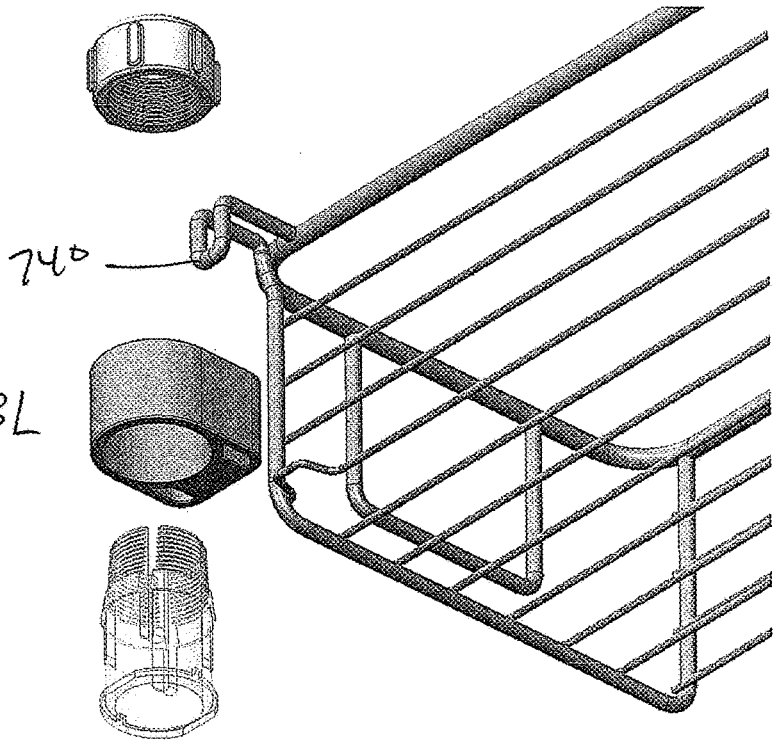
Figure 59F:
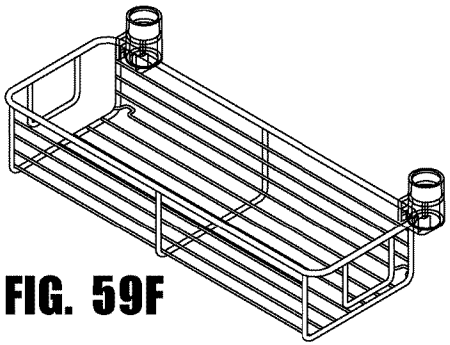
Figure 59E:
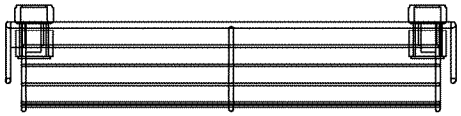
Figure 59B:
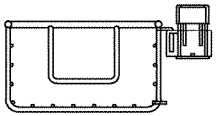
Figure 59C:
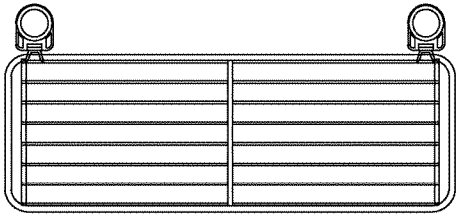
Figure 59A:
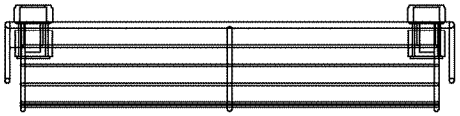
Figure 59D:
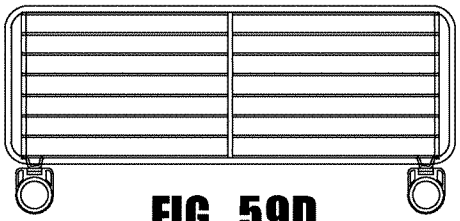
Figure 59G:
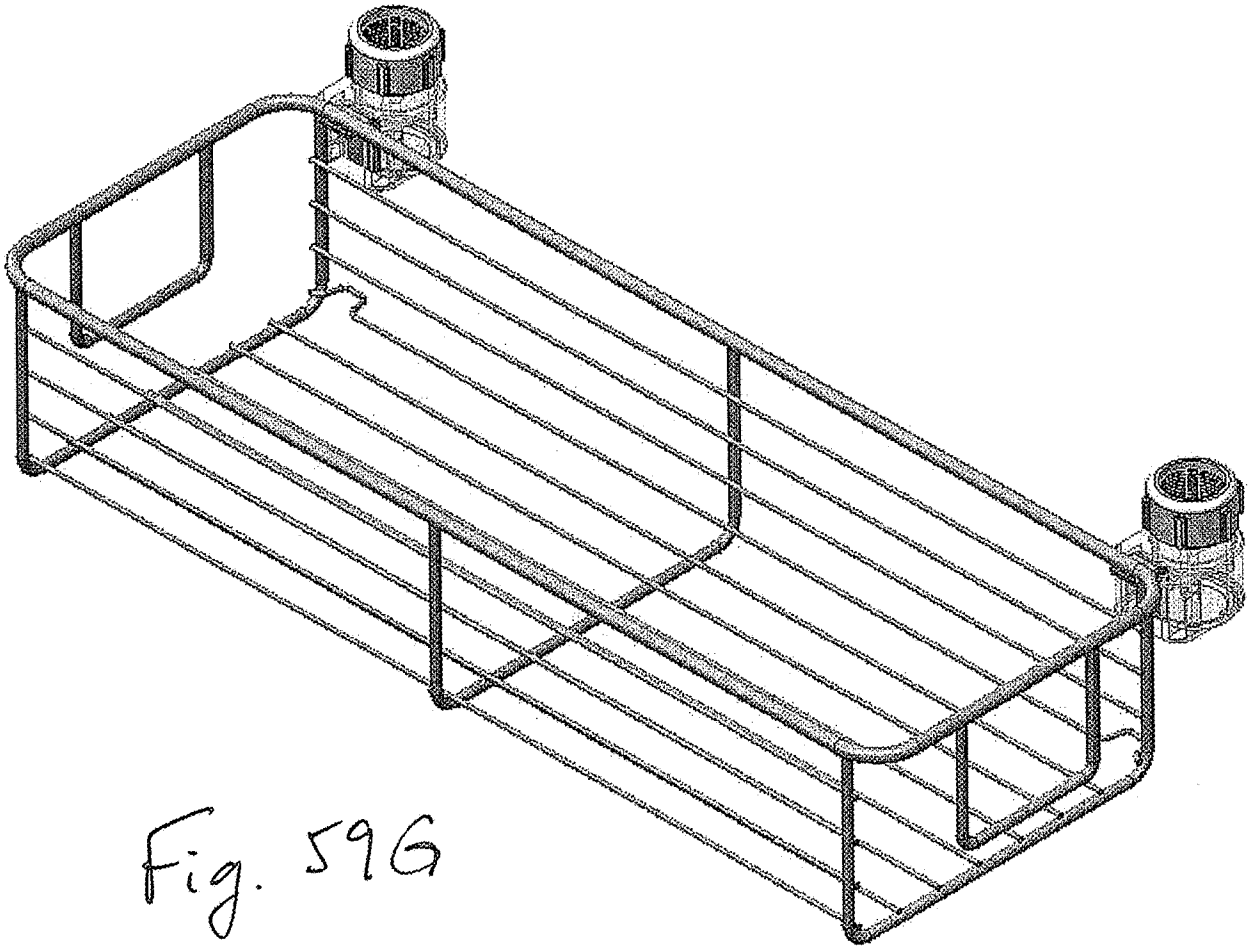
Figure 59H:
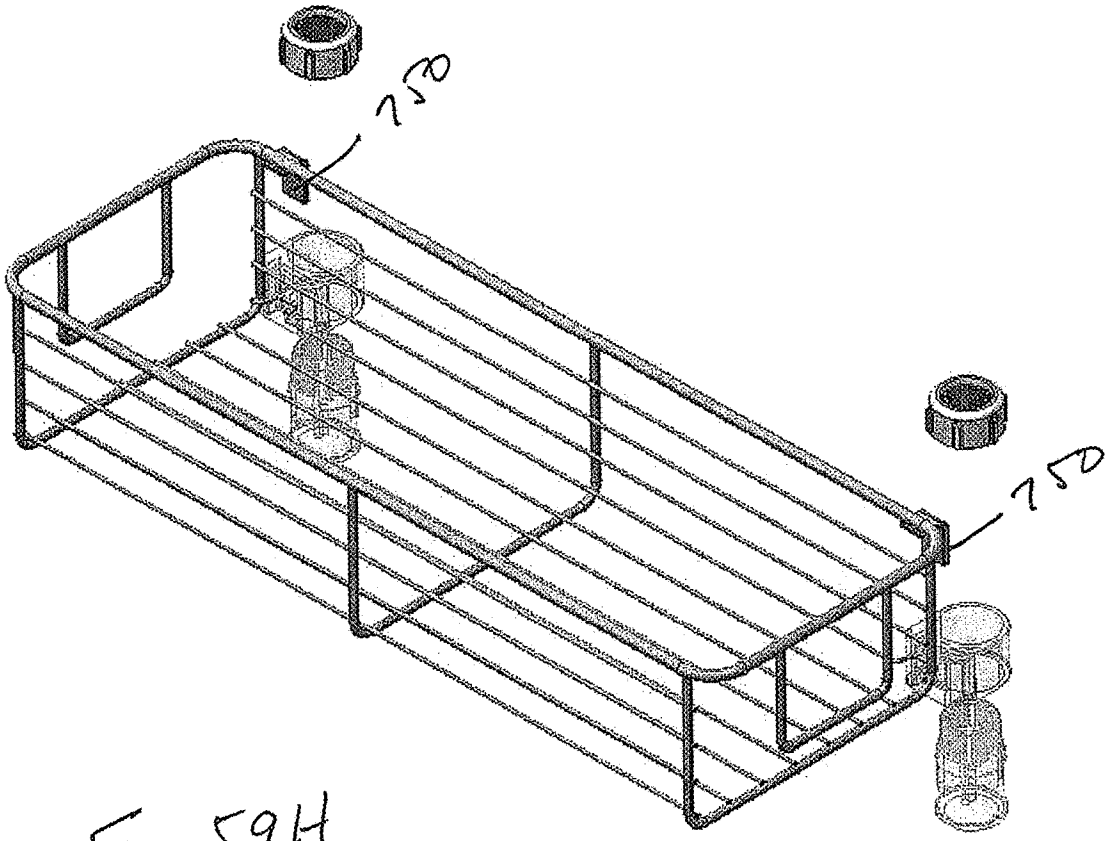
Figure 59I:
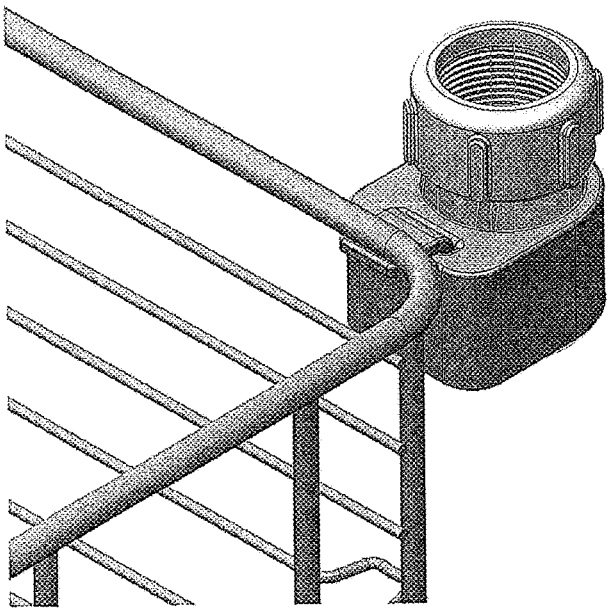
Figure 59J:
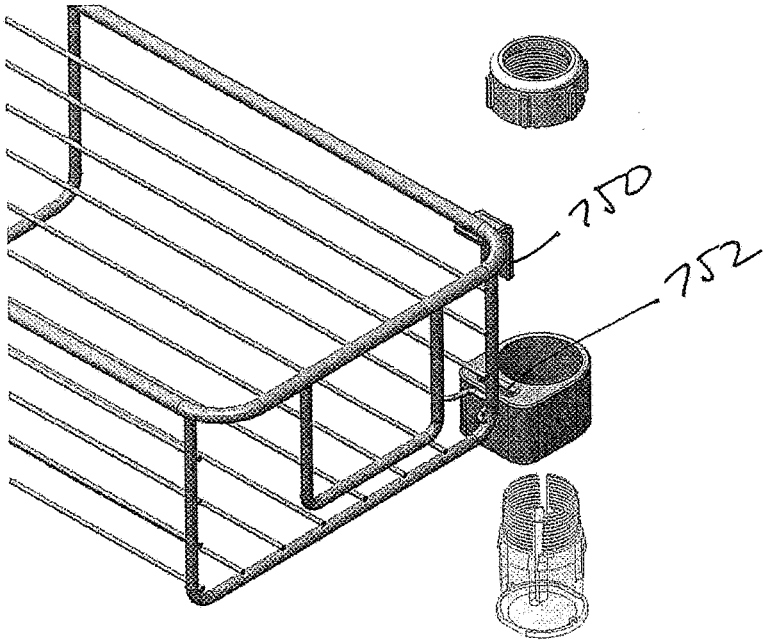
Figure 59K:
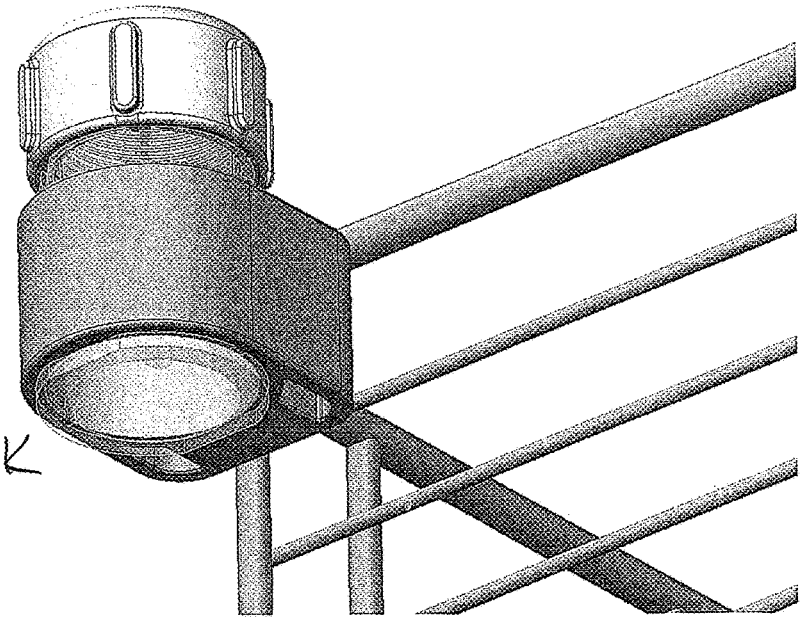
Figure 59L:
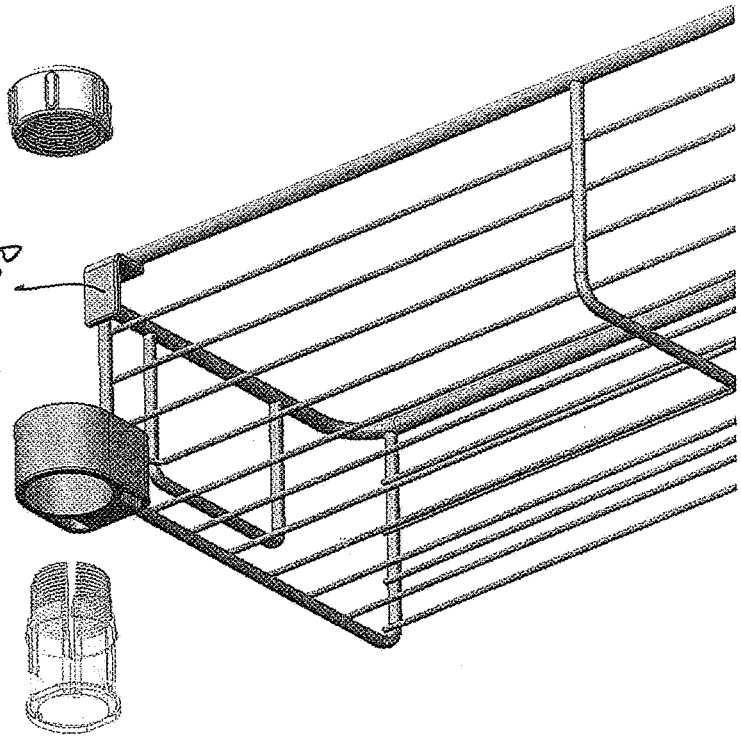
Figure 60F:
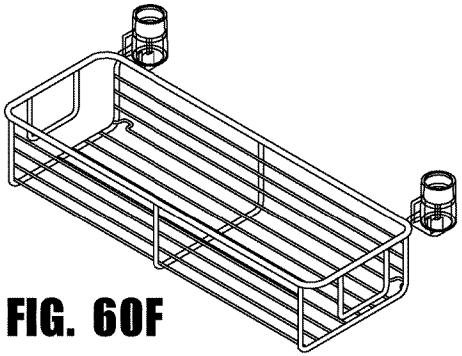
Figure 60E:
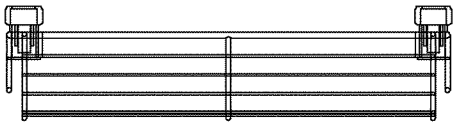
Figure 60B:
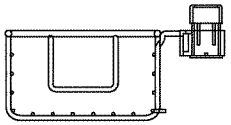
Figure 60C:
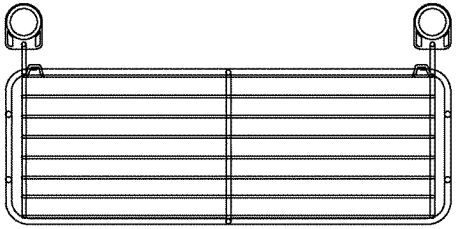
Figure 60A:
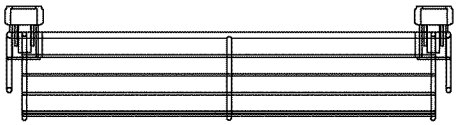
Figure 60D:
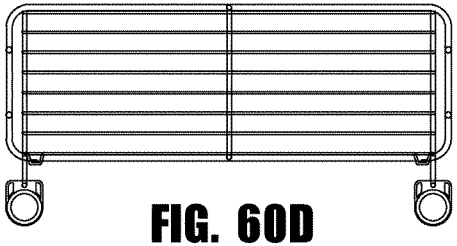
Figure 609:
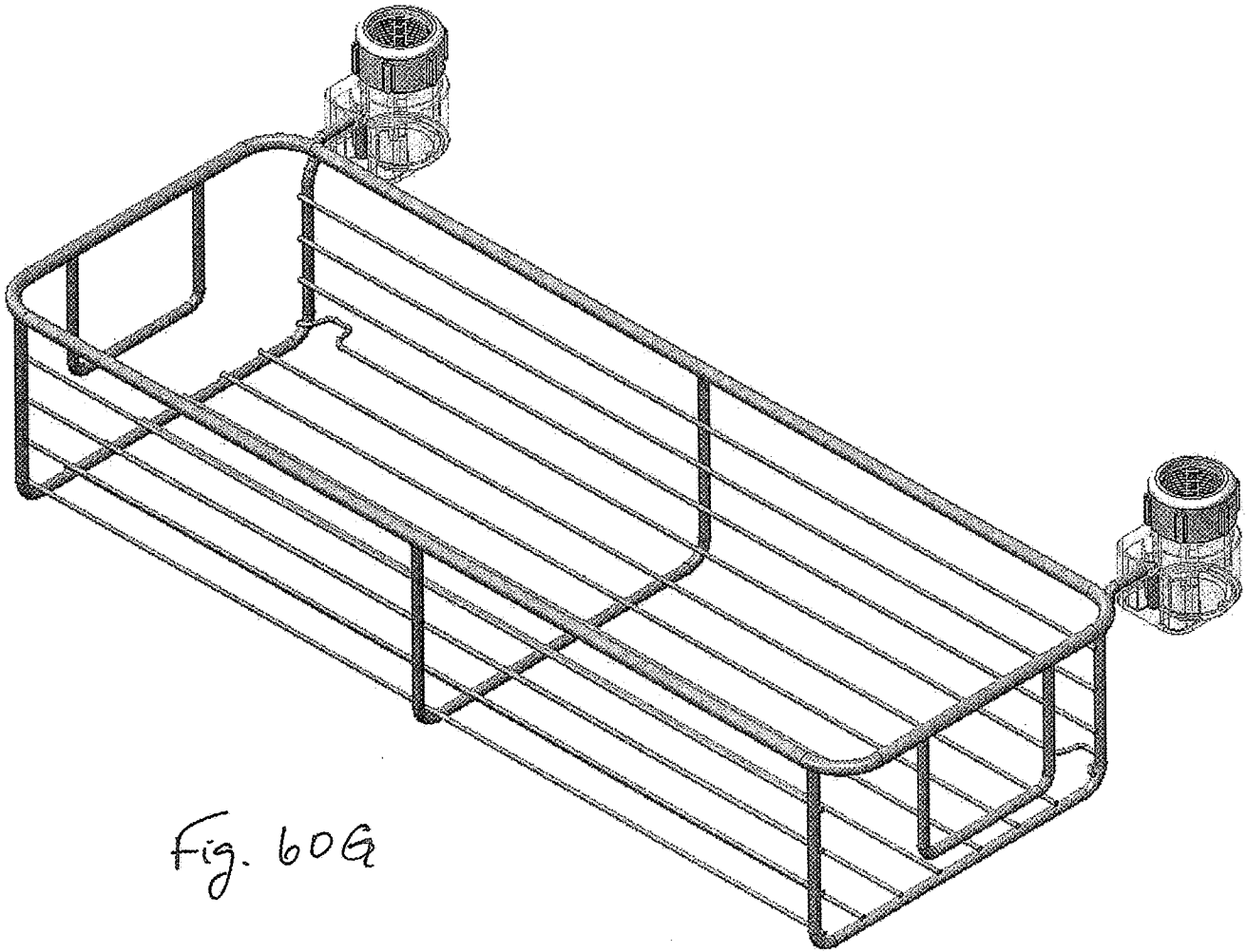
Figure 69H:
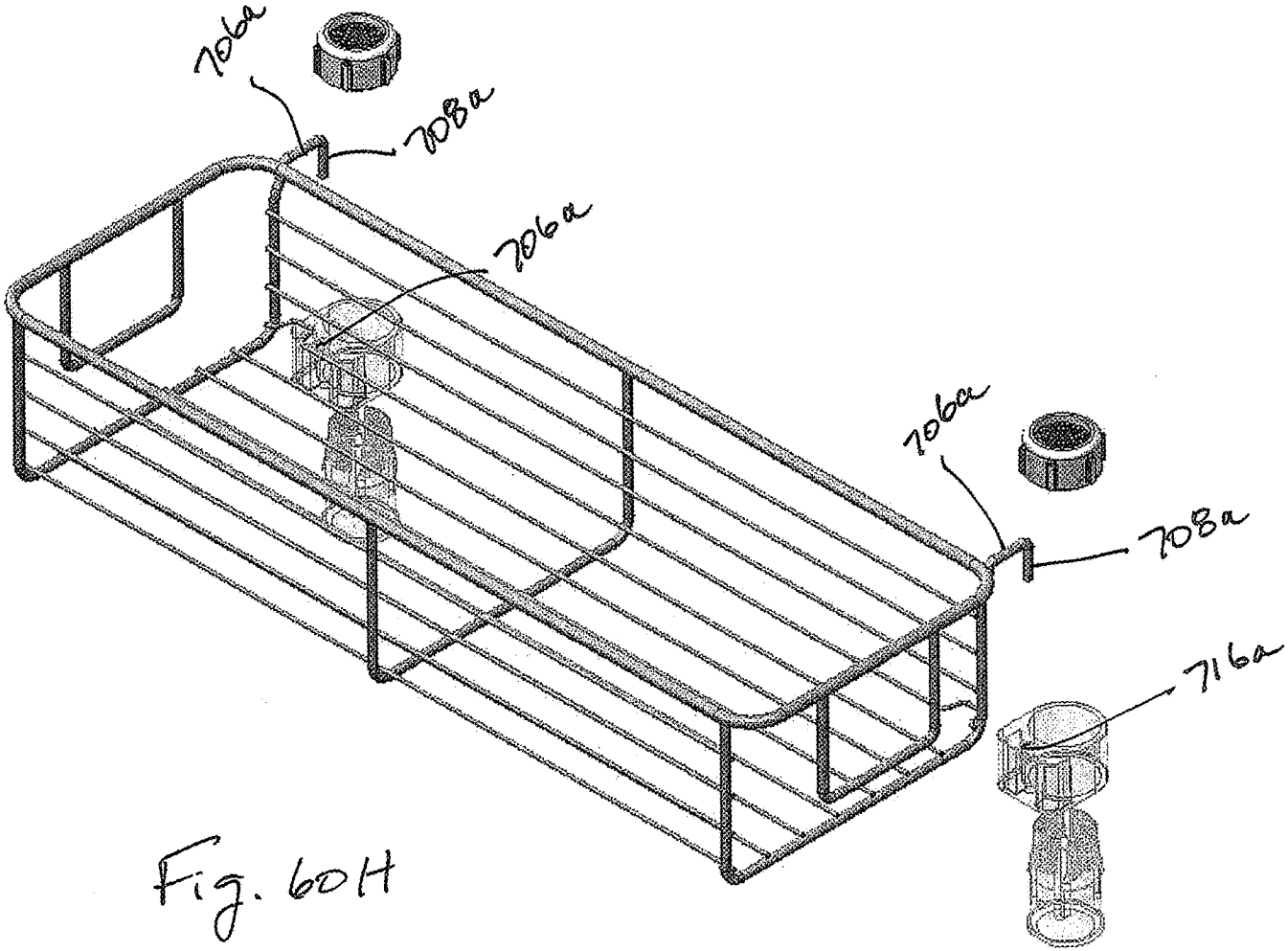
FIGS. 67A-69E show exemplary embodiments of structures with which accessories can be press-fit to affix the accessories to a collar to use with the various systems and methods herein.
Figure 60I:
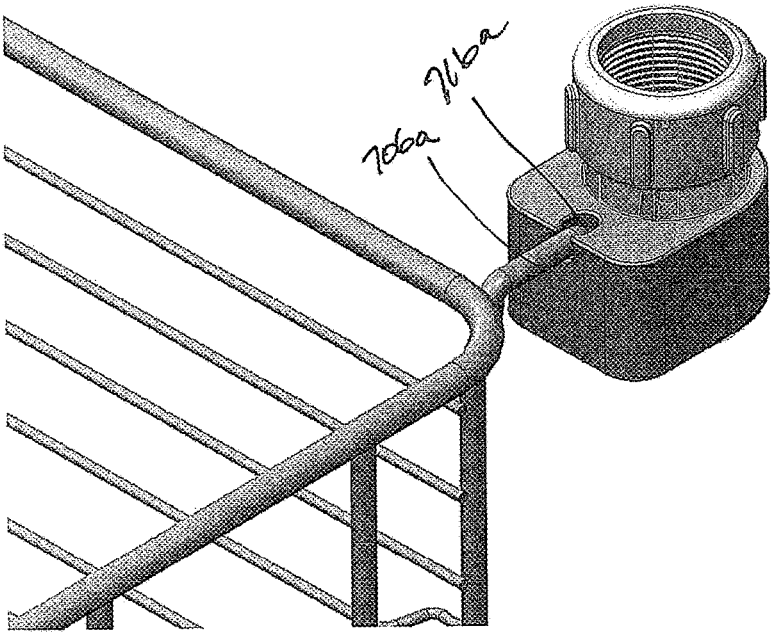
Figure 60J:
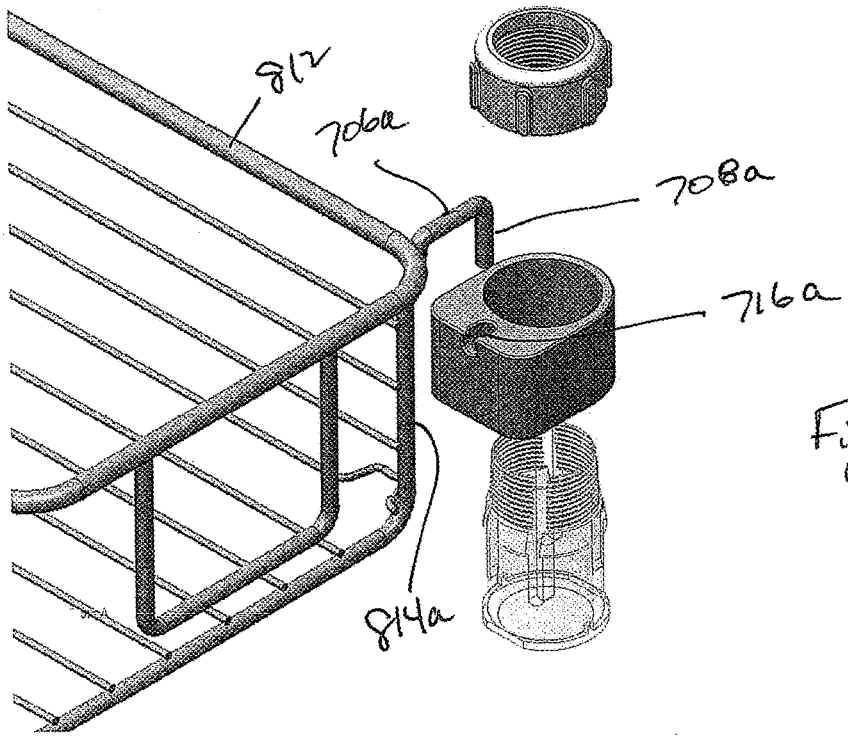
Figure 60K:
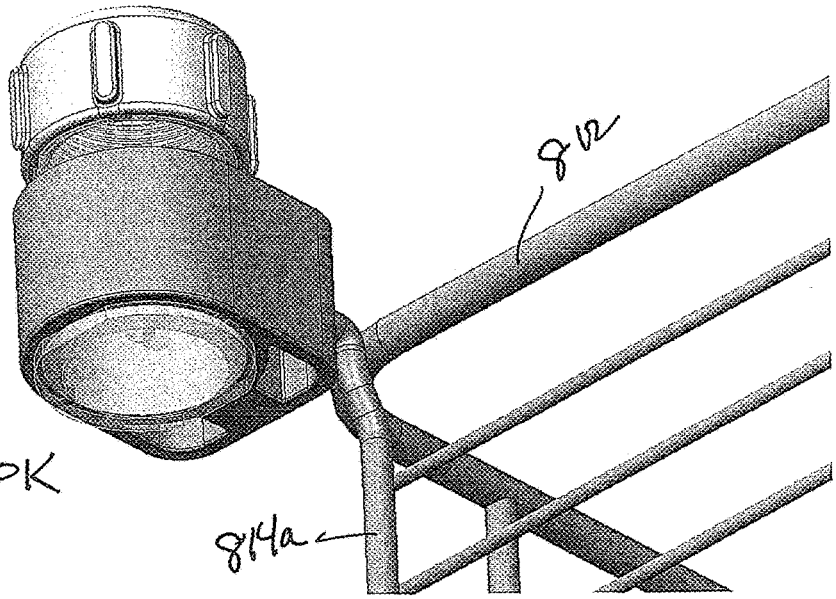
Figure 60L:
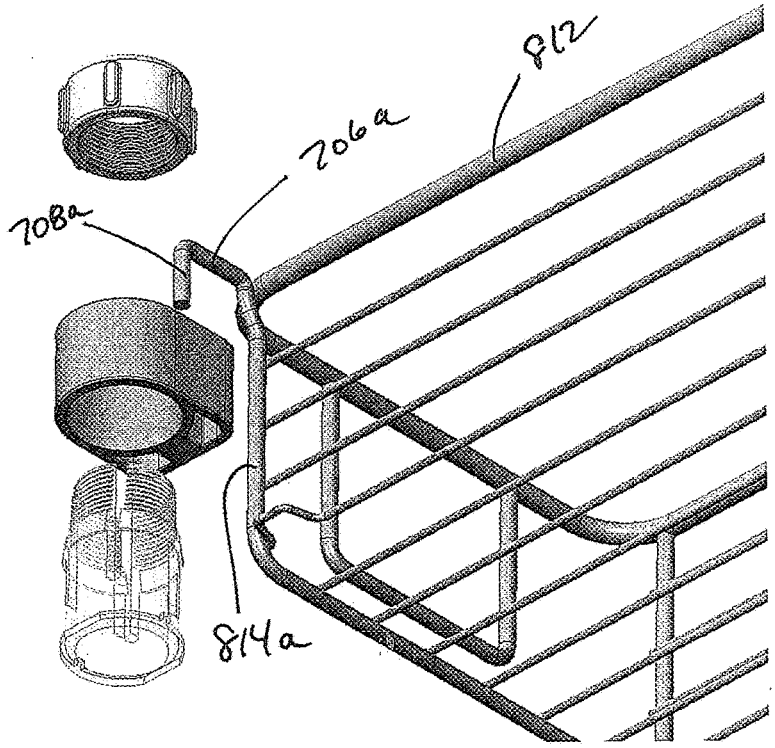
Figure 61:
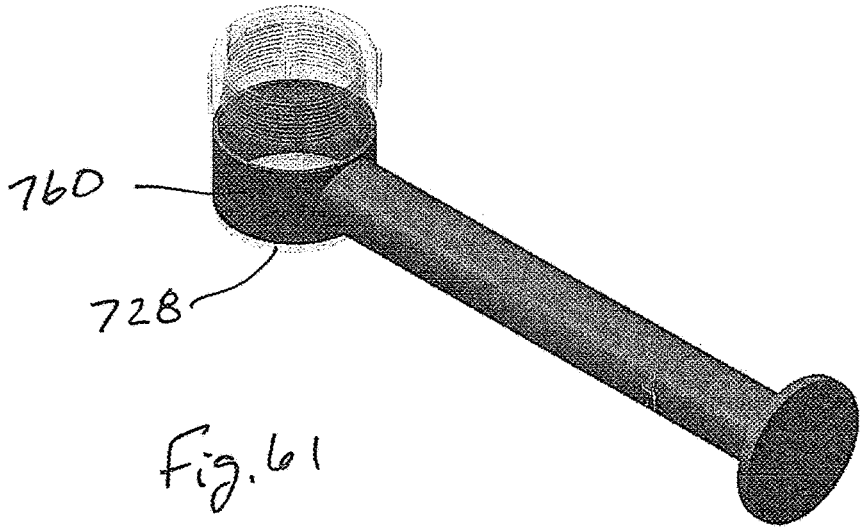
Figure 62:
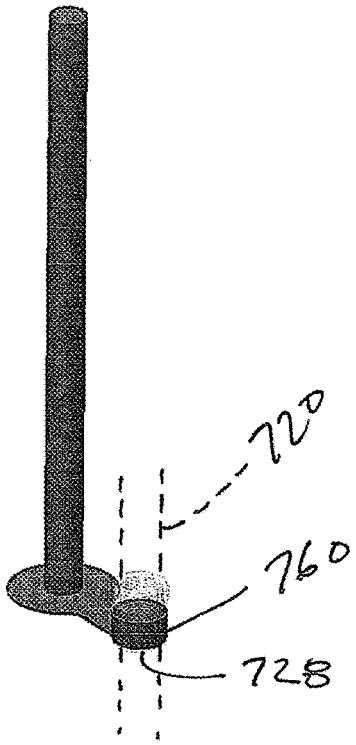
Figure 65A:
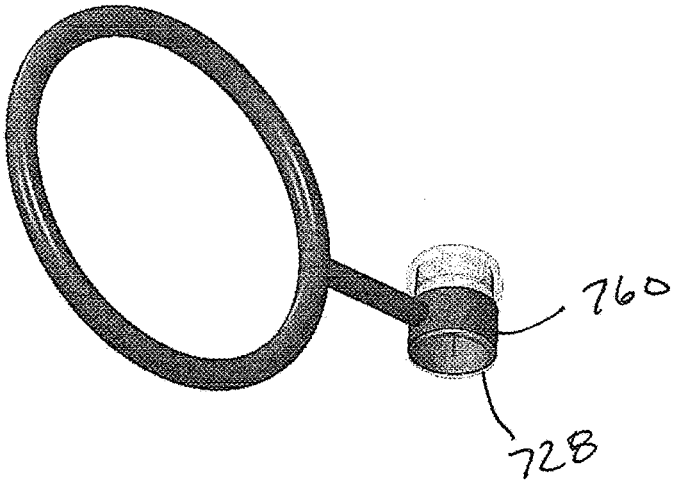
Figure 65B:
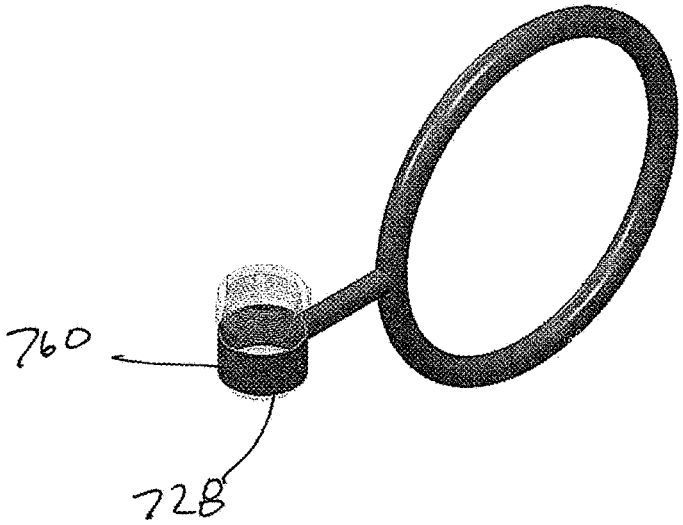

Referring now to FIG. 43, an exemplary adjustable accessory 650 with an exemplary adapter 660 is shown. This particular adjustable accessory includes: an accessory 654 (here a series of fixed, adjacent rings) affixed to at least one support 656 (here, two supports 656*a* and 656*b*) that supports the accessory 654; at least one adapter 660 having a sleeve opening extending therethrough that accepts and is supported by a compression sleeve 664 in a vertical orientation when in use, the adapter 660 also having at least one support opening 666 (here two support openings 666*a* and 666*b*) that removably accepts a portion of the at least one support 656; a compression sleeve 664 for insertion in the sleeve opening of the adapter 660 and having a threaded end; and a compression collar 668 for threadably coupling to the compression sleeve 664 to secure the adapter 660 to the frame 670; and wherein the at least one support 656 and the at least one adapter 660 cooperate to support the accessory 650 and retain the accessory 650 in an in-use orientation (here, the rings extend out radially from the longitudinal axis 672 of the frame 670) when the compression sleeve 664 is in a vertical orientation; and wherein the at least one support 666 can be removed from the at least one adapter 660 by hand without tools permitting the accessory 650 to be removed from the at least one adapter 660 by hand without tools.

Referring now to FIGS. 44A-44K, an exemplary adjustable accessory 700 with an exemplary adapter 710 is shown. This particular adjustable accessory includes: an accessory 704 affixed to at least one support 706 (here, two supports 706*a* and 706*b*) that supports the accessory 704; at least one adapter 710 having a sleeve opening 712 extending therethrough that accepts and is supported by a compression sleeve 714 in a vertical orientation when in use, the adapter 710 also having at least one support opening 716 (here two support openings 716*a* and 716*b*) that removably accepts a portion 708 (here two support openings 708*a* and 708*b*) of the at least one support 706; a compression sleeve 714 for insertion in the sleeve opening 712 of the adapter 710 and having a threaded end 715; and a compression collar 718 for threadably coupling to the compression sleeve 714 to secure the adapter 710 to the frame 720 (FIG. 44A); and wherein the at least one support 706 and the at least one adapter 710 cooperate to support the accessory 700 and retain the accessory 700 in an in-use orientation (here, the rings extend out radially from the longitudinal axis 722 of the frame 720) when the compression sleeve 714 is in a vertical orientation; and wherein the at least one support 716 can be removed from the at least one adapter 710 by hand without tools permitting the accessory 700 to be removed from the at least one adapter 710 by hand without tools. In the exemplary embodiment shown, the bottom 726 of the adapter 710 abuts a flange 728 of the compression sleeve 714 to prevent the compression sleeve from passing all the way through the opening 712. In the exemplary embodiment shown, the accessory 704 comprises a plurality of hooks 730 in the same orientation affixed to and carried by a linear carrier 732 having the support 706 at a proximal end, and wherein bent portions 708*a*, 708*b* of the linear carrier 732 forms the portion of the support 706 accepted by the support openings 716*a*, 716*b* of the adapter 710. In general, the opening 716 is sized and has a shape to removably accommodate the portion 708 of support 706 to support the accessory in the in-use orientation. The support opening 716 can be sized to loosely or tightly hold portion 708 of support 706, depending on the particular application. In the alternative, in exemplary embodiments, the opening 716 can be configured to make it difficult or impossible to remove the support 706 from the adapter 710 by hand without tools.

To use the adapter 710 with the accessory 704, a user inserts the compression sleeve 714 into the sleeve opening 712 of adapter 710 so that the flange 728 abuts the bottom 726 of adapter 710, inserts the frame portion 720 into the compression sleeve 714 (in an orientation with the support opening 716 opening upwards), inserts the compression collar over the frame portion 720 proximate the threaded end 715 of compression sleeve 714, positions the adapter 710 on the frame 720 in a desired location, and tightens the compression collar 718 down onto the threaded portion of the compression sleeve 714 to affix the adapter 710 to the frame 720. Then the user orients the accessory 704 approximately in its in-use orientation, positions the portion 708 of support 706 proximate the support opening 716 and inserts the portion 708 of support 706 into the support opening 716 to secure the support 706 (and the accessory 700) to the adapter 710. No tools are used to secure the support 706 (and the accessory 700) to the adapter by hand. To reposition (e.g., re-sequence) the accessory, a user simply lifts the portion 708 of support 706 out of the support opening 716, repositions the accessory 704 near a different adapter mounted to the frame as discussed immediately above, orients the accessory 704 approximately in its in-use orientation, positions the support 706 proximate the support opening 716 of the other adapter and inserts the portion 708 of support 706 into the support opening 716 to secure the support 706 (and the accessory 700) to the other adapter. No tools are used to remove the support 706 and re-secure the support 706 (and the accessory 700) to another adapter by hand. Additionally, because this exemplary embodiment uses a compression sleeve 714 and compression collar, the adapter can easily be moved up or down on the frame in accordance with the instructions discussed above (e.g., loosen the compression collar 718, move the adapter 710 and compression sleeve 714 up or down, and re-tighten the compression collar 718 to re-secure the adapter 710 to the portion of the frame). A kit with written instructions having the foregoing attachment instructions and/or the foregoing repositioning instructions (e.g., for re-sequencing and/or for moving up or down vertically) printed thereon can be included with an adapter 710 and an adapter-capable accessory 704, or a plurality of such adapters 710 and a plurality of such adapter-capable accessories 704. Such kits can also optionally include a frame or a plurality of frame members to be assembled into a frame with corresponding frame assembly instructions.

FIGS. 45A-45K show another exemplary embodiment that is identical to the exemplary embodiment of FIGS. 44A-44K, except the portion 708 of support 706 is a single piece 740 formed by a plurality of bends of support 706. Consequently, the support opening 742 of the adapter in FIGS. 45A-45K is different to removably accommodate the piece 740 forming the portion 708 of support 706 to support the accessory in the in-use orientation. Except for this difference, all of the other text about structure, kits, methods, etc. above with respect to FIGS. 44A-44K also apply to the embodiment of FIGS. 45A-45K.

FIGS. 46A-46K show another exemplary embodiment that is identical to the exemplary embodiment of FIGS. 44A-44K, except the portion 708 of support 706 is a single piece 750 affixed to (e.g., welded to, adhered to, integrally molded with, or otherwise affixed to) support 706. Piece 750 in this embodiment is formed by a piece of material (e.g., steel) bent to form a right angle piece with two portions; one portion is affixed to the support 706 and the other portion is inserted into the support opening. Consequently, the support opening 752 of the adapter in FIGS. 46A-46K is different (here a narrow slot) to removably accommodate the piece 750 forming the portion 708 of support 706 to support the accessory in the in-use orientation. Except for this difference, all of the other text about structure, kits, methods, etc. above with respect to FIGS. 44A-44K also apply to the embodiment of FIGS. 46A-46K.

FIGS. 47-55, 55A-55G, 56A-56G, and 57 show various views of exemplary accessories using the adapter 710 that permits the accessories to be removed from and attached to a frame without disassembling the frame and without tools, permitting the accessories to be re-sequenced on a frame, without disassembling the frame and without tools. The exemplary accessories in FIGS. 47-55, 55A-55G, 56A-56G, and 57 are identical to the exemplary embodiment of FIGS. 44A-44K, except the accessory 704 is different. Except for this difference, all of the other text about structure, kits, methods, etc. above with respect to FIGS. 44A-44K also apply to the embodiment of FIGS. 47-55, 55A-55G, 56A-56G, and 57.

A kit with written instructions having the foregoing attachment instructions and/or the foregoing repositioning instructions (e.g., for re-sequencing) printed thereon can be included with an adapter (any of FIGS. 44, 45, 46) and an adapter-capable accessory (corresponding one of FIGS. 44, 45, 46, 47-55, 55A-55G, 56A-56G, and/or 57, or other adapter-capable accessories), or a plurality of such adapters and a plurality of such adapter-capable accessories (corresponding ones of FIGS. 44, 45, 46, 47-55, 55A-55G, 56A-56G, and/or 57, or other adapter-capable accessories). Such kits can also include a frame or a plurality of members to be assembled into a frame with corresponding frame assembly instructions.

FIGS. 58A-58L, 59A-59L, and 60A-60L show various views of baskets and shelves using a pair of adapters that permit the baskets and shelves to be removed from and attached to a frame without disassembling the frame and without tools, permitting the baskets and shelves to be re-sequenced on a frame, without disassembling the frame and without tools.

Referring now to FIGS. 58A-58L, an exemplary removable basket 800 is shown. Exemplary removable basket 800 includes a basket 810 and two adapters identical to the adapters in FIGS. 45A-45K. Like basket 182 and basket 286, basket 810 is formed from at least one main support wire 812 and a plurality of secondary support wires 814 extending from the main support wire 812. A plurality of basket wires 816 extend between each wire of the secondary support wires 814 and perhaps also extend between wires of the secondary support wires 814 and the main support wire 812. In the specific embodiment shown, the main support wire 812 has a support 706 welded or otherwise affixed thereto. The support 706 extends essentially perpendicular to the rear straight portion of the main support wire. Also in this example, a stop is formed at each lateral end of the basket 810 by a wire 818 extending between one part of the main support wire 812 and another part of the main support wire 812. All these wires can be welded together or otherwise affixed. The main support wire 812 and its support 706 can be made from 0.08" to 0.25" steel wire, the secondary support wires 814 can be made from 0.08" to 0.25" steel wire, and the basket wires 816 and stops 818 can be made from 0.08" to 0.25" steel wire. The adapter, support, portion of the support, and piece in FIGS. 58A-58L are identical to the exemplary embodiment of FIGS. 45A-45K. Except for a basket being supported instead of an accessory, and the use of two supports 706 and two adapters instead of one of each (and two frame portions, of course), all of the other text about structure, kits, methods, etc. above with respect to FIGS. 45A-45K also apply to the embodiment of FIGS. 58A-58L.

Referring now to FIGS. 59A-59L, another exemplary removable basket is shown. This exemplary removable basket includes a basket that is the same as basket 810 in FIGS. 58A-58L and also includes two adapters identical to the adapters in FIGS. 46A-46K. The adapter and support pieces 750 in FIGS. 59A-59L are identical to the adapter and support piece 750 in the exemplary embodiment of FIGS. 46A-46K. Two support pieces 750 for insertion into respective adapters are welded or otherwise affixed to the main support wire of the basket. Except for a basket being supported instead of an accessory, and the use of two support pieces 750 and two adapters (and two frame portions, of course) instead of one of each, all of the other text about structure, kits, methods, etc. above with respect to FIGS. 46A-46K also apply to the embodiment of FIGS. 59A-59L.

Referring now to FIGS. 60A-60L, another exemplary removable basket is shown. This exemplary removable basket includes a basket that is the same as basket 810 in FIGS. 58A-58L and also includes two adapters identical to the adapters in FIGS. 45A-45K, except there is only support 706*a*, one support opening 716*a*, and one portion 708*a* for each adapter. As shown best in FIG. 60L, support 706*a* and portion 708*a* of support 706*a* can be an extension of secondary support wire 814*a*, i.e., formed by various bends in an extension of secondary support wire 814*a*, which is welded or otherwise affixed to main support wire 812. In the alternative, two supports 706*a* can be welded or otherwise affixed to the main support wire or secondary support wire of the basket. Except for a basket being supported instead of an accessory, and the use of two individual supports 706*a* and two adapters having a single support opening 716*a* (and two frame portions, of course) instead of one of each, all of the other text about structure, kits, methods, etc. above with respect to FIGS. 45A-45K also apply to the embodiment of FIGS. 60A-60L.

A kit with written instructions having the foregoing attachment instructions and/or the foregoing repositioning instructions (e.g., for re-sequencing) printed thereon can be included with an adapter (any of FIGS. 44, 45, 46, 60A-60L) and an adapter-capable shelf or basket (corresponding one of FIGS. 58A-58L, 59A-59L, and 60A-60L, or other adapter-capable shelves or baskets), or a plurality of such adapters and a plurality of such adapter-capable shelves or baskets (corresponding ones of FIGS. 58A-58L, 59A-59L, and/or 60A-60L, or other adapter-capable shelves or baskets). Such kits can also include a frame or a plurality of members to be assembled into a frame with corresponding frame assembly instructions.

A kit with written instructions having the foregoing attachment instructions and/or the foregoing repositioning instructions (e.g., for re-sequencing) printed thereon can be included with plurality of adapters (any of FIGS. 44, 45, 46, 60A-60L) and a plurality of adapter-capable accessories (corresponding ones of FIGS. 44, 45, 46, 47-55, 55A-55G, 56A-56G, and/or 57, or other adapter-capable accessories) and a plurality of adapter-capable shelves or baskets (corresponding one of FIGS. 58A-58L, 59A-59L, and/or 60A-60L, or other adapter-capable shelves or baskets). Such kits can also include a frame or a plurality of members to be assembled into a frame with corresponding frame assembly instructions.

Figure 66A:
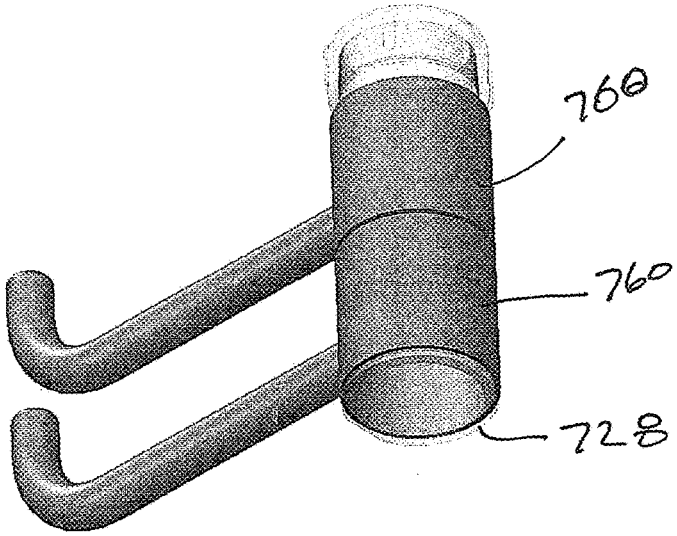
Figure 66B:
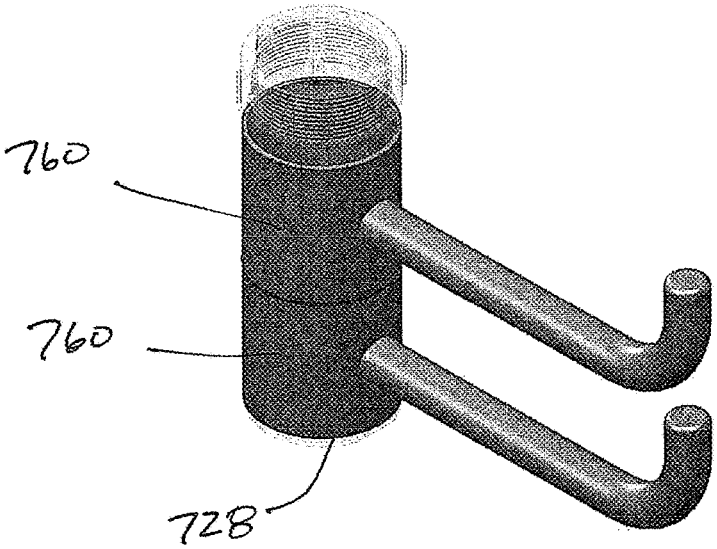
Figure 67A:
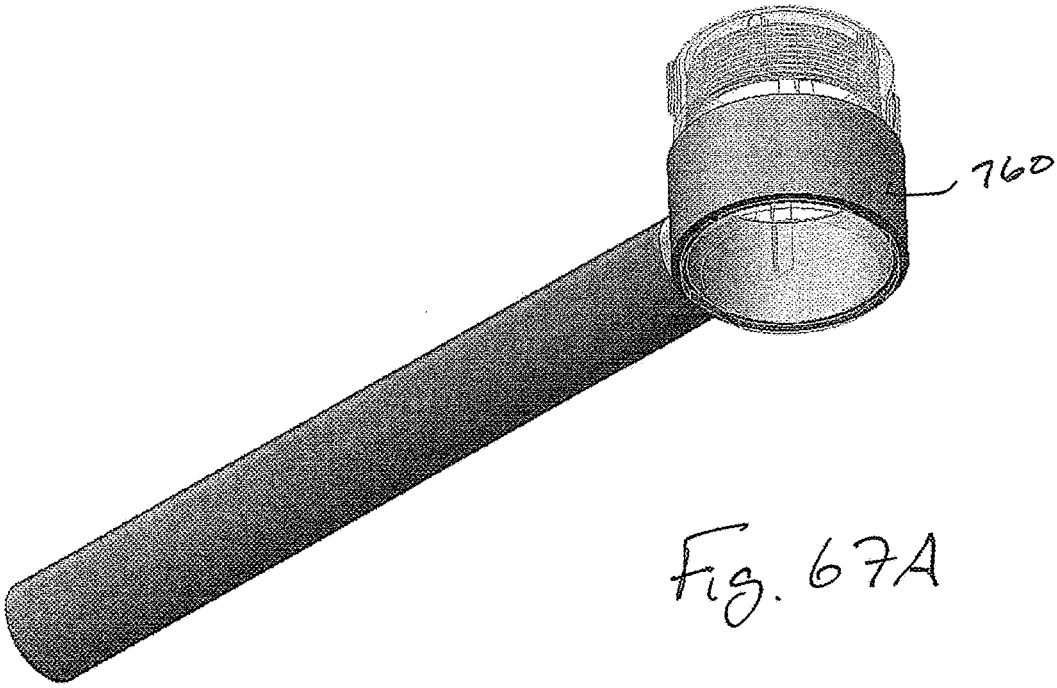
Figure 67B:
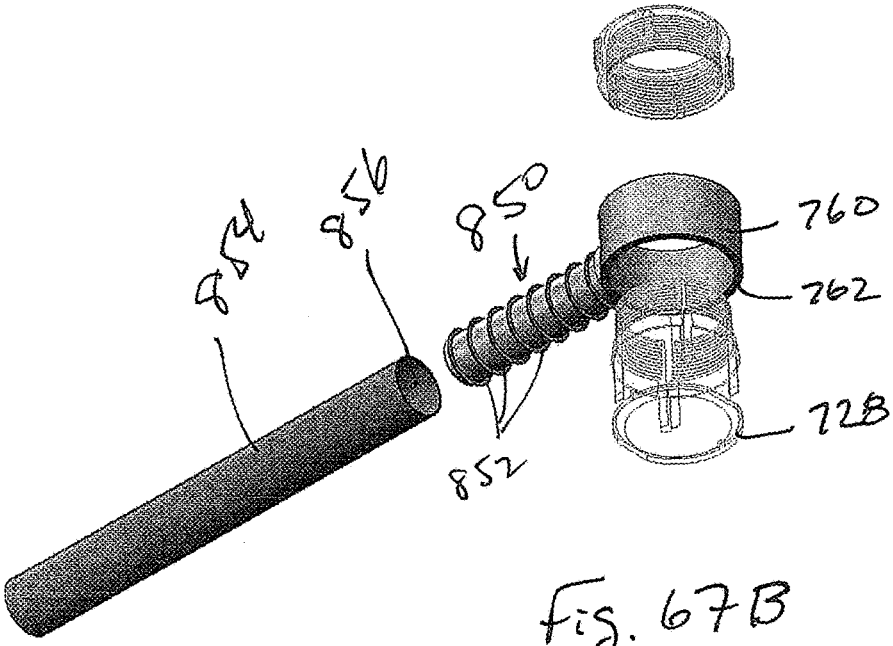
Figure 67C:
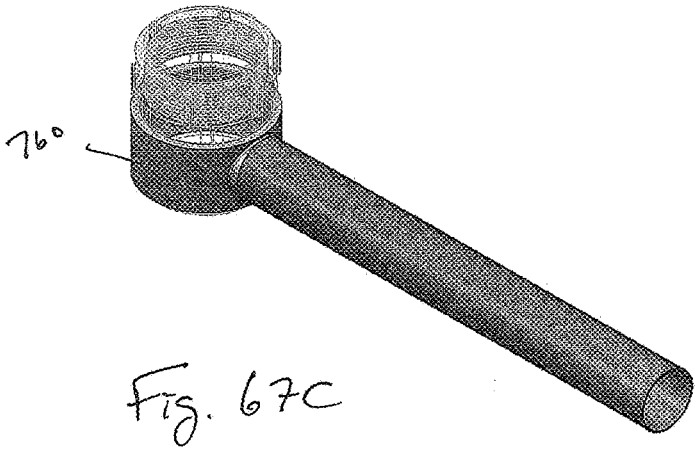
Figure 67D:
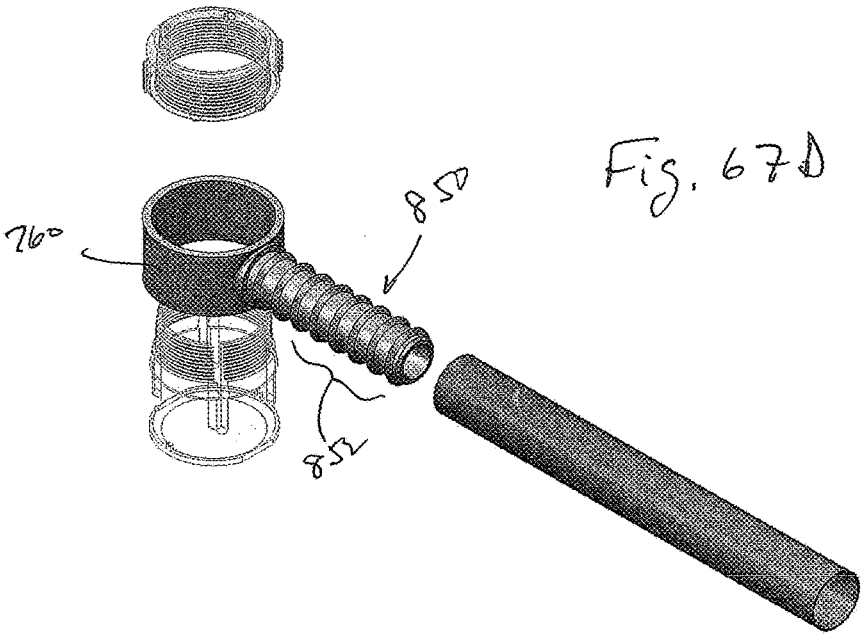
Figure 67E:
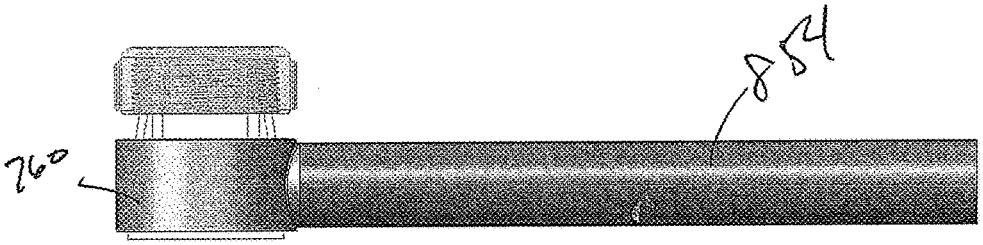
Figure 67F:
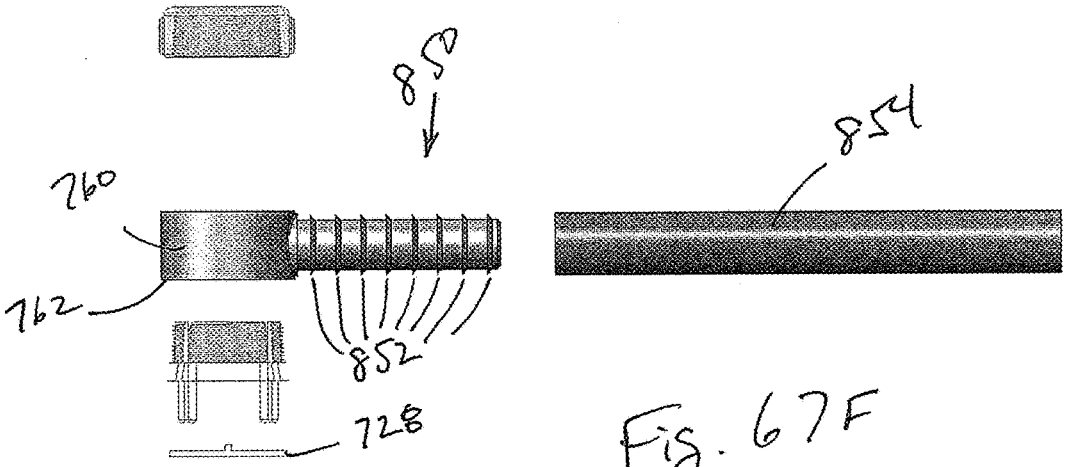

FIGS. 61-66B and 70-72 show various views of additional exemplary accessories. The exemplary accessories of FIGS. 61-66B each have a collar 760 that accepts a compression sleeve 714. In the exemplary embodiments shown, the bottom 762 of the collar 760 abuts a flange 728 of the compression sleeve 714 to prevent the compression sleeve 714 from passing all the way through the opening in the collar 760 through which the compression sleeve 714 extends. Thus, the compression sleeve 714 supports the collar 760 and items affixed to the collar 760. In exemplary embodiments, the exemplary accessories of FIGS. 61-66B can be rotated around their respective compression sleeve after being attached to the frame portion with the sleeve and collar. In the alternative, they can be modified to have a fixed rotational location with respect to their respective compression sleeve after being attached to the frame portion with the sleeve and collar. Also notice that the orientation of the accessories (e.g., the piece(s) extending radially from the collar 760) can have different orientation relative to an axis 764 of rotation of the collar 760. For example, in FIG. 71, the axes of rotation for the rings are parallel to the axis of the collar 760, while in FIGS. 70 and 72, the axes of rotation for the rings are perpendicular to the axis of rotation of the collar 760. In FIGS. 66A-66B, the compression sleeve is tall enough to accommodate two separate accessories with their respective collars 760. The bottom 762 of the lower collar 760 rests on the flange 728 of the compression sleeve and bottom 762 of the upper collar 760 rests on the top of the lower collar 760. The two accessories in this embodiment rotate freely and independently of each other.

In exemplary embodiments, the exemplary accessories of FIGS. 61-66B and 70-72 can be made as a unitary piece (i.e., the collar 760 and the piece(s) extending radially from the collar 760), e.g., molded together as an integral piece. In other exemplary embodiments, the exemplary accessories of FIGS. 61-66B and 70-72 can be made as one or more piece(s) affixed to and extending radially from the collar 760, e.g, adhered or press-fit together.

FIGS. 67A-69E show exemplary embodiments of structures with which accessories can be press-fit to affix the accessories to a collar to use with the various systems and methods herein. Each of the exemplary embodiments in FIGS. 67A-69E has a collar 760 (accepting a compression sleeve 714) and another structure molded together as an integral piece. In the exemplary embodiment of FIGS. 67A-67E, the collar 760 has an integrally molded radial extension 850, which has a plurality of circumferential barbs 852, which barbs 852 permit a user to assemble an accessory (exemplified in these figures by a tube 854) to its collar 760 simply by aligning them as shown in FIG. 67B and pushing the barbed extension 850 into an opening 856 in a portion of the accessory. As seen best in FIG. 67F, the barbs 852 are directional, permitting the accessory 854 to be inserted onto the radial extension 850, but the barbs 852 resist removing the accessory 854 from the extension 850. That said, the barbs 852 do permit the accessory to be rotated about the longitudinal axis of the radial extension 850. This method of attaching an accessory to a collar can be used for virtually any of the accessories having a tubular extension extending radially or approximately radially from the collar 760, e.g., bars (e.g., towel bars), racks (e.g., pants racks), mirrors, the rings of FIGS. 65A-65B, the hooks of FIGS. 66A-66B, etc. In this embodiment of FIGS. 67A-67E, the inside diameter of the opening 856 of the accessory 854 is about 0.585 inches. Similarly, the diameter of the radial extension 850 at the circumferential barbs 852 is about 0.605 inches and the diameter of the radial extension 850 between the circumferential barbs 852 is about 0.500 inches.

Figure 68A:
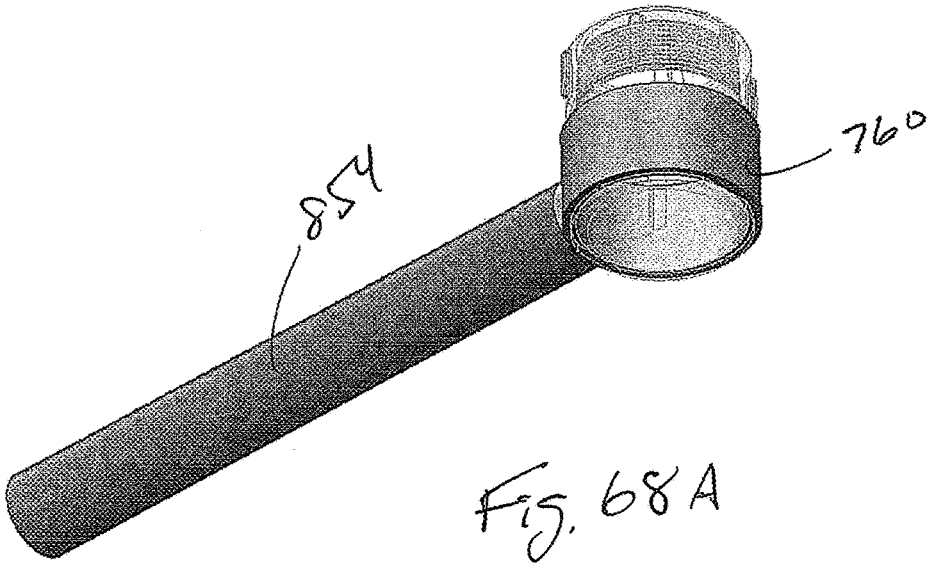
Figure 68B:
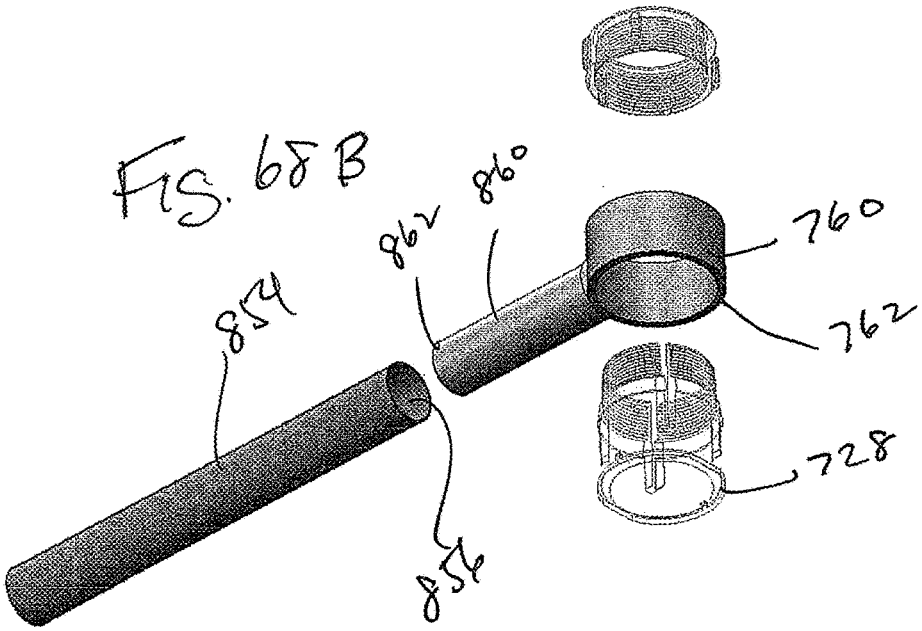
Figure 68E:
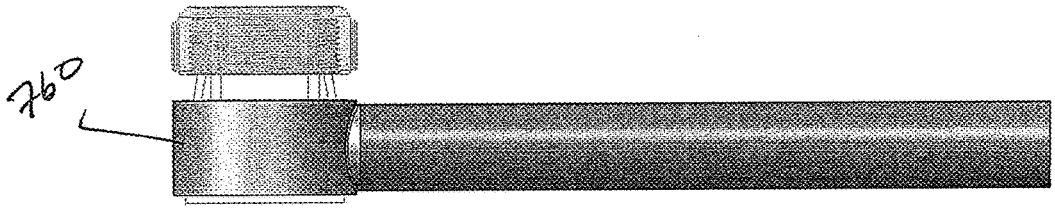
Figure 68F:
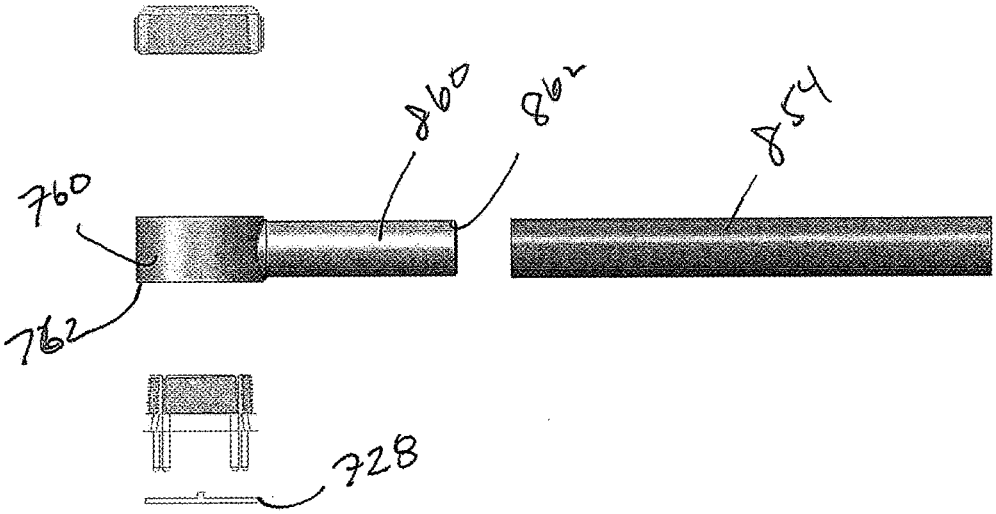

In the exemplary embodiment of FIGS. 68A-68E, the collar 760 has an integrally molded radial extension 860, which has a diameter sized to permit a user to assemble an accessory (exemplified in these figures by a tube 854) to its collar 760 simply by aligning them as shown in FIG. 68B and pushing the extension 860 (distal tip 862 first) into an opening 856 in a portion of the accessory. The extension 860 permits the accessory 854 to be inserted onto the radial extension 860 and permits the accessory to be rotated about the longitudinal axis of the radial extension 860. The diameter and/or the contour and/or the finish of the extension 860 permits the permits the accessory 854 to be inserted onto the radial extension 860, but also prevents the accessory 854 from being easily pulled off. Thus, in a sense, the accessory 854 is press-fit onto the extension 860. This method of attaching an accessory to a collar can be used for virtually any of the accessories having a tubular extension extending radially or approximately radially from the collar 760, e.g., bars (e.g., towel bars), racks (e.g., pants racks), mirrors, the rings of FIGS. 65A-65B, the hooks of FIGS. 66A-66B, etc. In this embodiment of FIGS. 68A-68E, the inside diameter of the opening 856 of the accessory 854 is about 0.585 inches. Similarly, the diameter of the radial extension 860 is about 0.575 inches.

Figure 69C:
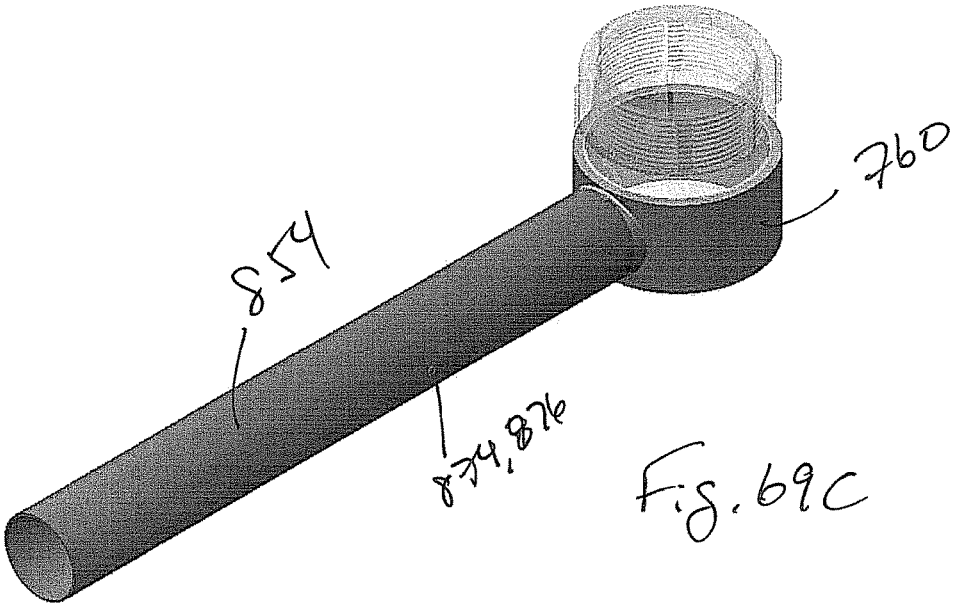
Figure 69D:
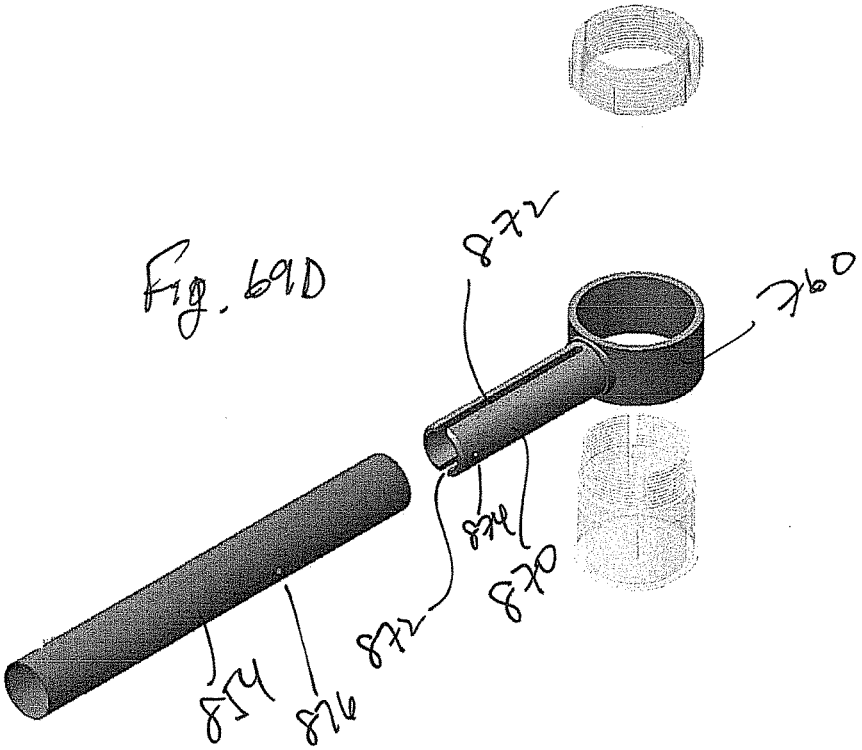
Figure 69A:
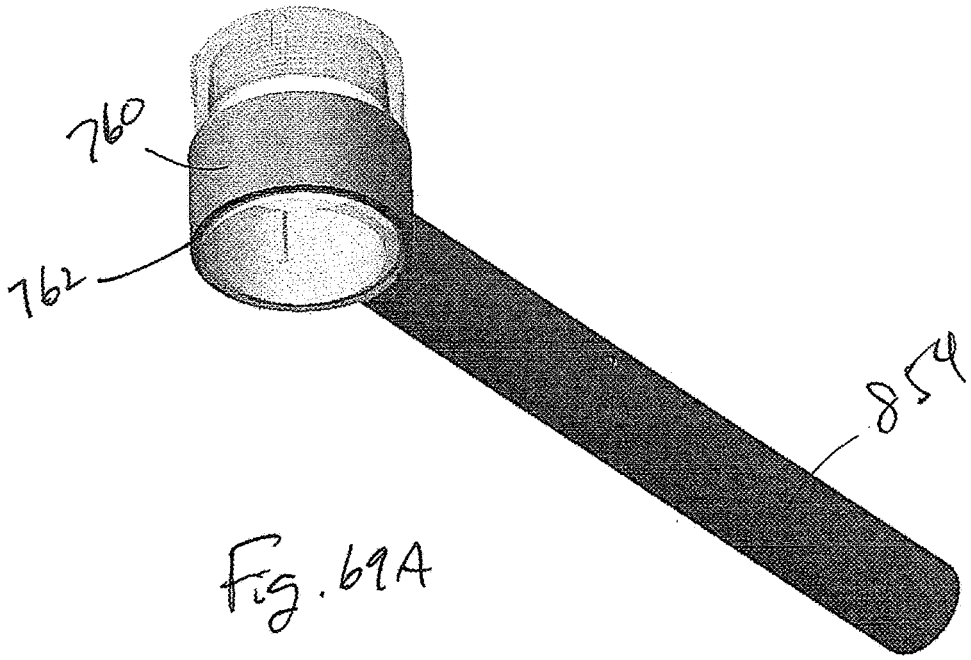
Figure 69B:
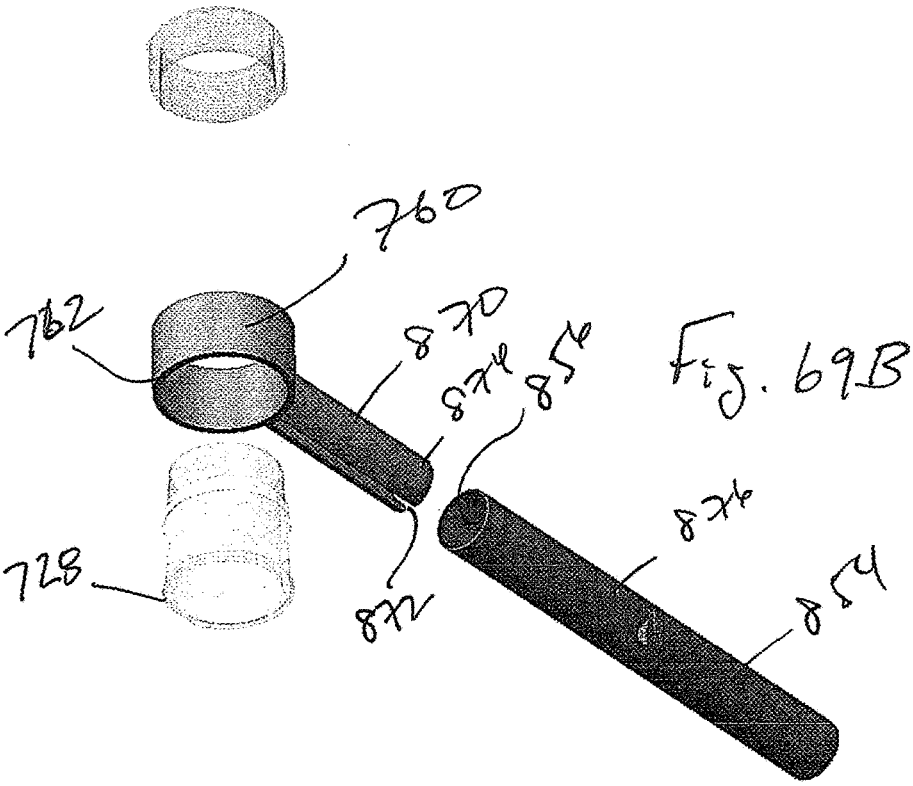
Figure 69C:
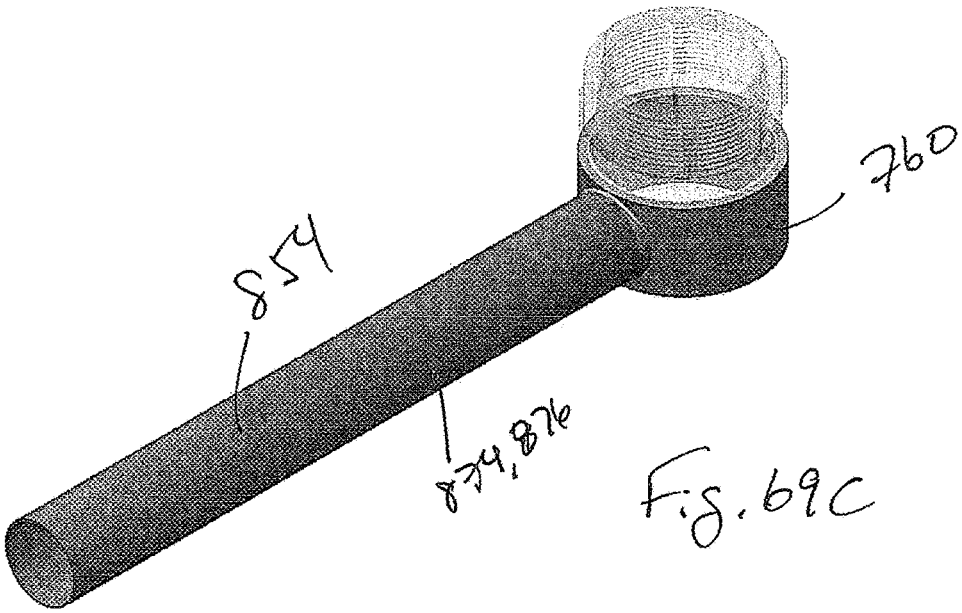
Figure 69D:
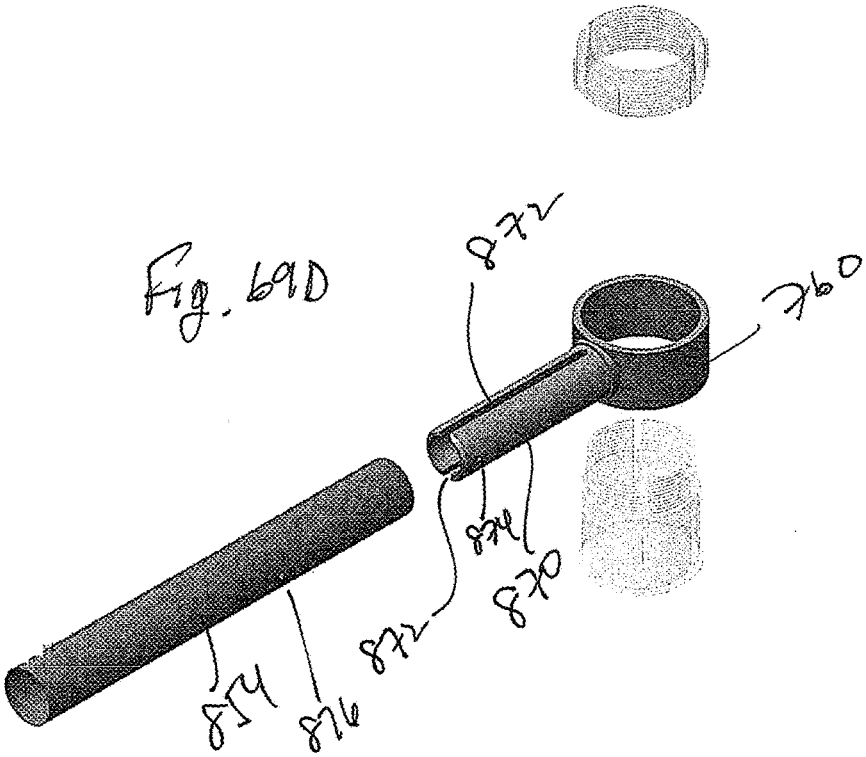
Figure 69E:
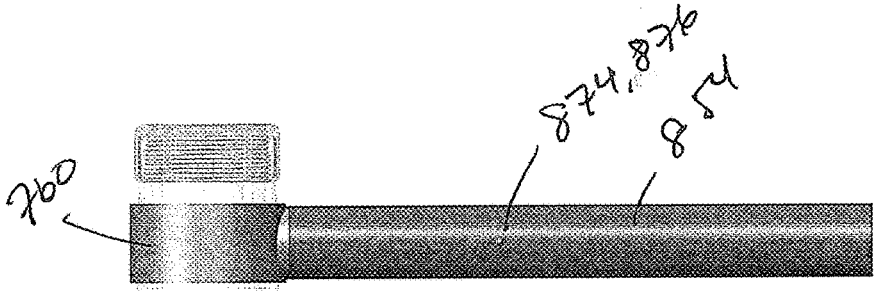
Figure 69F:
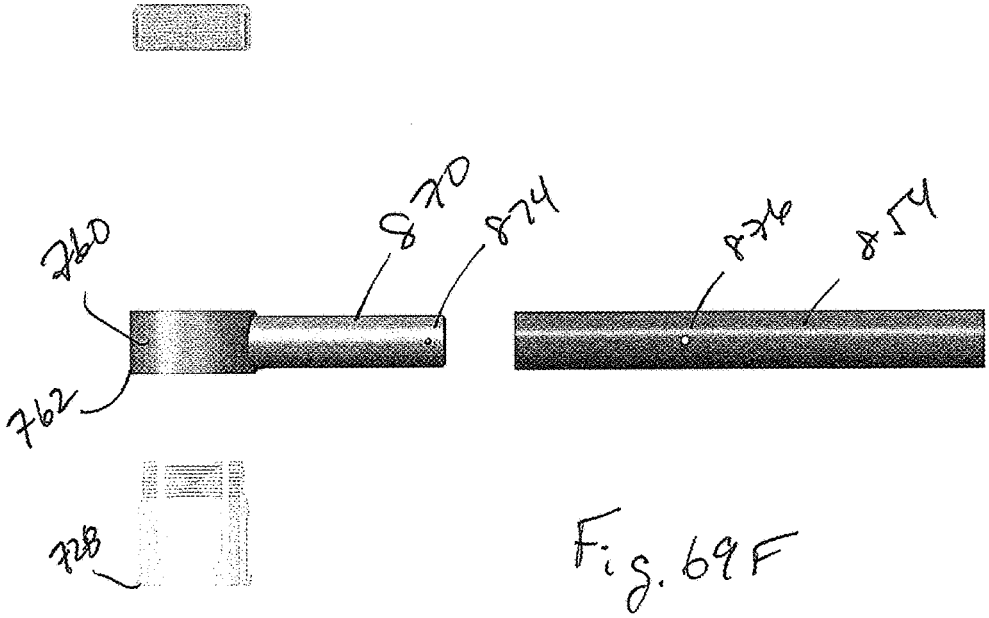
Figure 70:
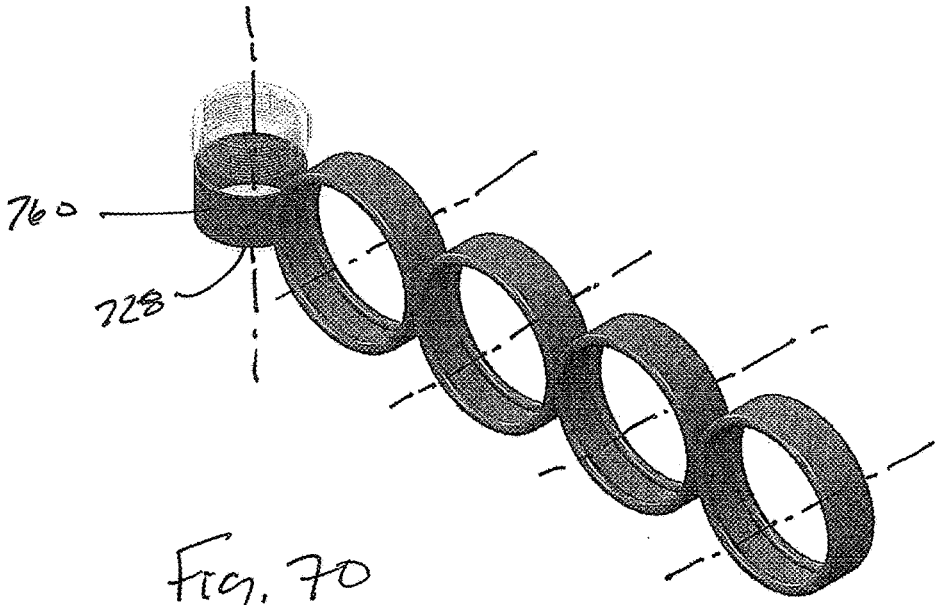
Figure 71:
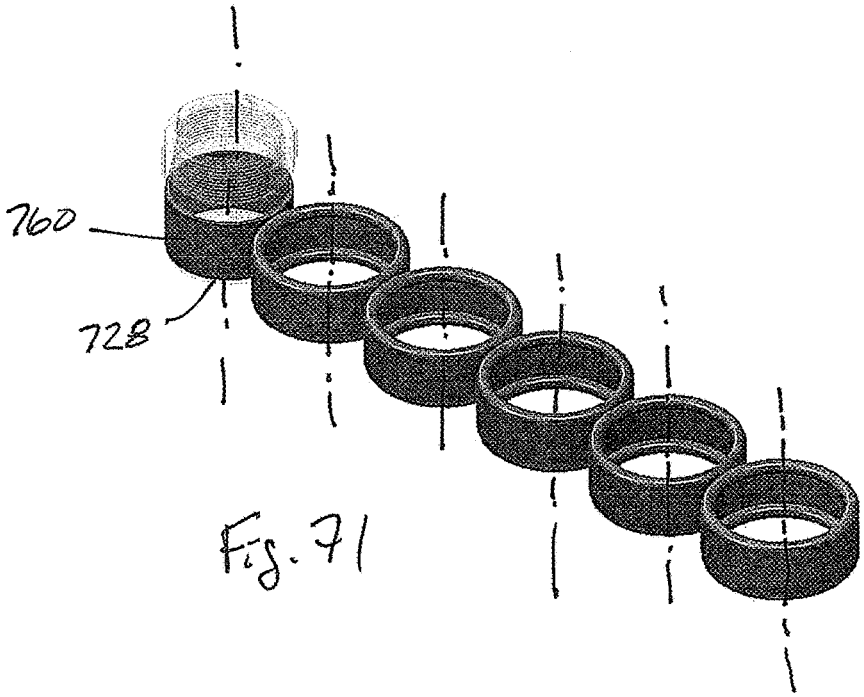
Figure 72:
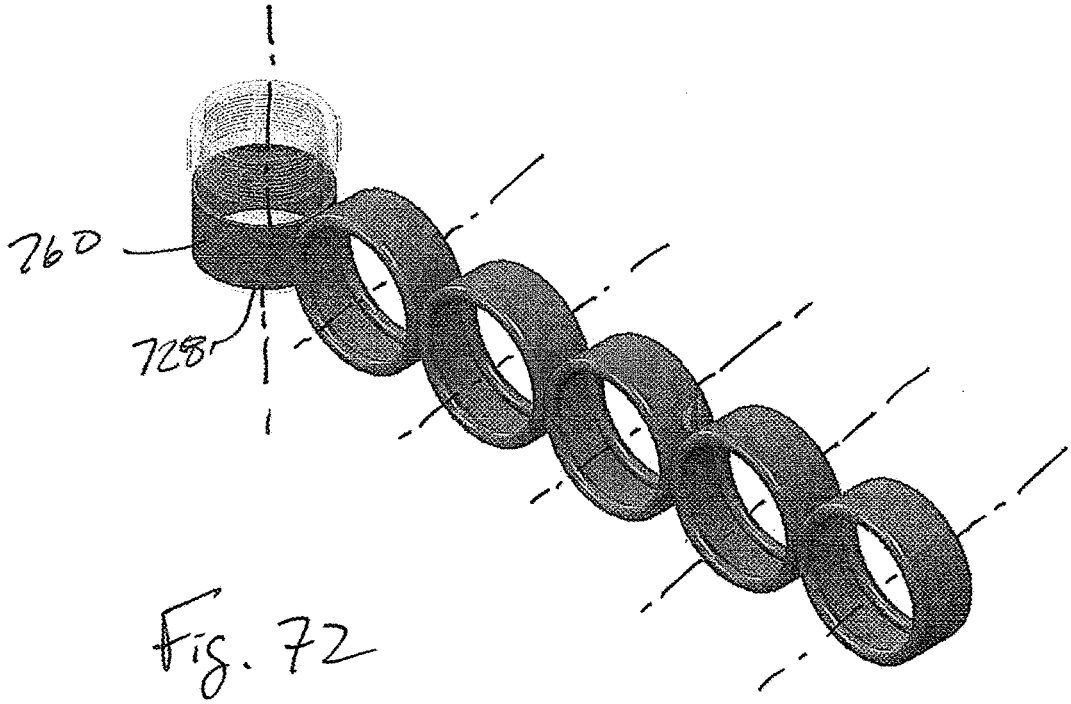
Figure 73:
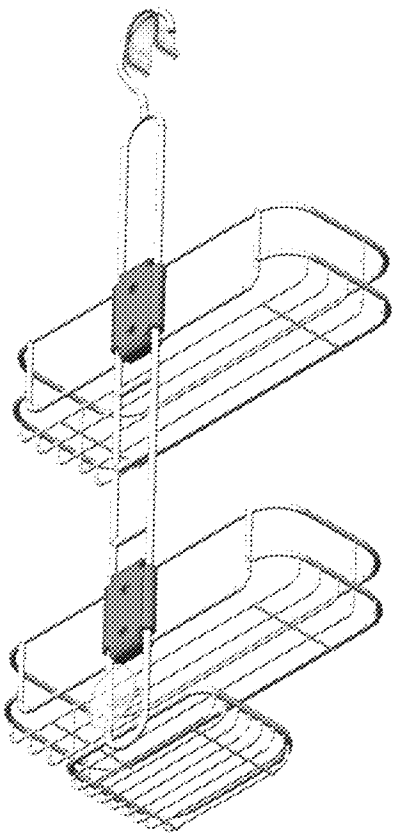
Figure 74:
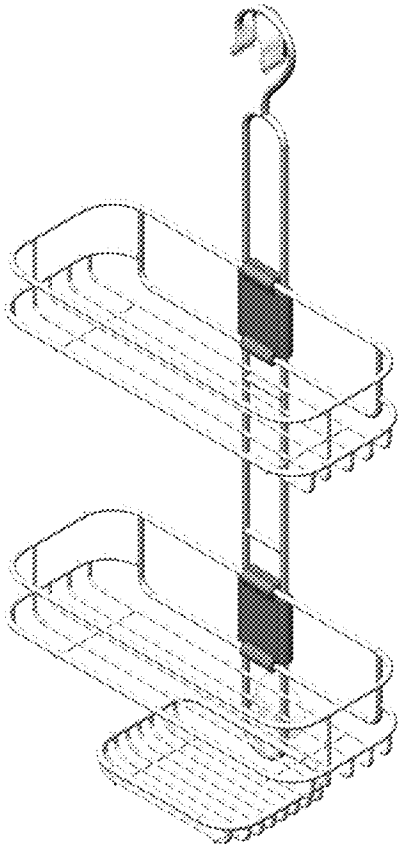
Figure 76:
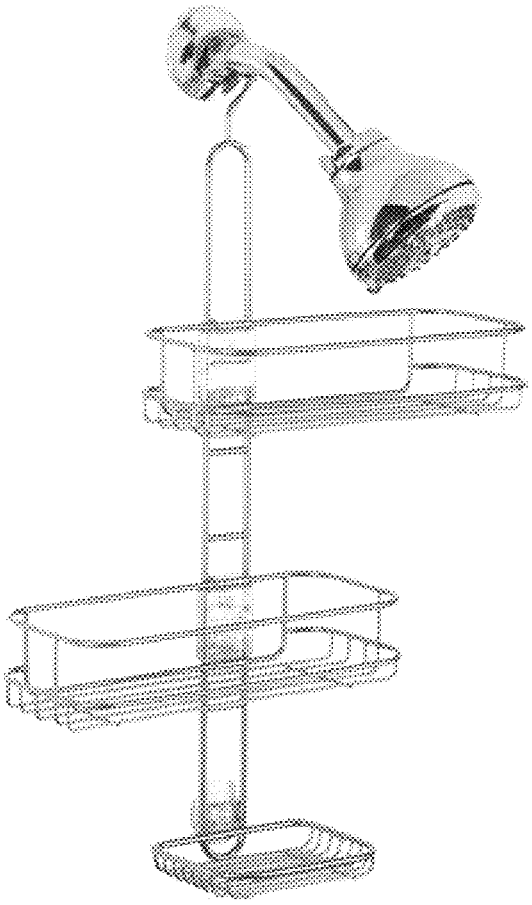
Figure 77:
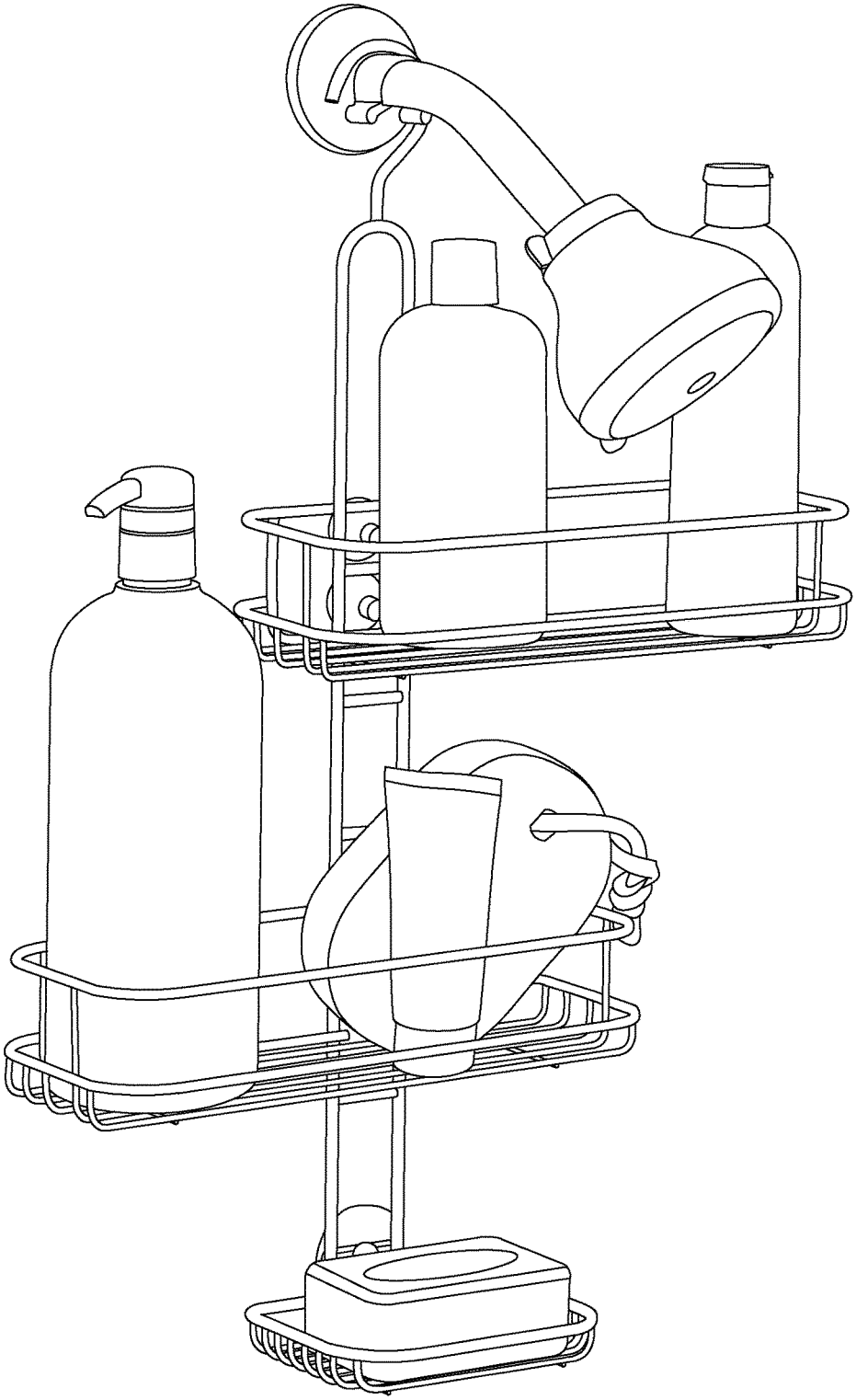

In the exemplary embodiment of FIGS. 69A-69E, the collar 760 has an integrally molded radial extension 870, which has a diameter sized to permit a user to assemble an accessory (exemplified in these figures by a tube 854) to its collar 760 simply by aligning them as shown in FIG. 69B and pushing the extension 870 into an opening 856 in a portion of the accessory. The extension 870 permits the accessory 854 to be inserted onto the radial extension 870 and permits the accessory to be rotated about the longitudinal axis of the radial extension 870. The radial extension 870 has two longitudinal slots 872 that permit the radial extension 870 to flex so that the accessory 854 can be inserted onto the radial extension 870. Additionally, the radial extension 870 has a pair of projections 874 that extend into matching detents 876 in the accessory, which helps prevent the accessory 854 from being easily pulled off. This method of attaching an accessory to a collar can be used for virtually any of the accessories having a tubular extension extending radially or approximately radially from the collar 760, e.g., bars (e.g., towel bars), racks (e.g., pants racks), mirrors, the rings of FIGS. 65A-65B, the hooks of FIGS. 66A-66B, etc. In this embodiment of FIGS. 69A-69E, the inside diameter of the opening 856 of the accessory 854 is about 0.858 inches. Similarly, the diameter of the radial extension 870 at the projections 874 is about 0.635 inches and the diameter of the radial extension 870 between the projections 874 is about 0.575 inches.

A kit with written instructions having the foregoing attachment instructions printed thereon can be included with any of the foregoing collars 760 with radial projections 850, 860, 870 and any of the various accessories disclosed herein, or a plurality of such collars 760 with radial projections 850, 860, 870 and a plurality of such accessories. Such kits can also include a frame or a plurality of members to be assembled into a frame with corresponding frame assembly instructions.

Any one or any two or more of the kits discussed herein can be combined with any one or any two or more of the other kits discussed herein. Such kits can also include a frame or a plurality of members to be assembled into a frame with corresponding frame assembly instructions.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members or elements.

All of the compression sleeve embodiments herein can be adjusted vertically up or down on a frame or a portion of a frame by loosening a corresponding compression collar, moving the compression sleeve and the parts supported by the compression sleeve, and re-tightening the compression collar.

While the present invention has been illustrated by the description of embodiments thereof, and while the embodiments have been described in considerable detail, it is not the intention of the applicants to restrict or in any way limit the scope of the invention to such details. Although the embodiments have been discussed herein in the context of shower caddies with adjustable baskets, many of the teachings herein will also apply to shelving systems in general having baskets and shelving systems having non-basket shelves. Thus, all the shower station/shower caddy embodiments can also be considered to be shelving system embodiments and the teachings with respect to baskets can also be applied to shelves in general. As another example, all of the compression sleeve embodiments herein can be modified to use any one or any two or more of: a set screw threaded into a threaded or non-threaded opening in the collar or adapter that extends radially out from an axis of the collar/adapter (e.g., an axis of rotational symmetry of the collar/adapter) (not shown) which set screw can be moved into the frame opening to engage the frame and/or a clamping lever hinged to the collar/adapter body (not shown) that provides a lever that can be manually moved to engage and disengage the frame to secure the collar/adapter to the frame, and release the adapter from the frame, respectively. Additional advantages and modifications will readily appear to those skilled in the art. For example, where components are releasably or removably connected or attached together, any type of releasable connection may be suitable including for example, locking connections, fastened connections, tongue and groove connections, etc. As another example, although many of the horizontally adjustable baskets herein are able to slide about 80% of its width, it can still be beneficial if the baskets slide to a lesser extent, e.g., be able to slide 40-80% of its width or be able to slide greater than 60% of its width or slide greater than 40% of its width. As yet another example, all of the examples herein that can be used with a frame or a portion of a frame can, instead be used with a tension pole, e.g., a spring tensioned pole that adjusts from 5 feet to nine feet between floor to ceiling and that has non-skid feet at the top and the bottom for added stability. Thus, all of the kits described herein can include one or two such tension poles along with any one or any two or more of any of the various compression sleeve/collar shelves, baskets, and/or accessories described herein, along with corresponding printed instructions to install them and move them vertically and/or horizontally and/or relocate them to different adapters. Still further, component geometries, shapes, and dimensions can be modified without changing the overall role or function of the components. Therefore, the inventive concept, in its broader aspects, is not limited to the specific details, the representative apparatus, and illustrative examples shown and described. Accordingly, departures may be made from such details without departing from the spirit or scope of the applicant's general inventive concept.

EXEMPLARY EMBODIMENTS

Exemplary Embodiment 1

A suction cup clip, comprising:

a. a first portion configured to removably couple to a tubular frame member of a frame without tools or fasteners or adhesive;

b. a second portion affixed to the first portion configured to removably couple to a suction cup without tools or fasteners or adhesive.

Exemplary Embodiment 2

The suction cup clip of embodiment 1:

a. wherein the first portion comprises a body having a wall forming a hollow therein that is at least partially cylindrical and the wall also forming an axial radial opening into the hollow portion, and the body having an axial opening at each end of the hollow portion, each axial opening shaped at least in part like a section of a circle; wherein the first portion can be forced onto a tubular member of a frame by forcing the tubular member through the axial radial opening and into the hollow to secure the first portion to the tubular member without tools or fasteners or adhesive; and b. wherein the second portion comprises a snap-fit opening having a narrow channel opening to a wider portion that accepts and retains a narrow portion of a suction cup.

Exemplary Embodiment 3

An adjustable shelf or basket, comprising:

a. a shelf or basket having a collar affixed thereto, the collar having an opening with a flange or other surface that accepts and is supported by a compression sleeve in a vertical orientation when a surface of the shelf or basket is in a horizontal orientation; and b. a compression sleeve for insertion in the collar and having a threaded end; and c. a compression collar for threadably coupling to the compression sleeve to secure the shelf or basket.

Exemplary Embodiment 4

An adjustable accessory, comprising:

a. one of a mirror, towel bar, dish, and hook a having a collar affixed thereto, the collar having an opening with a flange or other surface that accepts and is supported by a compression sleeve in a vertical orientation when the mirror, towel bar, dish, and hook is in an in-use orientation; and b. a compression sleeve for insertion in the collar and having a threaded end; and c. a compression collar for threadably coupling to the compression sleeve to secure the accessory.

Exemplary Embodiment 5

A pivot hook, comprising:

a plurality of connectable portions that interconnect without tools or adhesive to form a body having an enclosed space through which a shower pipe can extend to support a shelving system; and a coupler affixed to at least one of the portions; and wherein the plurality of portions each have snap-fit connectors to permit them to be assembled together to form the enclosed space without tools or adhesive.

Exemplary Embodiment 6

The pivot hook according to embodiment 5, wherein the plurality of connectable portions comprise first and second portions that connect to form a substantially circular annulus forming an enclosed space through which a shower pipe can extend to support a shelving system; and wherein the first portion comprises a section of from about 260 to about 280 degrees of the annulus, comprises flexible material on an inner surface of the annulus, comprises at least one arcuate metal reinforcing piece to strengthen the pivot hook; and wherein the second comprises a section of from about 100 to about 80 degrees of the annulus and comprises flexible material on an inner surface of the annulus; and wherein the first and second portions snap together to form the annulus when about 3-15 pounds of pressure are applied to one of the pieces relative to the other piece while the pieces are aligned.

7

A suction cup assembly, comprising:

an end cap movably connected to a rotor arm having at least one suction cup affixed thereto, the end cap configured to couple to a member of a shelving system, and the rotor arm providing for both rotational and lateral motion of the at least suction cup relative to the end cap; and wherein the rotor arm comprises a longitudinal channel that couples to the end cap via a snap-fit connection, the snap-fit connection providing for rotational motion around a pivot point created by the snap-fit connection and also providing for lateral motion along the longitudinal axis of the channel.

Exemplary Embodiment 8

An adjustable shelf or basket, comprising:

a. a shelf or basket having a bracket affixed thereto, the bracket carrying a compression sleeve in a vertical orientation when a surface of the shelf or basket is in a horizontal orientation; and b. a compression collar for threadably coupling to the compression sleeve to secure the shelf or basket; and wherein the bracket slidably retains the shelf or basket in a manner that permits the shelf or basket to be moved horizontally by hand without tools and without loosening a fastener or latching mechanism by applying greater than three pounds of force and the bracket retains the shelf or basket in place when less than three pounds of force are applied.

Exemplary Embodiment 9

A suction cup assembly for securing a frame of a shelving system to a surface, comprising:

a suction cup threadably coupled to a knob, the suction cup being on one side of a body and the knob being on the other side of the body, and the knob and suction arranged so that turning the knob causes the suction cup to grip tighter to a portion of the surface engaging the perimeter of the suction cup; and an arm rotatably coupled to the body about an axis, the arm having a frame securing end at a distal end of the arm; and wherein the suction cup, arm, and body cooperate to secure the frame of the shelving system to the surface at a point along the axis of rotation of the arm while permitting the suction cup to be positioned in a plurality of different rotational positions around the axis.

Exemplary Embodiment 10

A suction cup assembly of embodiment 9 wherein the suction cup, arm, and body cooperate to secure the frame of the shelving system to the surface at a point along the axis of rotation of the arm while permitting the suction cup to be positioned in any rotational position around the axis.

Exemplary Embodiment 11

A suction cup assembly of embodiment 9 wherein the suction cup, arm, and body cooperate to secure the frame of the shelving system to the surface at a point along the axis of rotation of the arm while permitting the suction cup to be positioned in any rotational position around the axis within a range of at least 180 degrees around the axis.

Exemplary Embodiment 12

A suction cup assembly of any of embodiments 9-11 wherein the frame securing end of the arm comprises a collar through which a frame member extends to help secure the frame to the surface.

Exemplary Embodiment 13

A suction cup assembly of any of embodiments 9-11 wherein the frame securing end of the arm comprises a surface with one of a projection and a like shaped opening, the frame securing end accepting a keyed plug of a frame member having the other of the projection and the like shaped opening to help secure the frame to the surface and to also rotationally secure the frame against rotational motion along a longitudinal axis of the frame.

Exemplary Embodiment 14

An adjustable shelf or basket permitting the shelf or basket to be re-sequenced on a frame without disassembling the frame and without tools, comprising:

a. a shelf or basket affixed to at least one support that supports the shelf or basket; and b. at least one adapter having a frame opening extending therethrough that accepts and is supported by a portion of a frame in a vertical orientation when in use, the adapter also having at least one support opening that removably accepts a portion of the at least one support, wherein the at least one support and the at least one adapter cooperate to support the shelf or basket and retain a surface of the shelf or basket in a horizontal orientation when the portion of the frame is in a vertical orientation; and wherein the at least one support can be removed from the at least one adapter by hand without tools permitting the shelf or basket to be removed from the at least one adapter by hand without tools.

Exemplary Embodiment 15

An adjustable accessory permitting the accessory to be re-sequenced on a frame without disassembling the frame and without tools, comprising:

a. an accessory (e.g., one of a mirror, towel bar, dish, and hook) affixed to at least one support that supports the accessory; and b. at least one adapter having a frame opening extending therethrough that accepts and is supported by a portion of a frame in a vertical orientation when in use, the adapter also having at least one support opening that removably accepts a portion of the at least one support;

wherein the at least one support and the at least one adapter cooperate to support the accessory and retain the accessory in an in-use orientation when the portion of the frame is in a vertical orientation; and wherein the at least one support can be removed from the at least one adapter by hand without tools permitting the accessory to be removed from the at least one adapter by hand without tools.

Exemplary Embodiment 16

An adjustable shelf or basket permitting the shelf or basket to be re-sequenced on a frame without disassembling the frame and without tools, comprising:

a. a shelf or basket affixed to at least one support that supports the shelf or basket; and b. at least one adapter having a sleeve opening extending therethrough with a flange or other surface that accepts and is supported by a compression sleeve in a vertical orientation when in use, the adapter also having at least one support opening that removably accepts a portion of the at least one support, c. a compression sleeve for insertion in the sleeve opening of the adapter and having a threaded end; and d. a compression collar for threadably coupling to the compression sleeve to secure the adapter; and wherein the at least one support and the at least one adapter cooperate to support the shelf or basket and retain a surface of the shelf or basket in a horizontal orientation when the compression sleeve is in a vertical orientation; and wherein the at least one support can be removed from the at least one adapter by hand without tools permitting the shelf or basket to be removed from the at least one adapter by hand without tools.

Exemplary Embodiment 17

An adjustable accessory permitting the accessory to be re-sequenced on a frame without disassembling the frame and without tools, comprising:

a. an accessory (e.g., one of a mirror, towel bar, dish, and hook) affixed to at least one support that supports the accessory; and b. at least one adapter having a sleeve opening extending therethrough with a flange or other surface that accepts and is supported by a compression sleeve in a vertical orientation when in use, the adapter also having at least one support opening that removably accepts a portion of the at least one support;

c. a compression sleeve for insertion in the opening of the adapter and having a threaded end; and d. a compression collar for threadably coupling to the compression sleeve to secure the adapter; and wherein the at least one support and the at least one adapter cooperate to support the accessory and retain the accessory in an in-use orientation when the compression sleeve is in a vertical orientation; and wherein the at least one support can be removed from the at least one adapter by hand without tools permitting the accessory to be removed from the at least one adapter by hand without tools.

Exemplary Embodiment 18

The adjustable shelf or basket or accessory according to any of embodiments 14-17, wherein the at least one support has a portion extending substantially parallel to an axis of the compression sleeve and the support opening in the at least one adapter also extends substantially parallel to an axis of the compression sleeve.

Exemplary Embodiment 19

The adjustable shelf or basket or accessory according to any of embodiments 14-18, wherein the adjustable shelf or basket or accessory comprises at least two adapters and at least two supports in different locations to support the shelf or basket or accessory and wherein each adapter accepts a respective support.

Exemplary Embodiment 20

The adjustable shelf or basket or accessory according to any of embodiments 14-19, wherein the adjustable shelf or basket or accessory can be removed from the at least one adapter simply by lifting the portion of the at least one support out of the support opening of the at least one adapter.

Exemplary Embodiment 21

The adjustable shelf or basket or accessory according to any of embodiments 14-20, wherein the adjustable shelf or basket or accessory comprises at least two adapters and at least two supports in different locations to support the shelf or basket or accessory and wherein each adapter accepts a respective support, and further wherein the adjustable shelf or basket or accessory can be removed from the at least two adapters simply by lifting the portion of the at least one support out of the support opening of a respective adapter.

Exemplary Embodiment 22

The adjustable shelf or basket or accessory according to any of embodiments 14-21, wherein the accessory comprises one or any two or more of: (a) a plurality of adjacent rings rigidly connected to each other and to a support; (b) a plurality of hooks in the same orientation affixed to and carried by a linear carrier having a support at a proximal end; (c) a plurality of hooks in the same orientation affixed to and carried by a linear carrier having a support at a proximal end, and wherein a bent portion of the linear carrier forms the portion of the support accepted by the support opening of the adapter; (d) a mirror; (e) a towel bar; (f) a dish; (g) a plurality of rigidly affixed rings; (h) a pants hanger; (i) one or more garment hanging clips; and (j) a plurality of affixed, parallel supports for pants, towels, etc.

What is claimed is:

1. A caddy, comprising:

a. a frame having first and second spaced, elongate wire portions;

b. a plurality of shelves carried by the frame in such a manner that when the first and second spaced, elongate wire portions of the frame are in a substantially vertical orientation, the shelves are in a substantially horizontal orientation; and c. at least one bracket slidably retaining a respective one of the plurality of shelves to the first and second spaced, elongate wire portions; the bracket configured to tightly secure itself to the first and second spaced, elongate wire portions of the frame; and the bracket further configured to secure itself to the respective shelf to permit the respective shelf to be moved horizontally relative to the frame by hand without tools and without loosening a fastener or latching mechanism; and wherein the bracket comprises first and second halves secured to each other with the first and second spaced, elongate wire portions of the frame positioned therebetween to tightly secure the bracket to the first and second spaced, elongate wire portions of the frame.

2. The caddy according to claim 1, wherein the plurality of shelves comprises a plurality of baskets and wherein the respective shelf comprises at least one respective basket.

3. The caddy according to claim 1, wherein the first elongate wire portion of the frame is tightly secured in a first channel of the first half on one side and a second channel of the second half on the other side; and further wherein the second elongate wire portion of the frame is tightly secured in a third channel of the first half on one side and a fourth channel of the second half on the other side.

4. The caddy according to claim 1, wherein the first and second halves of the bracket are secured to each other via at least one fastener with the first and second spaced, elongate wire portions of the frame positioned therebetween to tightly secure the bracket to the first and second spaced, elongate wire portions of the frame.

5. The caddy according to claim 4, wherein the bracket is configured to be adjusted vertically along the first and second spaced, elongate wire portions of the frame if the at least one fastener is loosened.

6. The caddy according to claim 4, wherein the first elongate wire portion of the frame is tightly secured in a first channel of the first half on one side and a second channel of the second half on the other side by a force provided by the at least one fastener; and further wherein the second elongate wire portion of the frame is tightly secured in a third channel of the first half on one side and a fourth channel of the second bracket half on the other side by a force provided by the at least one fastener.

7. The caddy according to claim 5, wherein the first elongate wire portion of the frame is tightly secured in a first channel of the first half on one side and a second channel of the second half on the other side by a force provided by the at least one fastener; and further wherein the second elongate wire portion of the frame is tightly secured in a third channel of the first half on one side and a fourth channel of the second half on the other side by a force provided by the at least one fastener.

8. The caddy according to claim 1, wherein the respective shelf is formed from at least first and second basket wire portions; and wherein the first and second basket wire portions are slidably secured between the first and second halves.

9. The caddy according to claim 1, wherein the respective shelf is formed from at least first and second basket wire portions; and wherein the first basket wire portion is slidably secured in a first basket wire channel of the first half on one side and on the other side by a first projection of the second half and wherein the second basket wire portion is slidably secured in a second basket wire channel of the first half on one side and on the other side by a second projection of the second half.

10. The caddy according to claim 3, wherein the respective shelf is formed from at least first and second basket wire portions; and wherein the first basket wire portion is slidably secured in a first basket wire channel of the first half on one side and on the other side by a first projection of the second half and wherein the second basket wire portion is slidably secured in a second basket wire channel of the first half on one side and on the other side by a second projection of the second half.

11. The caddy according to claim 4, wherein the respective shelf is formed from at least first and second basket wire portions; and wherein the first basket wire portion is slidably secured in a first basket wire channel of the first half on one side and on the other side by a first projection of the second half and wherein the second basket wire portion is slidably secured in a second basket wire channel of the first half on one side and on the other side by a second projection of the second half.

12. The caddy according to claim 5, wherein the respective shelf is formed from at least first and second basket wire portions; and wherein the first basket wire portion is slidably secured in a first basket wire channel of the first half on one side and on the other side by a first projection of the second half and wherein the second basket wire portion is slidably secured in a second basket wire channel of the first half on one side and on the other side by a second projection of the second half.

13. The caddy according to claim 6, wherein the respective shelf is formed from at least first and second basket wire portions; and wherein the first basket wire portion is slidably secured in a first basket wire channel of the first half on one side and on the other side by a first projection of the second half and wherein the second basket wire portion is slidably secured in a second basket wire channel of the first half on one side and on the other side by a second projection of the second half.

14. The caddy according to claim 7, wherein the respective shelf is formed from at least first and second basket wire portions; and wherein the first basket wire portion is slidably secured in a first basket wire channel of the first half on one side and on the other side by a first projection of the second half and wherein the second basket wire portion is slidably secured in a second basket wire channel of the first half on one side and on the other side by a second projection of the second half.

15. A kit comprising a caddy according to claim 1 and instructions for moving the respective shelf horizontally relative to the frame by hand without tools and without loosening a fastener or latching mechanism.

16. The kit according to claim 15, wherein the first and second halves of the bracket are secured to each other via at least one fastener with the first and second spaced, elongate wire portions of the frame positioned therebetween to tightly secure the bracket to the first and second spaced, elongate wire portions of the frame; wherein the bracket is configured to be adjusted vertically along the first and second spaced, elongate wire portions of the frame if the at least one fastener is loosened; wherein the first elongate wire portion of the frame is tightly secured in a first channel of the first half on one side and a second channel of the second half on the other side by a force provided by the at least one fastener; and further wherein the second elongate wire portion of the frame is tightly secured in a third channel of the first half on one side and a fourth channel of the second half on the other side by a force provided by the at least one fastener; and wherein the respective shelf is formed from at least first and second basket wire portions; and wherein the first basket wire portion is slidably secured in a first basket wire channel of the first half on one side and on the other side by a first projection of the second half and wherein the second basket wire portion is slidably secured in a second basket wire channel of the first half on one side and on the other side by a second projection of the second half.

17. The kit according to claim 15, wherein the first elongate wire portion of the frame is tightly secured in a first channel of the first half on one side and a second channel of the second half on the other side; and further wherein the second elongate wire portion of the frame is tightly secured in a third channel of the first half on one side and a fourth channel of the second half on the other side.

18. The kit according to claim 15, wherein the first and second halves of the bracket are secured to each other via at least one fastener with the first and second spaced, elongate wire portions of the frame positioned therebetween to tightly secure the bracket to the first and second spaced, elongate wire portions of the frame.

19. The kit according to claim 15, wherein the first and second halves of the bracket are secured to each other via at least one fastener with the first and second spaced, elongate wire portions of the frame positioned therebetween to tightly secure the bracket to the first and second spaced, elongate wire portions of the frame and wherein the bracket is configured to be adjusted vertically along the first and second spaced, elongate wire portions of the frame if the at least one fastener is loosened.

20. The kit according to claim 15, wherein the first and second halves of the bracket are secured to each other via at least one fastener with the first and second spaced, elongate wire portions of the frame positioned therebetween to tightly secure the bracket to the first and second spaced, elongate wire portions of the frame; wherein the first elongate wire portion of the frame is tightly secured in a first channel of the first half on one side and a second channel of the second half on the other side by a force provided by the at least one fastener; and further wherein the second elongate wire portion of the frame is tightly secured in a third channel of the first half on one side and a fourth channel of the second bracket half on the other side by a force provided by the at least one fastener.

* * * * *